US008193997B2

(12) United States Patent
Webb

(10) Patent No.: US 8,193,997 B2
(45) Date of Patent: Jun. 5, 2012

(54) DIRECTIONAL PLANAR LOG-SPIRAL SLOT ANTENNA

(75) Inventor: Spencer Webb, Pelham, NH (US)

(73) Assignee: Antennasys, Inc., Pelham, NH (US)

( * ) Notice: Subject to any disclaimer, the term of this patent is extended or adjusted under 35 U.S.C. 154(b) by 445 days.

(21) Appl. No.: 12/544,838

(22) Filed: Aug. 20, 2009

(65) Prior Publication Data

US 2011/0043414 A1 Feb. 24, 2011

(51) Int. Cl.
*H01Q 1/36* (2006.01)

(52) U.S. Cl. ..... 343/895; 343/767; 343/792.5

(58) Field of Classification Search ..... 343/767, 343/792.5, 895
See application file for complete search history.

(56) References Cited

U.S. PATENT DOCUMENTS

| | | | | |
|---|---|---|---|---|
| 3,618,114 | A | 11/1971 | Dietrich | |
| 4,095,230 | A * | 6/1978 | Salmond et al. | 343/729 |
| 4,114,164 | A * | 9/1978 | Greiser | 343/895 |
| 4,319,248 | A * | 3/1982 | Flam | 343/701 |
| 5,053,786 | A | 10/1991 | Silverman | |
| 5,313,216 | A * | 5/1994 | Wang et al. | 343/700 MS |
| 6,191,756 | B1 * | 2/2001 | Newham | 343/895 |
| 6,407,721 | B1 * | 6/2002 | Mehen et al. | 343/895 |
| 6,853,351 | B1 | 2/2005 | Mohuchy | |

OTHER PUBLICATIONS

RFspin s.r.o. "SCSA-27 Electrical specification", retrieved from http://www.rfspin.cz/anteny/scsa-27.php on Sep. 14, 2009, 5 pages.

Piksa, "Log-Spiral antenna from 2 to 40 GHz with impedance matching", 4 pages.

Johnson, "Antenna Engineering Handbook", Third edition, DuHamel et al. Frequency-Independent Antennas, 20 pages.

VDAR-1 Antenna, "Single 5dBic "Hybrid-Patch" Antenna with mounting option", 1 page.

Lo et al. "Antenna Handbook" vol. II, "Antenna Theory", "Frequency-Independent Antennas", 4.Log-Spiral Antennas, 1993, 11 pages.

International Search Report and Written Opinion for corresponding PCT application, dated Dec. 21, 2010, 8 pages.

Notification Concerning Transmittal of Copy of International Preliminary Report on Patentability dated Mar. 1, 2012, 6 page.

* cited by examiner

*Primary Examiner* — Tho G Phan
(74) *Attorney, Agent, or Firm* — ARC IP Law, PC; Joseph J. Mayo

(57) ABSTRACT

Directional wide band antenna that may be utilized to enhance cell phone coverage within a building, or for signals intelligence collection (SIGINT). Includes a log-spiral slot antenna with feed-point configured to transfer energy to/from the antenna. Includes an energy absorbent backing and an energy absorbent siding coupled with the log-spiral slot antenna. Includes a cavity behind the log-spiral slot antenna and in front of the energy absorbent backing. Includes a cable connector coupled to a tapered microstrip line coupled to the feed-point wherein the tapered microstrip line is configured to transform the input impedance to the antenna impedance. Housed in a container configured to hold the above listed components. Energy absorbent siding, cavity and energy absorbent backing greatly reduces back lobes. Another embodiment has log-spiral shaped slots at an outer portion of the log-spiral slot antenna overlap with the energy absorbent siding and wherein the feed-point overlaps the cavity.

20 Claims, 64 Drawing Sheets

A

B

S1,1 ( 150 Ohm)

Frequency / MHz $S_{1,1}$ 710.2218888 ( 127.2313158, -17.6055377 ) Ohm $S_{2,2}$ 2038.2455207 ( 164.1945111, 6.6441248 ) Ohm

FIGURE 64

AntennaSys, Inc. Model No. ALS7025
Prototype No. 1

| Frequency (MHz) | Gain (dBic) | HPBW (deg.) | On-Axis Axial Ratio (dB) | F/B (dB) | Estimated Directivity* (dBic) | Estimated Radiation Efficiency |
|---|---|---|---|---|---|---|
| 700 | - | 80 | 5.3 | 34 | 8.1 | - |
| 776 | 4.0 | 80 | 3.9 | 24 | 8.1 | 39 |
| 874 | 5.1 | 80 | 3.2 | 41 | 8.1 | 50 |
| 950 | 4.1 | 83 | 1.9 | 30 | 7.8 | 43 |
| 1900 | 4.7 | 98 | 0.4 | 28 | 6.3 | 69 |
| 1982 | 4.8 | 100 | 0.2 | 34 | 6.2 | 72 |
| 2450 | 5.1 | 97 | 0.5 | 32 | 6.4 | 74 |

** NOTE: Directivity values shown are estimated as Do(dB)=10*log10(41,253/(HPBW^2)).*

DIRECTIONAL PLANAR LOG-SPIRAL SLOT ANTENNA

BACKGROUND OF THE INVENTION

1. Field of the Invention

One or more embodiments setting forth the ideas described throughout this disclosure pertain to the field of antennas. More particularly, but not by way of limitation, one or more aspects of the disclosure enable a directional planar log-spiral slot antenna.

2. Description of the Related Art

Some buildings are difficult to receive cell phone coverage in. In order to provide cell phone coverage in these buildings, "microcells" have been installed to accommodate cell phone calls within these buildings. Microcells are implemented as low power cell instances in a mobile phone network wherein the microcells have a correspondingly low coverage area with respect to a standard cell. Typical microcell range is under a mile in radius. Current implementations of microcells suffer from the types of antennas that are utilized. These microcells are generally omnidirectional antennas that allow access from locations external to the building in which they are installed.

Use of wide band antennas allows for the cell or microcell sites to handle more phone calls. Thus, wide band antennas are generally used for cell antennas. Walls in buildings begin to attenuate the cell phone signals at around 1.8 GHz and thus although coverage is limited above this frequency, the number of calls that may be handled is actually higher as individual floors within a building may simultaneously use the same frequency for separate phone calls.

Another approach to increase coverage within buildings uses bi-directional amplifiers (BDAs) to boost the cell phone coverage by receiving cell phone signals, amplifying them and retransmitting the signals, for example into/out of a building and from/to an existing cell tower for example. This solution may be cheaper and easier to implement than a full fledged microcell, and is expected to form a large portion of the market for increasing cell phone coverage for example within buildings. These installations utilize antennas within the building and an antenna generally on the outside of a building for example an externally directed antenna, e.g., pointed in the direction of the highest power cell tower within range.

For microcells and BDAs, it is desirable to primarily employ coverage within the building itself and not outside the building where the cell towers can handle traffic. With better antennas covering the inside of a building, fewer antennas are required as well.

One type of wide band antenna is a planar logarithmic-spiral antenna, also known as a planar log-spiral antenna. Log-spiral antennas have been known at least since 1955. Two-arm Log-spiral antennas generally have two spiral shaped arms shifted 180 degrees from one another. This type of antenna yields left hand circularly polarized radiation in one direction away from the plane, and right hand circularly polarized radiation in the opposite direction. Attempts at absorbing rearward pointing energy in order to make a directional antenna have been less than optimal in that known directional implementations still have sizable back lobes. This means that in the case of a BDA, the antenna pointing into the building would still have a fairly high gain pointing out of the building, which can cause problems with the externally directed antenna for example.

Since cell phones are generally linearly polarized, if wideband linearly polarized antennas are utilized within a building, then when a cell phone tips, i.e., the cell phone antenna is displaced out of a vertical orientation, for example when a cell phone user leans back in a chair, the signal fades. This is known as polarization fade. Circularly polarized antennas, for example coupled with a microcell or BDA, may receive the linearly polarized energy from the cell phone and do not experience this type of fade.

Another application for wideband antennas is for gathering signals for intelligence, i.e., "SIGINT". Wideband antennas for example are utilized in running continuous searches for signals or scanning known frequencies that may extend over a large range. In addition, in the intelligence world, one antenna can be utilized for many purposes. For covert communications, if a transmitter with a wide band antenna is captured for example, it is impossible to tell exactly what frequency the system was operating at. Also, if the antenna has a wide range of operation, e.g., 700 MHz-2500 MHz, there is no way to determine what the antenna was being used for.

For at least the limitations described above there is a need for a directional planar log-spiral slot antenna with low back lobes.

BRIEF SUMMARY OF THE INVENTION

At a high-level the disclosure set forth herein is directed to a directional planar log-spiral slot antenna. Embodiments of the invention enable a directional wide band antenna that may be utilized for example to enhance cell phone coverage within a building or for any other use such as signal intelligence, i.e., "SIGINT".

One such embodiment includes a directional planar log-spiral slot antenna made from a log-spiral slot antenna having a feed-point configured to transfer energy to and from the log-spiral slot antenna wherein the log-spiral slot antenna has an antenna impedance that in one or more embodiments is 150 Ohms. The embodiment further includes an energy absorbent backing and an energy absorbent siding coupled with the energy absorbent backing and further coupled with the log-spiral slot antenna. The embodiment further includes a cavity behind the log-spiral slot antenna and in front of the energy absorbent backing. The energy absorbent siding, cavity and energy absorbent backing greatly reduces back lobes. In one or more embodiments, the absorbent material is polyurethane impregnated with carbon with a net resistivity of 200-400 Ohms/Square.

The embodiment further includes a cable connector having an input impedance, wherein the cable connector for example may couple with a standard cable, such as a coaxial connector, e.g., a 50 Ohm coax. The embodiment further includes a tapered microstrip line coupled to the feed-point and configured to transform the input impedance to the antenna impedance. The embodiment is housed in a container configured to hold the log-spiral slot antenna, the energy absorbent backing, the energy absorbent siding, the cavity, the cable connector and the tapered microstrip line. In one or more embodiments, the tapered microstrip acts as a Tapered Balun, converting the input impedance to the antenna feed-point impedance over a wide frequency range and converting the unbalanced coaxial input to the balanced signal for the antenna feedpoint.

In one or more embodiments of the invention, the absorbent backing overlaps the outer portion of the slot to attenuate the reflected energy, for example at low frequencies. Embodiments of the invention enable great wideband impedance matching with Voltage Standing Wave Ratio (VSWR) below 1.2:1, for example.

BRIEF DESCRIPTION OF THE DRAWINGS

The above and other aspects, features and advantages of the ideas conveyed through this disclosure will be more apparent from the following more particular description thereof, presented in conjunction with the following drawings wherein:

FIG. 64 shows actual antenna performance measured by an independent lab.

DETAILED DESCRIPTION OF THE INVENTION

A directional planar log-spiral slot antenna will now be described. In the following exemplary description numerous specific details are set forth in order to provide a more thorough understanding of the ideas described throughout this specification. It will be apparent, however, to an artisan of ordinary skill that embodiments of ideas described herein may be practiced without incorporating all aspects of the specific details described herein. In other instances, specific aspects well known to those of ordinary skill in the art have not been described in detail so as not to obscure the disclosure. Readers should note that although examples of the innovative concepts are set forth throughout this disclosure, the claims, and the full scope of any equivalents, are what define the invention.

Figure 1:
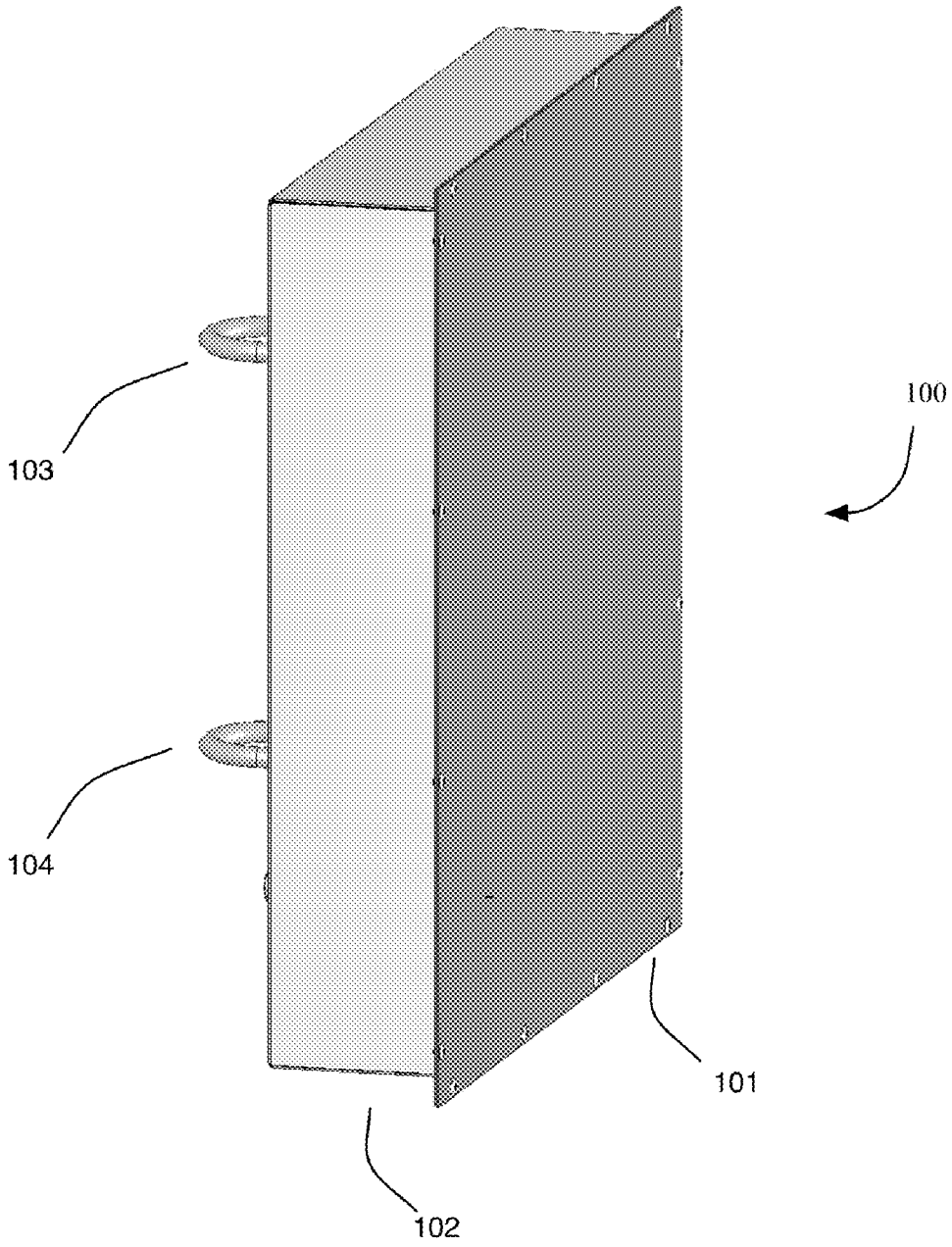
FIG. 1 shows a side perspective view of an embodiment of the invention.

FIG. 1 shows a side perspective view of an embodiment of directional planar log-spiral slot antenna 100. Covering the antenna is radome 101 that in one or more embodiments is riveted to container 102. Container 102 may be mounted using mounting U bolts 103 and 104 for example. Radome 101 may be constructed of any material that minimally attenuates electromagnetic radiation of the frequencies desired for operation of directional planar log-spiral slot antenna 100, and may be implemented as a weatherproof element that prevents water or dust from entering the internal volume enclosed by radome 101 and container 102 for example. One embodiment of the invention utilizes a 17" square fiberglass cover for radome 101, while container 102 is implemented with a 15.9" square aluminum box, 3.2" deep. U-bolts 103 and 104 may be any size, for example 2.375" radius bolts. One skilled in the art will recognize that these dimensions are not to be taken as the only dimensions that embodiments of the invention can be implemented with.

Figure 2:
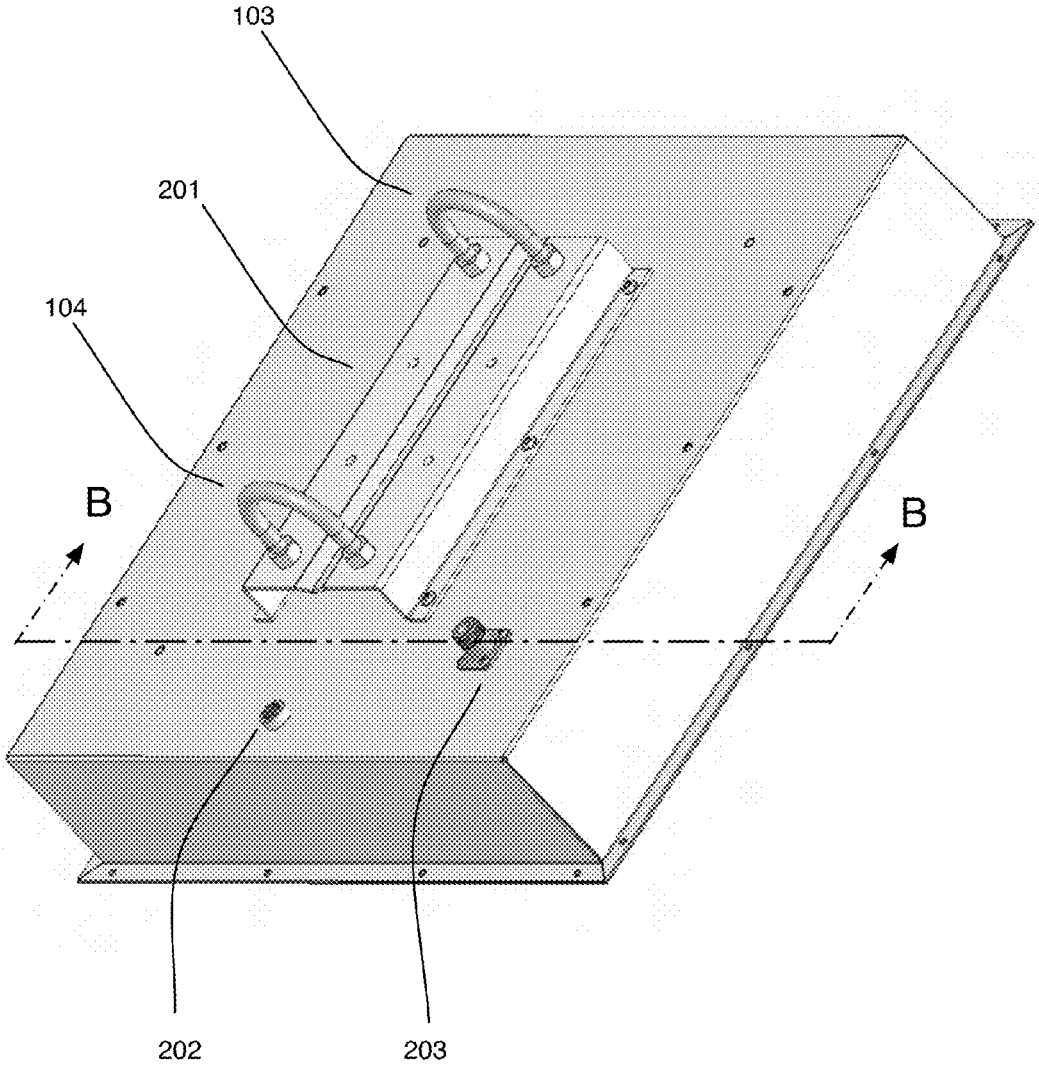
FIG. 2 shows a back perspective view of an embodiment of the invention.

FIG. 2 shows a back perspective view of an embodiment of the invention. Mounting U bolts 103 and 104 couple to container 102 via mounting bracket 201 for example. Any other method of mounting directional planar log-spiral slot antenna 100 is in keeping with the spirit of the invention. Also shown are gas vent 202 that allows for atmospheric pressure compensation. One or more embodiments of gas vent 202 do not allow moisture to enter the volume enclosed by container 102 and radome 101 for example. One or more embodiments of gas vent 202 may utilize a filter that allows gas to enter or exit the internal volume, while keeping moisture or other objects from entering the volume within the container. Cable connector 203 may comprise any type of cable connector, for example a 50 Ohm N-type coaxial cable connector. Any type of connector may be utilized for cable connector 203 depending on the intended application as desired.

Figure 3:
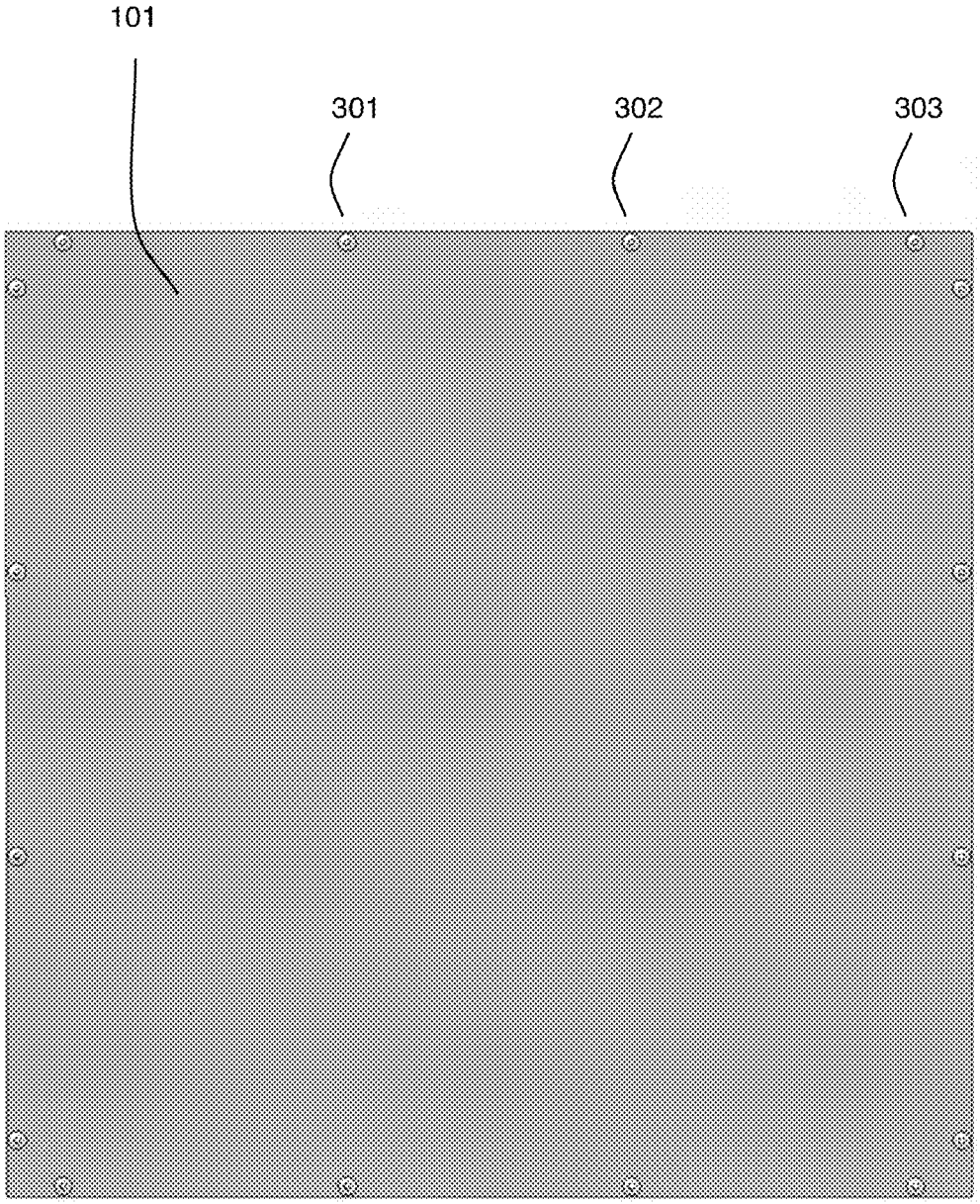
FIG. 3 shows a front view of an embodiment of the invention.

FIG. 3 shows a front view of an embodiment of the invention. Shown coupling radome 101 to the container are rivets 301-303. Any number of rivets or other connection devices may be utilized to couple radome 101 to the container.

Figure 4:
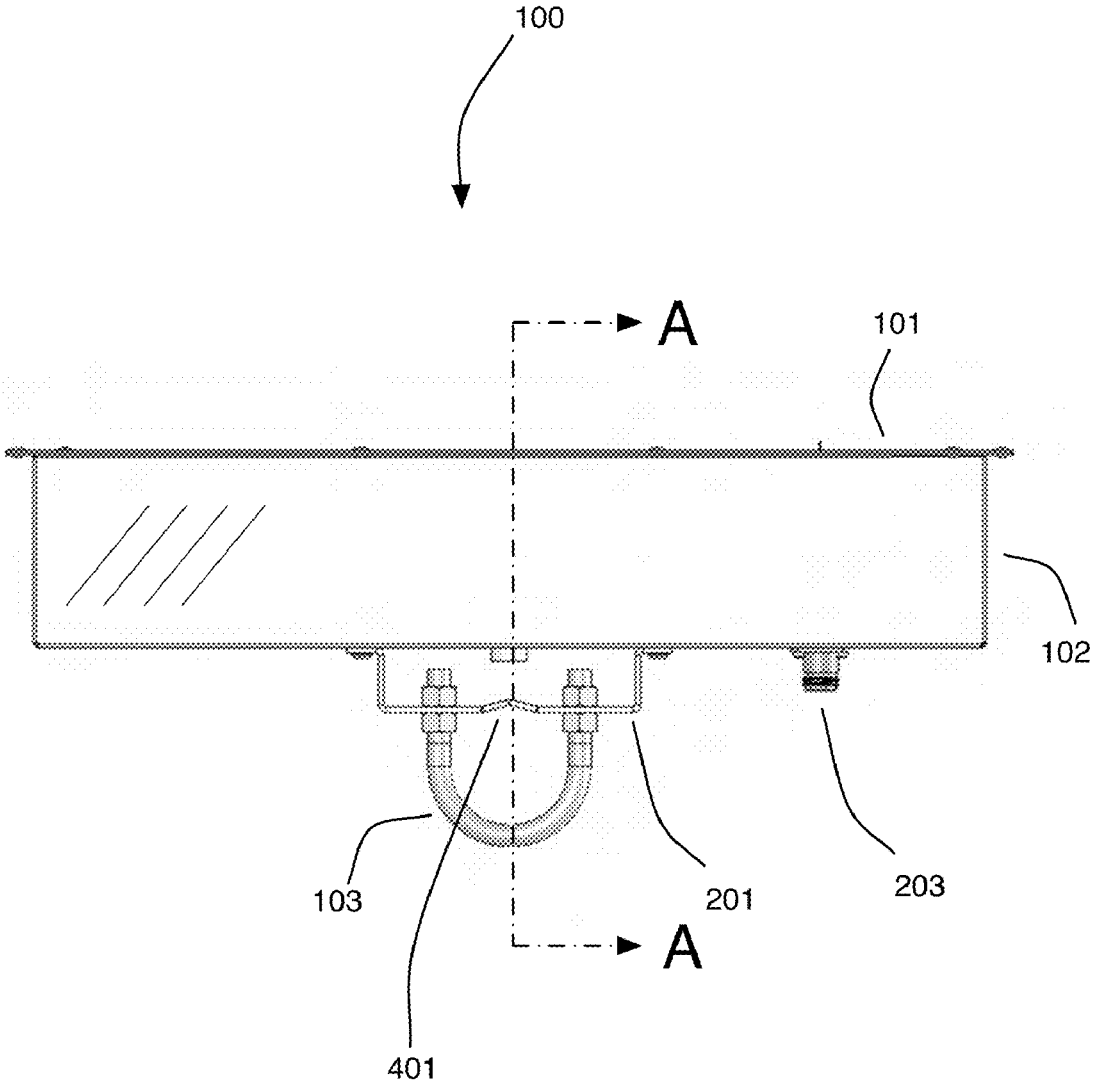
FIG. 4 shows a top view of an embodiment of the invention.
Figure 8:
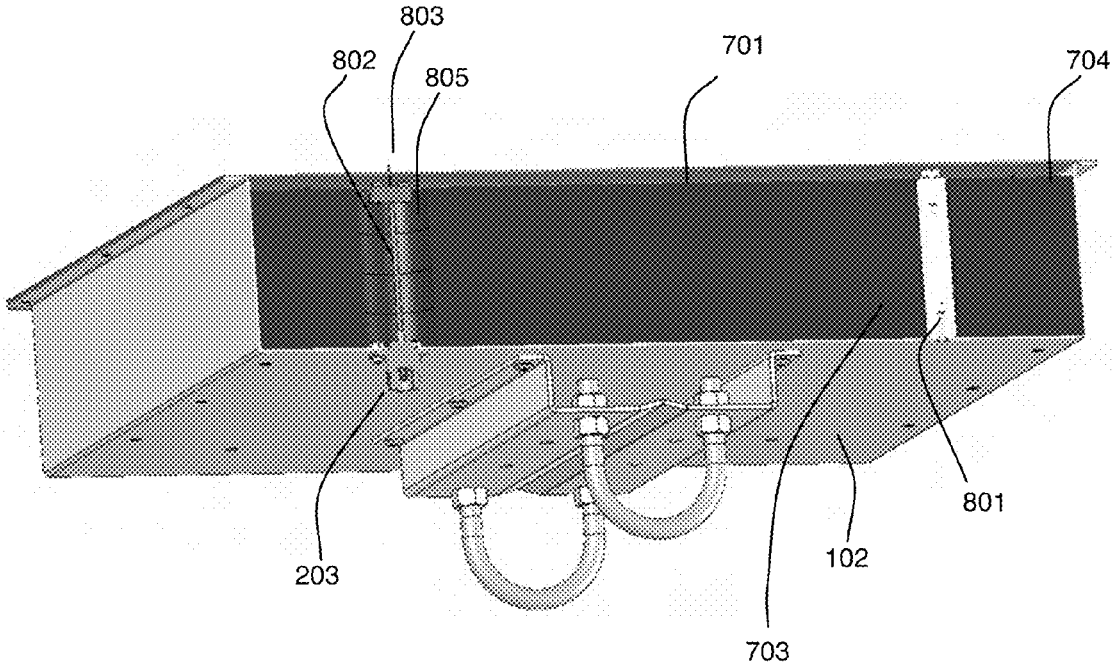
FIG. 8 shows a cross section of FIG. 5 at section B.

FIG. 4 shows a top view of an embodiment of the invention. Container 102 may be constructed from any conductive material durable enough for the intended installation location. One or more embodiments may be constructed from aluminum or any durable plastic having embedded conductive properties for example. Indentation 401 on mounting bracket 201 allows for a mounting pole for example to interface with mounting U bolts 103 and 104 and keep container 102 vertically oriented. Indentation 401 is optional and could be of any geometric shape that is able to interface with the desired mount. Cross section A looking into a cutaway of container 102 is shown in FIG. 8 below.

Figure 5:
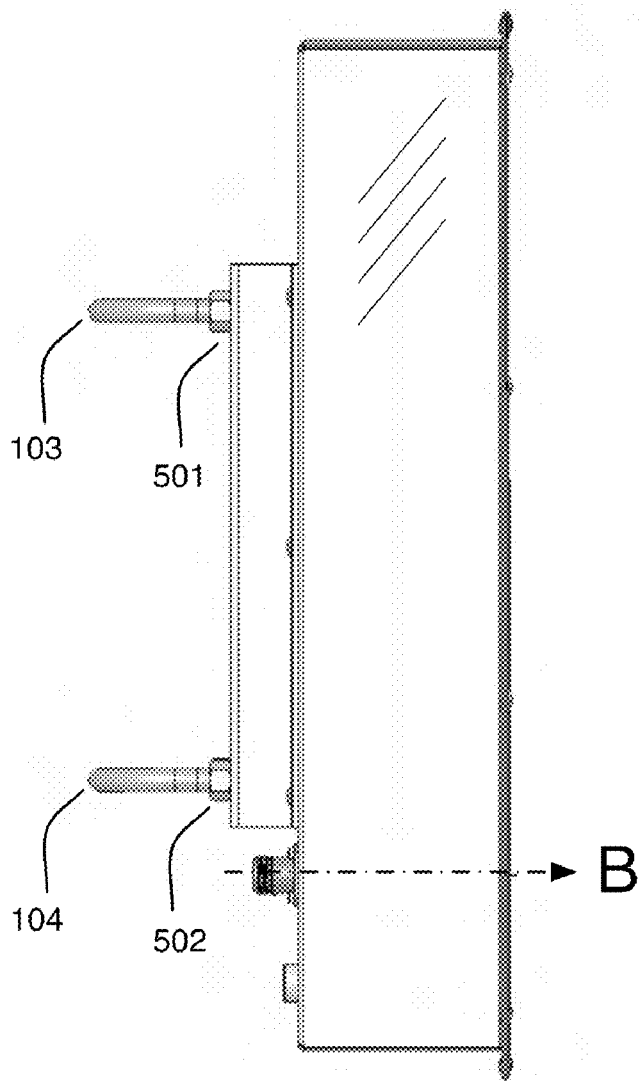
FIG. 5 shows a side view of an embodiment of the invention.

FIG. 5 shows a side view of an embodiment of the invention. Mounting nuts 501 and 502 are shown coupling mounting bracket 201 with mounting U bolts 103 and 104 respectively. By tightening mounting nuts, the U bolts are drawn closer to mounting bracket 201 and fix container 102 to any desired mount.

Figure 6:
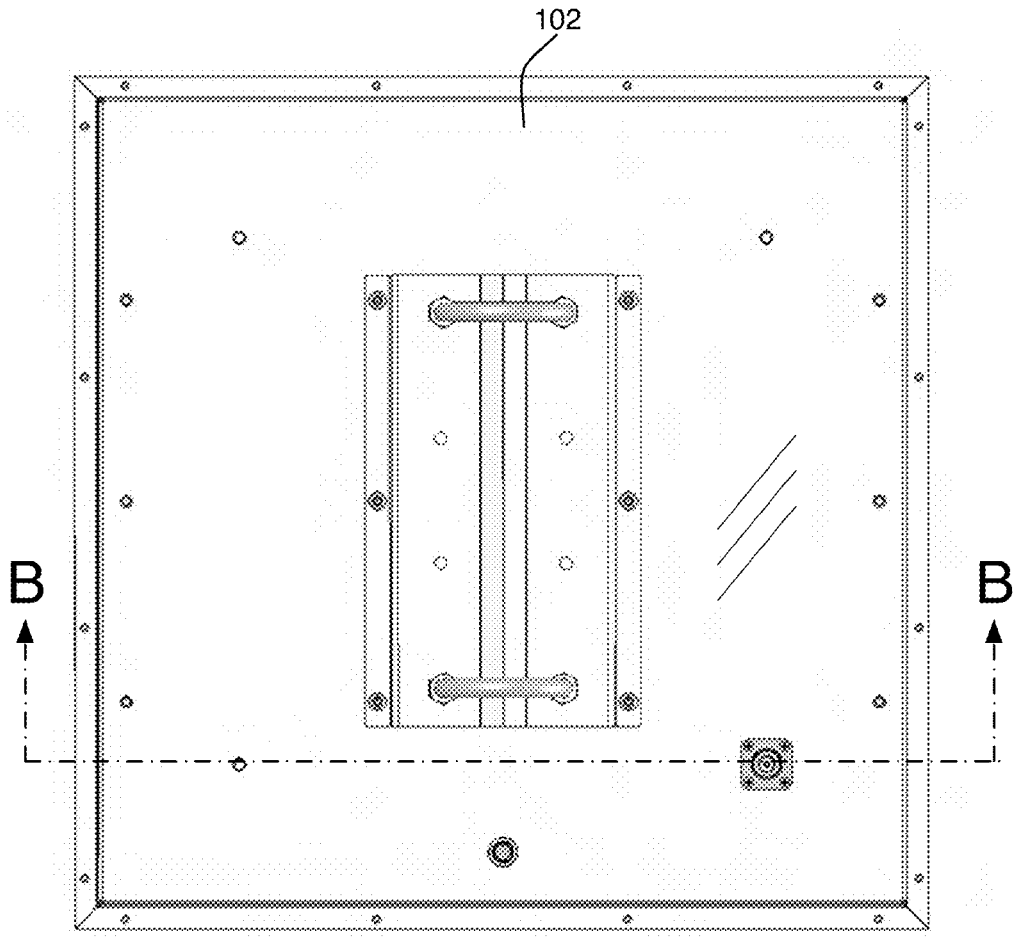
FIG. 6 shows a back view of an embodiment of the invention.

FIG. 6 shows a back view of an embodiment of the invention. Cross section B looking into a cutaway of container 102 is shown in FIG. 8 below.

Figure 7:
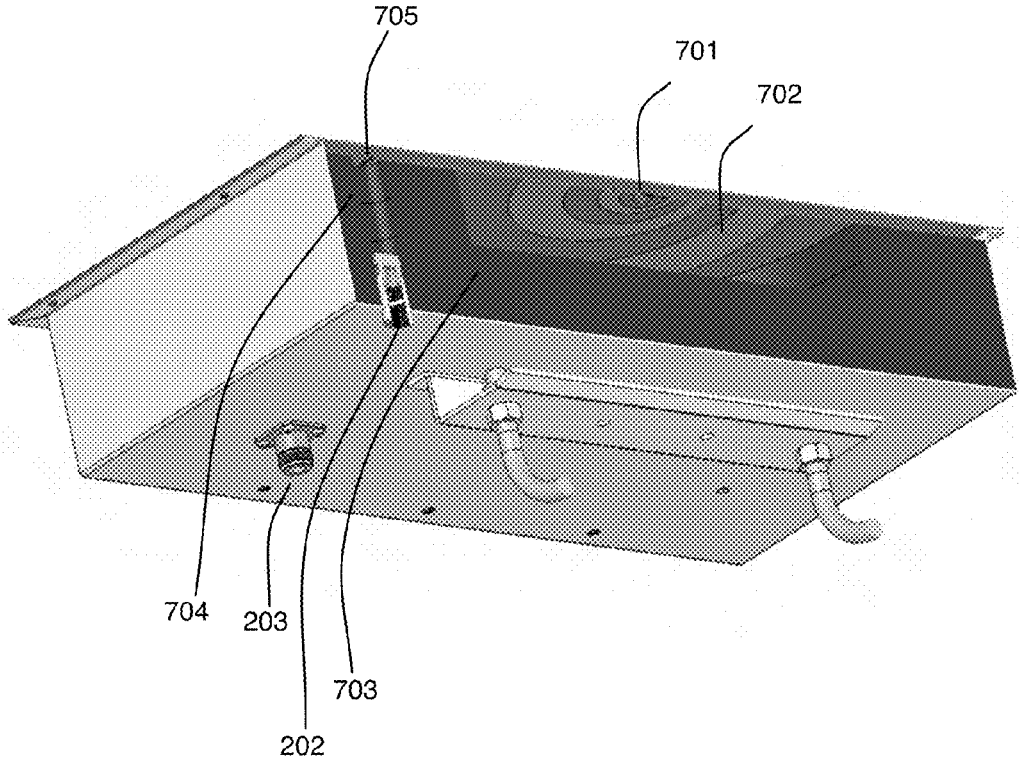
FIG. 7 shows a cross section of FIG. 4 at section A.

FIG. 7 shows a perspective view of cross section of FIG. 4 at section A. Antenna 701 is shown as mounted as part of a printed circuit board (PCB). Directly beneath antenna 701 is cavity 702 that is bounded on the sides by energy absorbent siding 704 and below by energy absorbent backing 703. Also shown is gas passage 605 that allows gas entering or exiting from gas vent 202 to enter cavity 702 and otherwise equalize pressure within the volume bounded by radome 101 and container 102. Gas vent 102 may be implemented in one or more embodiments with a sintered material for example with small pores that allows gas to transfer into and out of the device without allowing liquid to transfer.

FIG. 8 shows a cross section of FIG. 5 at section B. Support 801 couples antenna 701, for example as implemented on a PCB, to container 102 through energy absorbent siding 704. In addition, cable connector 203 mounts on container 102 and provides coaxial cable 802 to coaxial terminal 803 via coaxial cavity 805. Optionally, ferrite beads may be placed on coaxial cable 802 to prevent RF signals from traveling down the coaxial cable.

Figure 9:
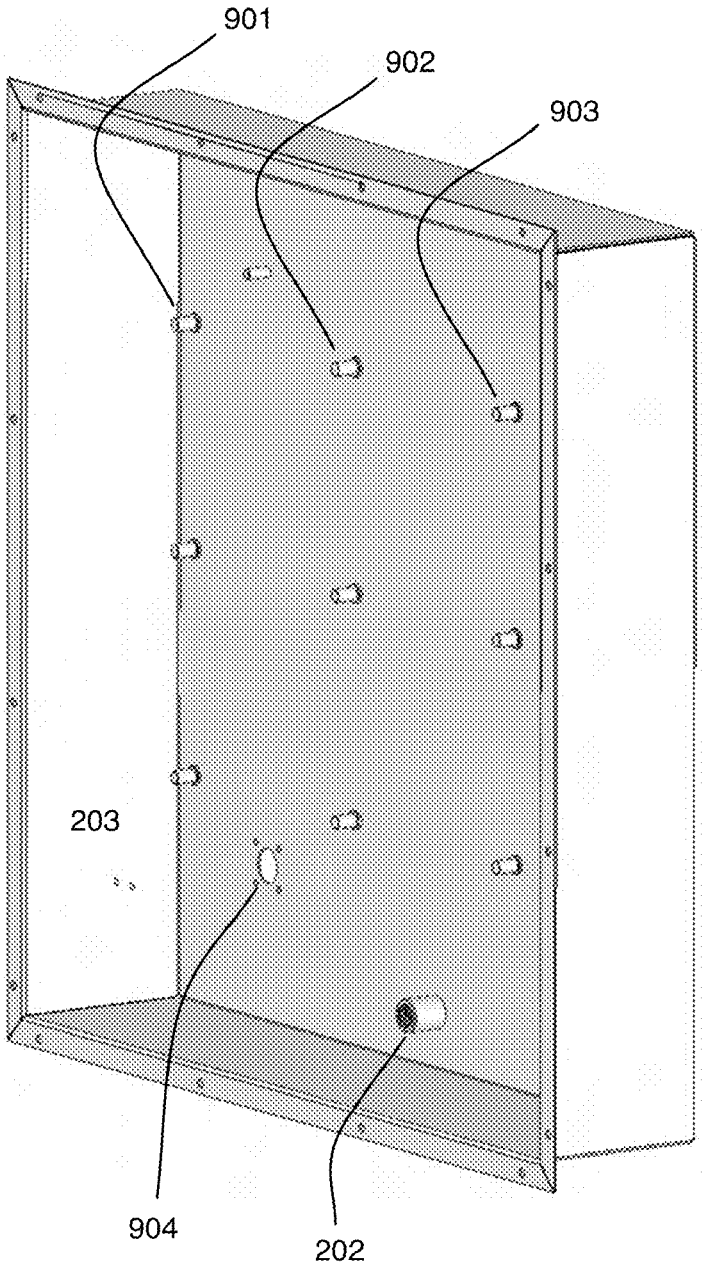
FIG. 9 shows a side perspective view of an embodiment of the container.

FIG. 9 shows a side perspective view of an embodiment of the container. Shown are cable connector hole 904 for mounting cable connector 203, and mount points 901, 902 and 903 (and vertically offset mount points not numbered for brevity) that allow mounting bracket 201 to be mounted at a translated offset to container 102.

Figure 10:
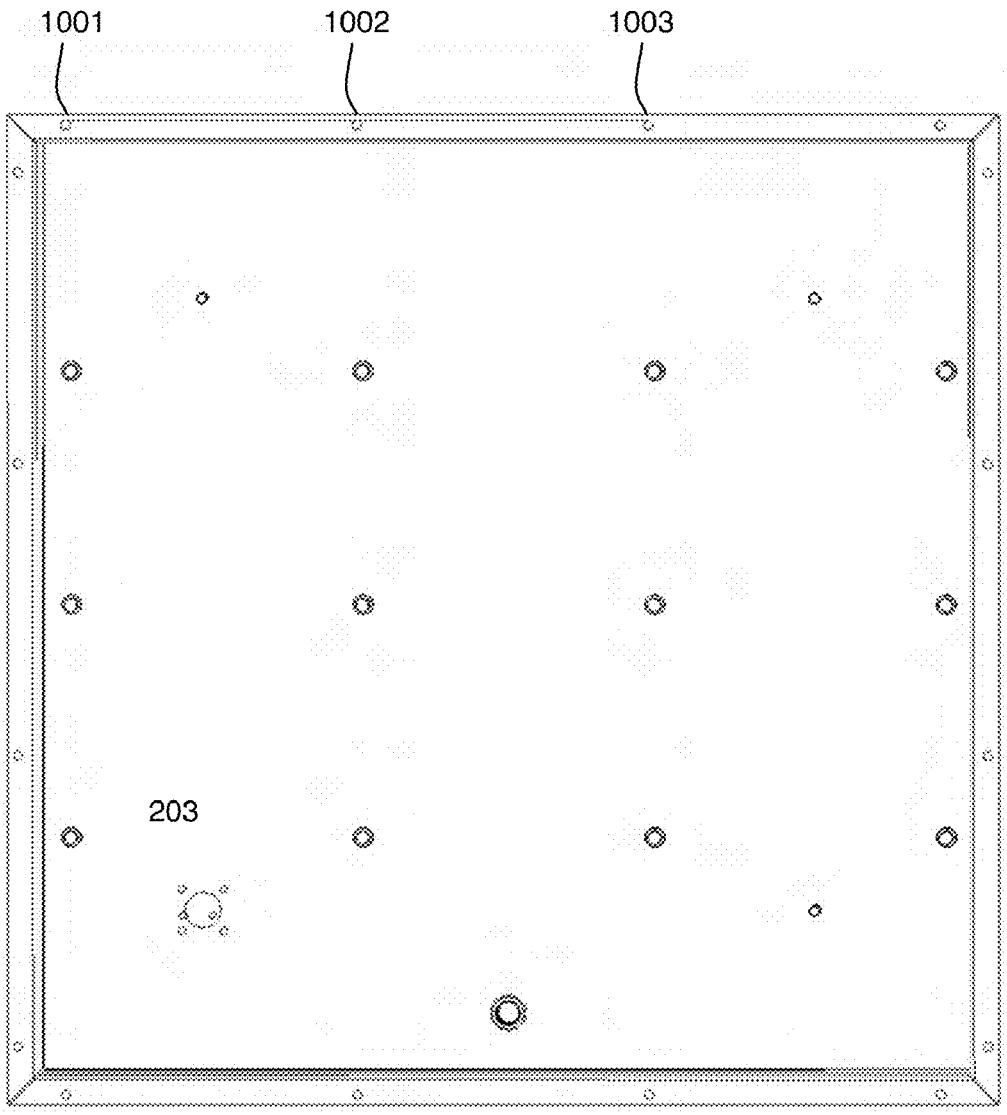
FIG. 10 shows a front view of an embodiment of the container.

FIG. 10 shows a front view of an embodiment of the container. Connection holes 1001, 1002 and 1003 are shown, for example to couple radome 101 to container 102. Rivets for example may be utilized in one or more embodiments although bolts, or any other connection apparatus may also be utilized in keeping with the spirit of the invention.

Figure 11:
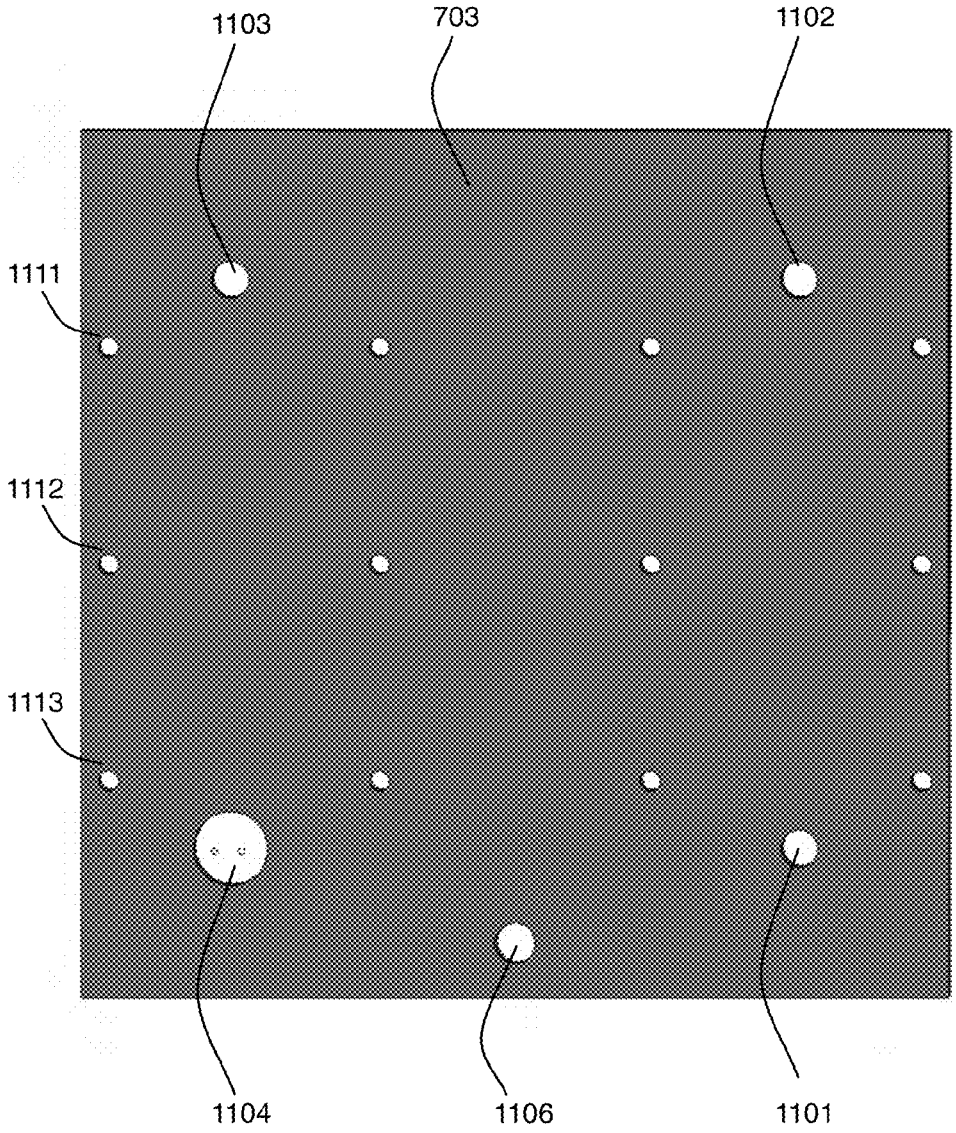
FIG. 11 shows a front view of an embodiment of the energy absorbent material.

FIG. 11 shows a front view of an embodiment of the energy absorbent material. Energy absorbent backing 703 is shown with holes configured to accommodate mount points, supports and coaxial connector. For example, holes 1101, 1102 and 1103 allow for supports (such as support 801) to traverse through energy absorbent backing 703. Holes 1111, 1112 and 1113 allow corresponding mount points 901, 902 and 903 for example to intrude into container 102. Hole 1104 creates coaxial cavity 805 and allows for coaxial cable 802 to traverse from coaxial connector 203 to coaxial terminal 803.

Figure 12:
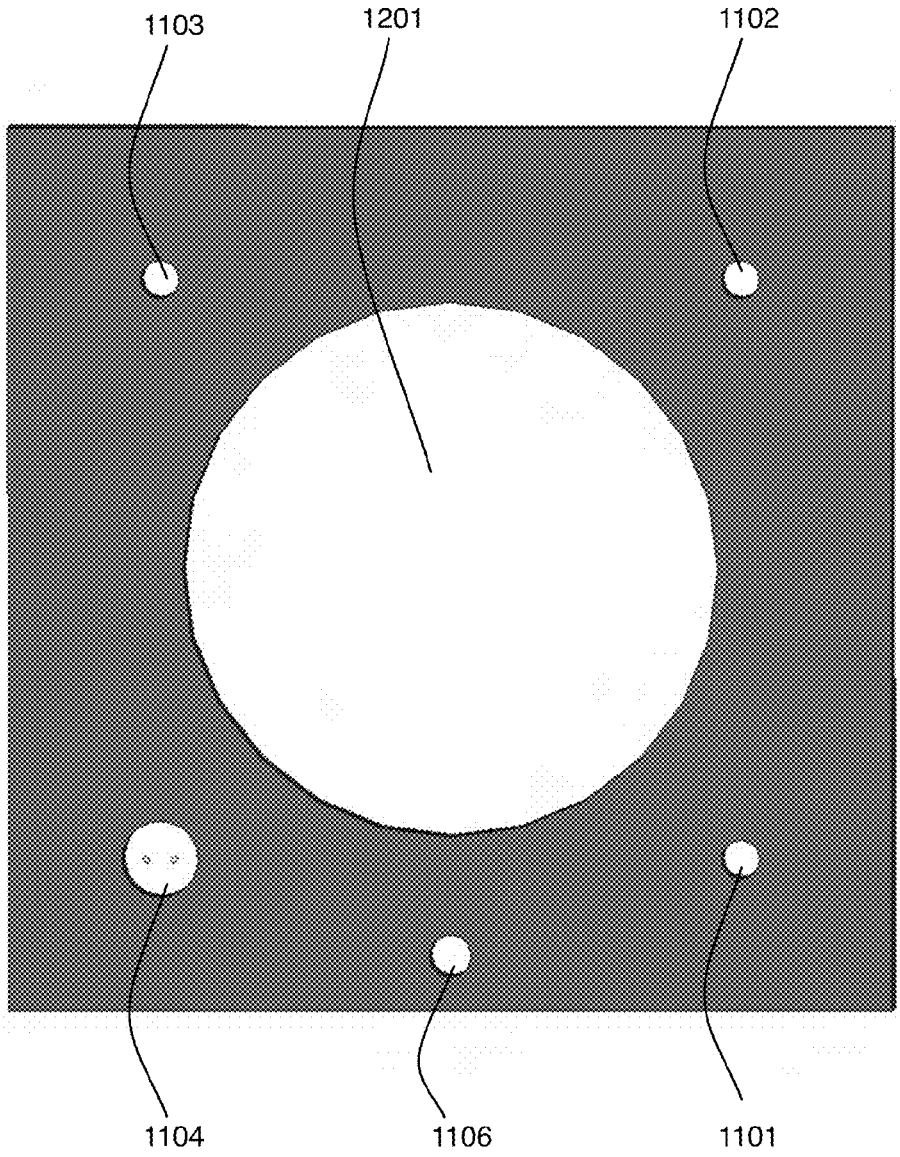
FIG. 12 shows a front view of an embodiment of the energy absorbent material having a cavity.

FIG. 12 shows a front view of an embodiment of the energy absorbent material having cavity 1201 that is situated directly behind antenna 701. In one or more embodiments of the invention, the diameter of cavity 1201 is 9.69" and the depth is 1.5", while the absorbent siding is 1.2" thick between the container and the PCB board, while the log-spiral slots overlap by 0.3".

Figure 13:
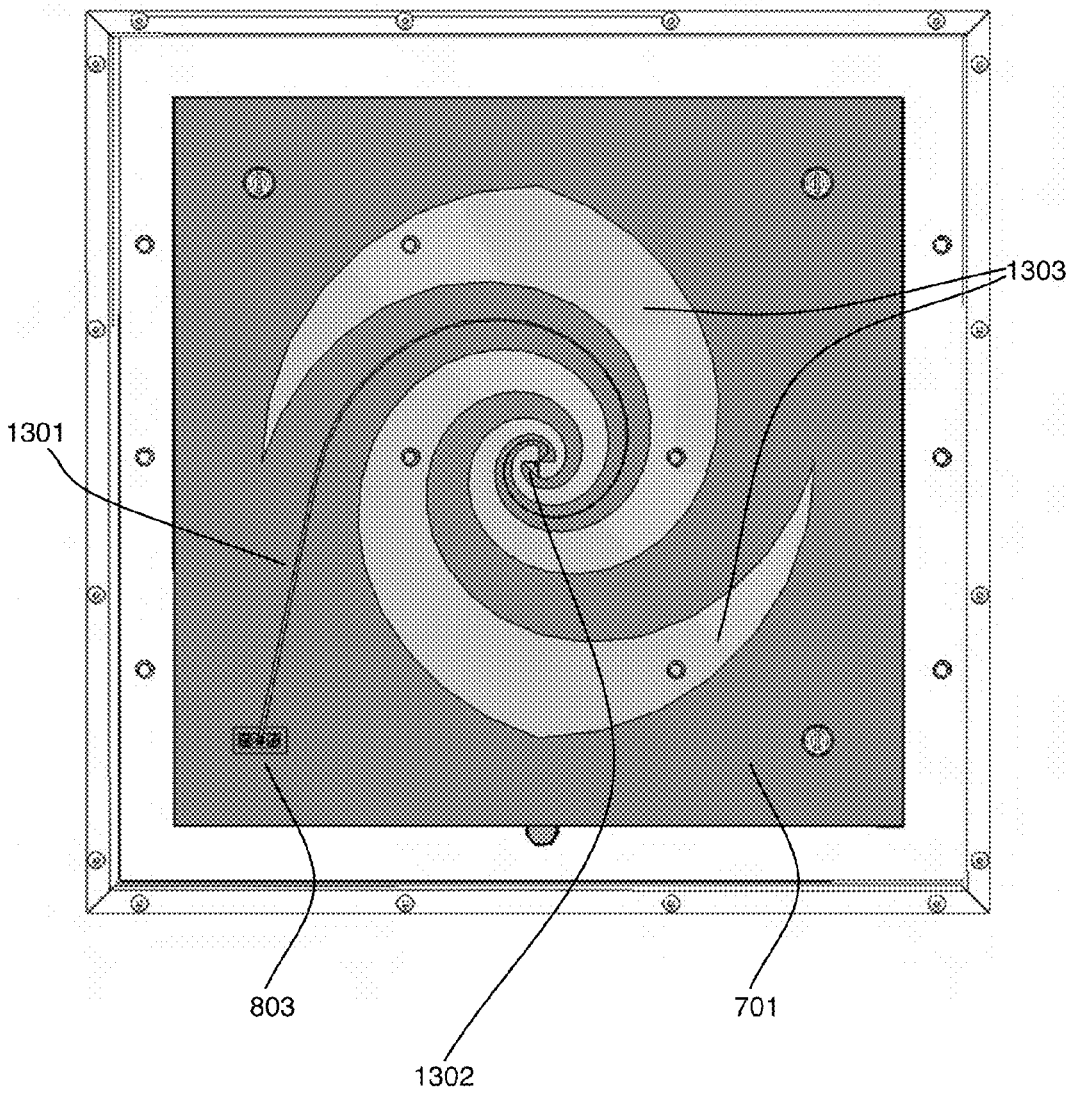
FIG. 13 shows a front view of an embodiment of a PCB implementation wherein the PCB is transparent to allow viewing of the slots.

FIG. 13 shows a front view of an embodiment of a PCB implementation wherein the PCB is transparent to allow viewing of the slots in antenna 701. As shown, coaxial terminal 803 couples with tapered microstrip line 1301 that couples to feed-point 1302 at the center of antenna 701. In one or more embodiments tapered microstrip line 1301 acts as a wideband impedance transformer that transforms for example, a 50 Ohm input impedance to a 150 Ohm antenna impedance over a wide range of frequencies. Slots 1303 in antenna 701 are of the log-spiral shape, and allow for a wideband radiation pattern as will be shown in later figures. One embodiment of the invention may be implemented with a 0.05" gap at the feed-point, wherein the shield of the tapered microstrip line 1301 connects to the conductor on one side of the gap and wherein the main conductor of the tapered microstrip line 1302 connects to the conductor portion across the gap, therein creating a balanced line. The tapered microstrip line 1301 can be formed into the PCB in one or more embodiments of the invention. In one or more embodiments of the invention, tapered microstrip line 1301 tapers down to 0.004" at the feed-point from 0.054" at coaxial terminal 803. In one or more embodiments, the PCB material may be implemented with Rogers 4003C, having a dieletric thickness of 0.032 inches and clad on both sides with copper approximately 0.0015 inches thick. Any other type of PCB material may be utilized in keeping with the spirit of the invention.

Specifically, the shape of embodiments of the log-spiral antenna enabled herein are based on the logarithmic spiral curve defined by:

$$Q=k*\exp(b\phi)$$

where Q is the radial distance in inches from the origin in the direction given by the angle $\phi$, b=0.3 and k=0.2867 for an embodiment of the invention as shown in at least FIG. 13 for example. As one skilled in the art will recognize, these parameters may be adjusted in keeping with the spirit of the invention to modify the performance of the antenna as desired, and thus is not meant to be a limiting exact range for all embodiments.

By utilizing another log-spiral with a second angle that differs from $\phi$, a log-spiral arm or slot may be defined that is cut from a metal sheet for example. Terminating the spirals with a circular arc is typically performed. In this embodiment as shown in at least FIG. 13, the radius of the terminating circular arc is 4.845 inches, which again, may be adjusted to adjust the performance of the antenna as desired as one skilled in the art will appreciate, and thus is not meant to be a limiting exact range for all embodiments. Rotating the curves by 180 degrees and cutting a second slot results in a balanced log-spiral slot antenna as utilized in one or more of the embodiments enabled herein.

Figure 14:
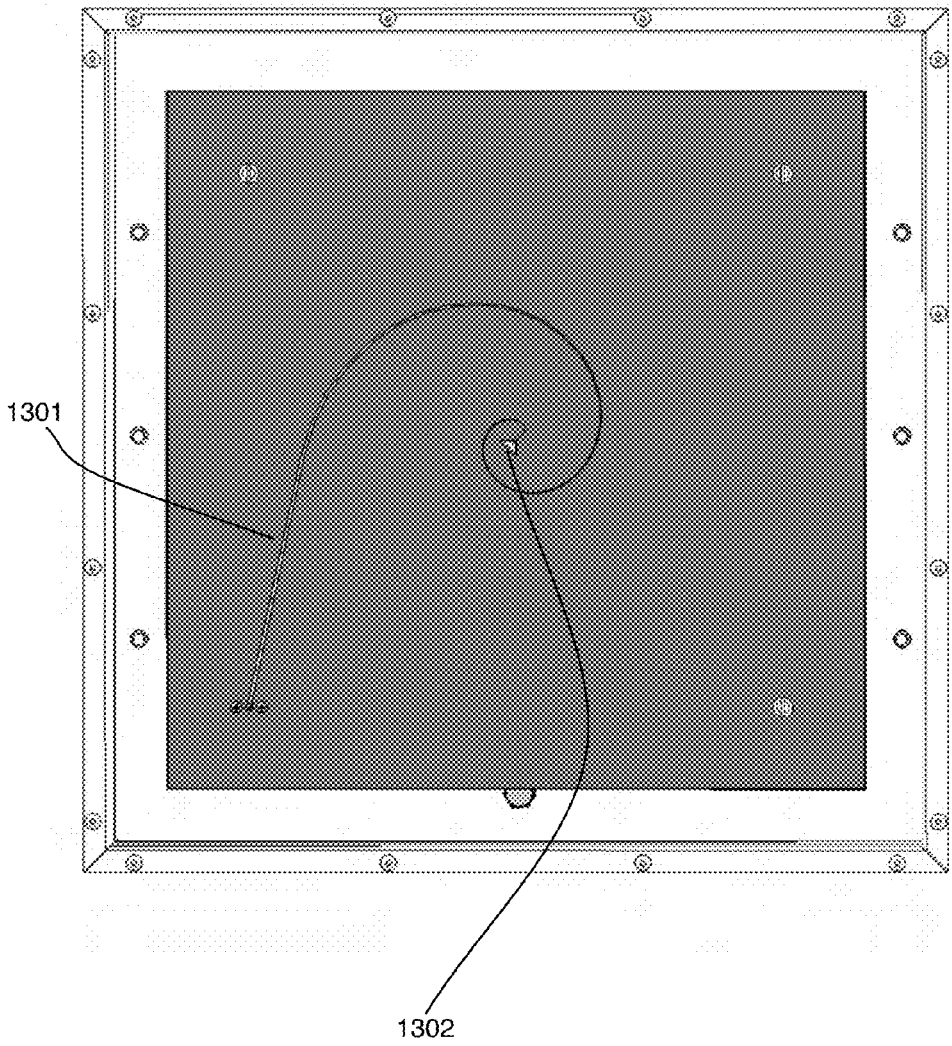
FIG. 14 shows a front view of an embodiment of a PCB implementation wherein the PCB is opaque and wherein the slots are shown as lines that represent the slots underneath the top layer of the PCB.

FIG. 14 shows a front view of an embodiment of a PCB implementation wherein the PCB is opaque, thus showing only tapered microstrip line 1301 and feed-point 1302, while hiding the slots in antenna 701 for example.

Figure 15:
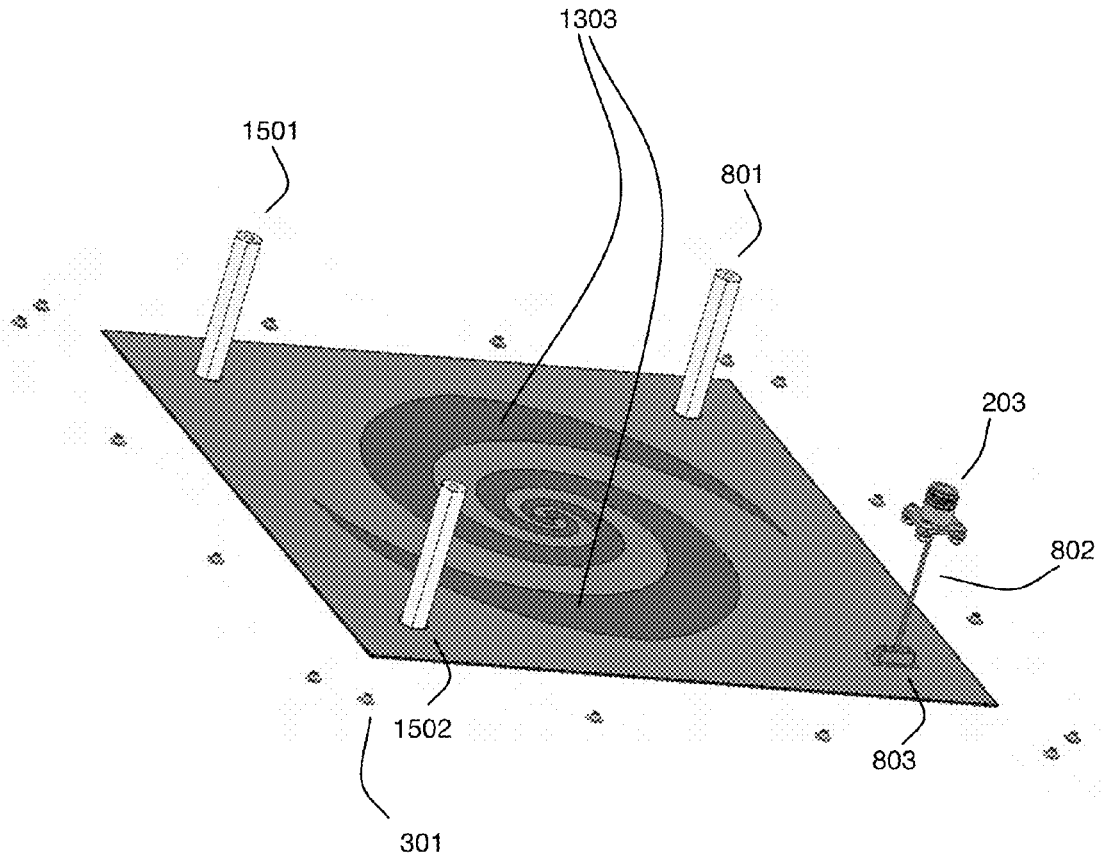
FIG. 15 shows a perspective view of the underside of the PCB board of FIG. 10.

FIG. 15 shows a perspective view of the underside of the PCB board of FIG. 10. Rivets 301, slot 1303, coaxial terminal 803, coaxial cable 802 and cable connector 203 along with supports 801, 1501 and 1502 from the underside in their final configuration positions. The copper ground plane from which slots 1303 are cut, also has the copper removed where supports 801, 1501 and 1502 couple to the PCB so that the copper ground plane is not electrically coupled to supports 801, 1501 and 1502.

Figure 16:
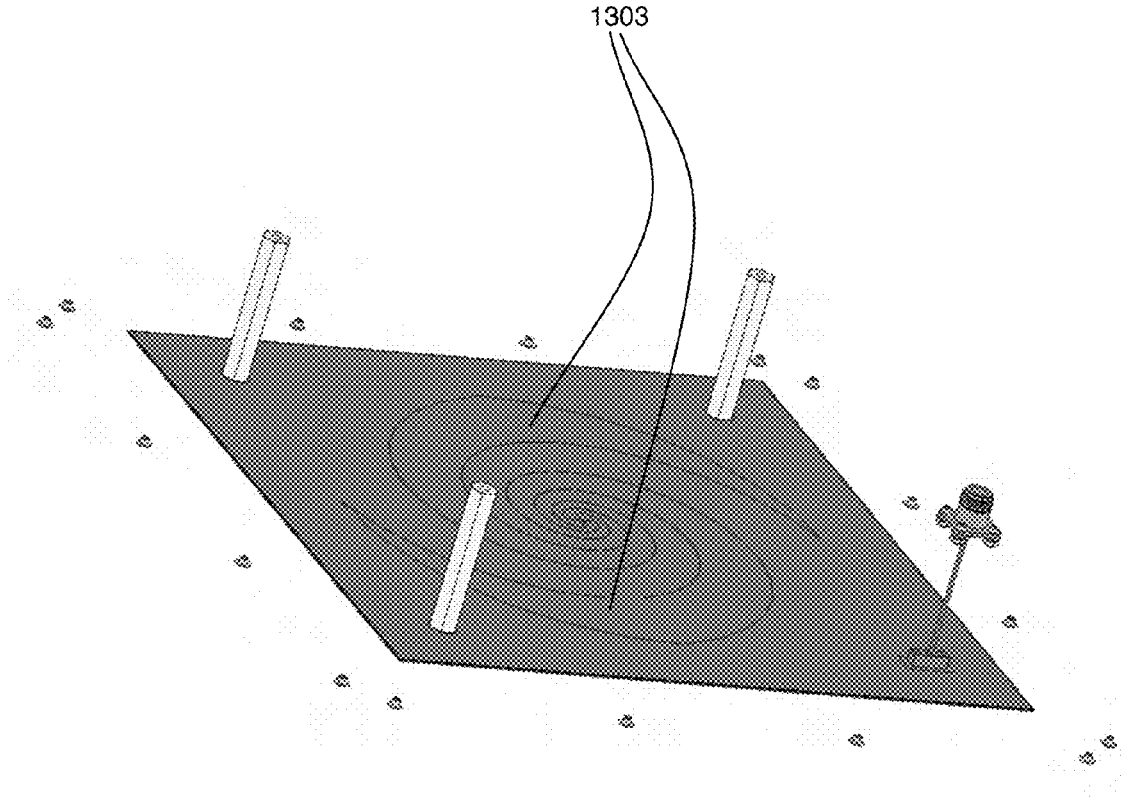
FIG. 16 shows a perspective view of the underside of the PCB board of FIG. 11.

FIG. 16 shows a perspective view of the underside of the PCB board of FIG. 11 wherein the PCB is translucent and allows slots 1303 to be visible as outlines.

Figure 17:
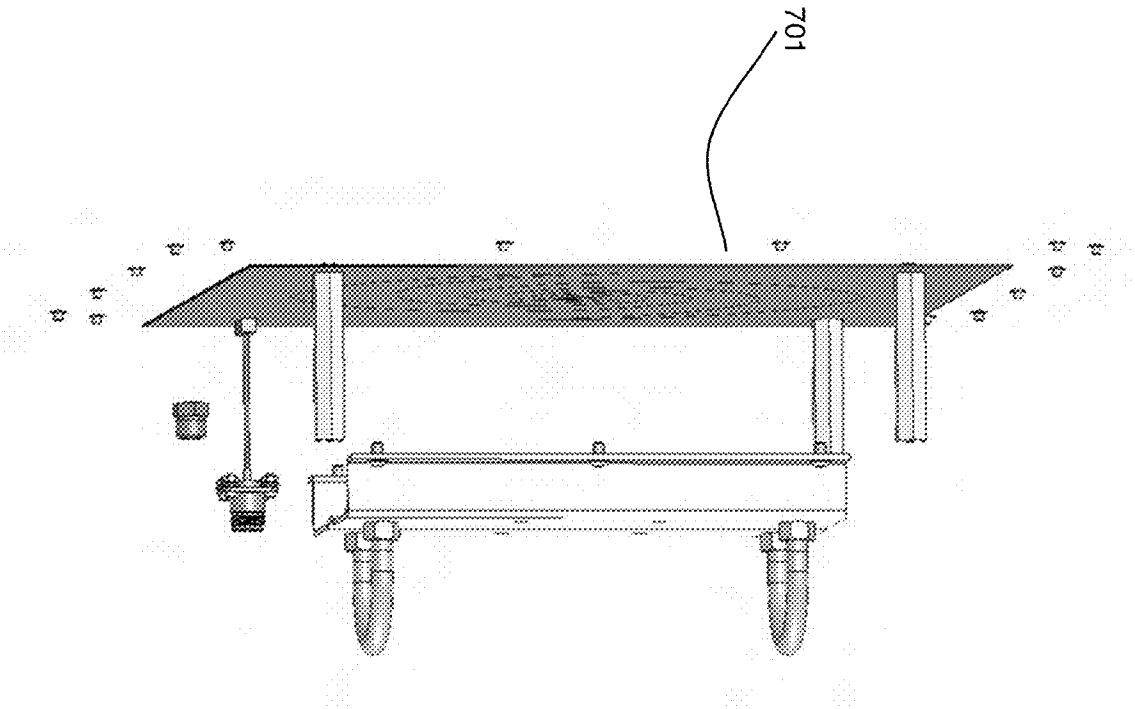
FIG. 17 shows a side view of the PCB board, mounting legs, mounting bracket, coaxial connector and gas vent.

FIG. 17 shows a side view of the PCB board, mounting legs, mounting bracket, coaxial connector and gas vent without container 102.

Figure 18:
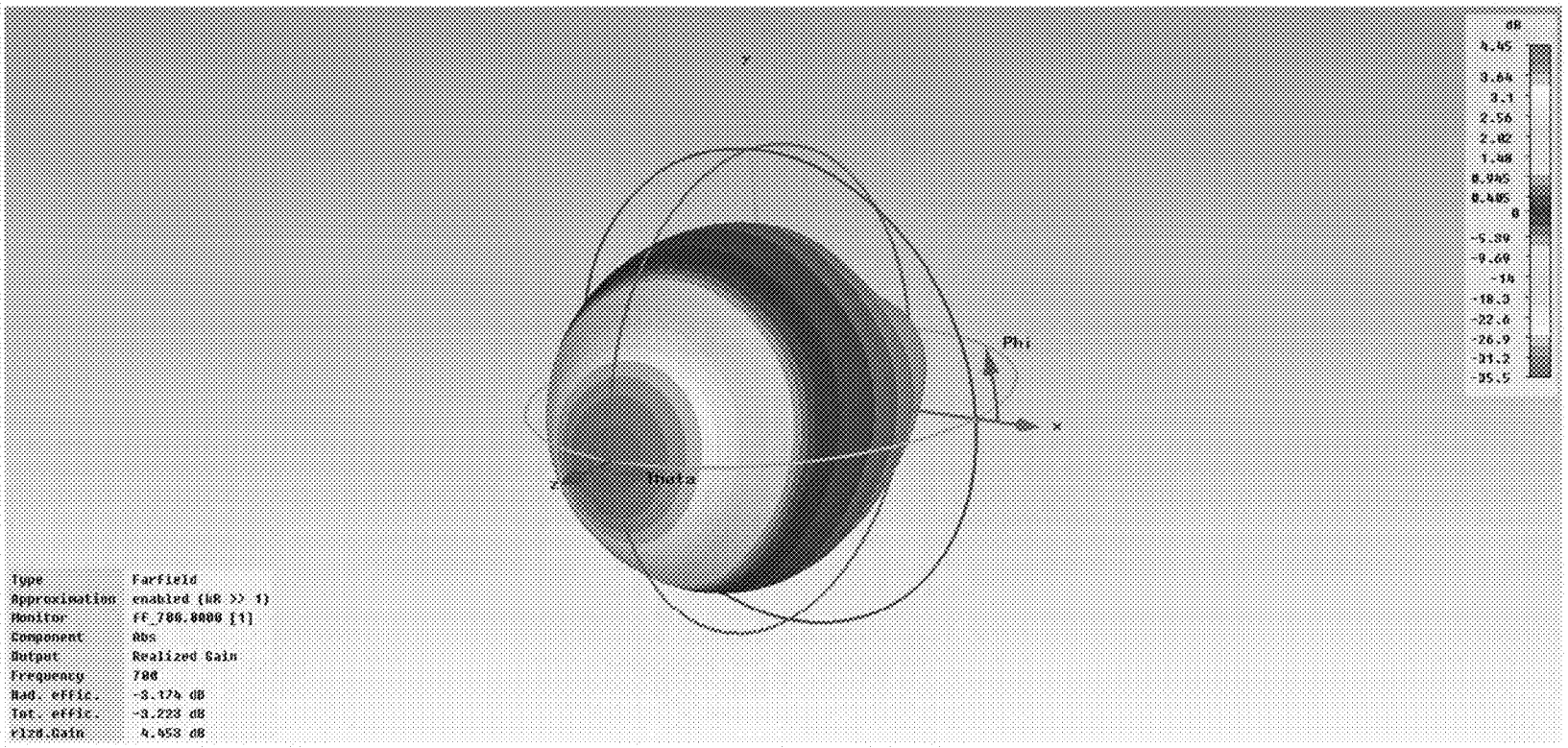
FIG. 18 shows a three-dimensional radiation pattern for the forward pointing direction for an embodiment of the invention at 700 MHz.

FIG. 18 shows a three-dimensional radiation pattern for the forward pointing direction for an embodiment of the invention at 700 MHz.

Figure 19:
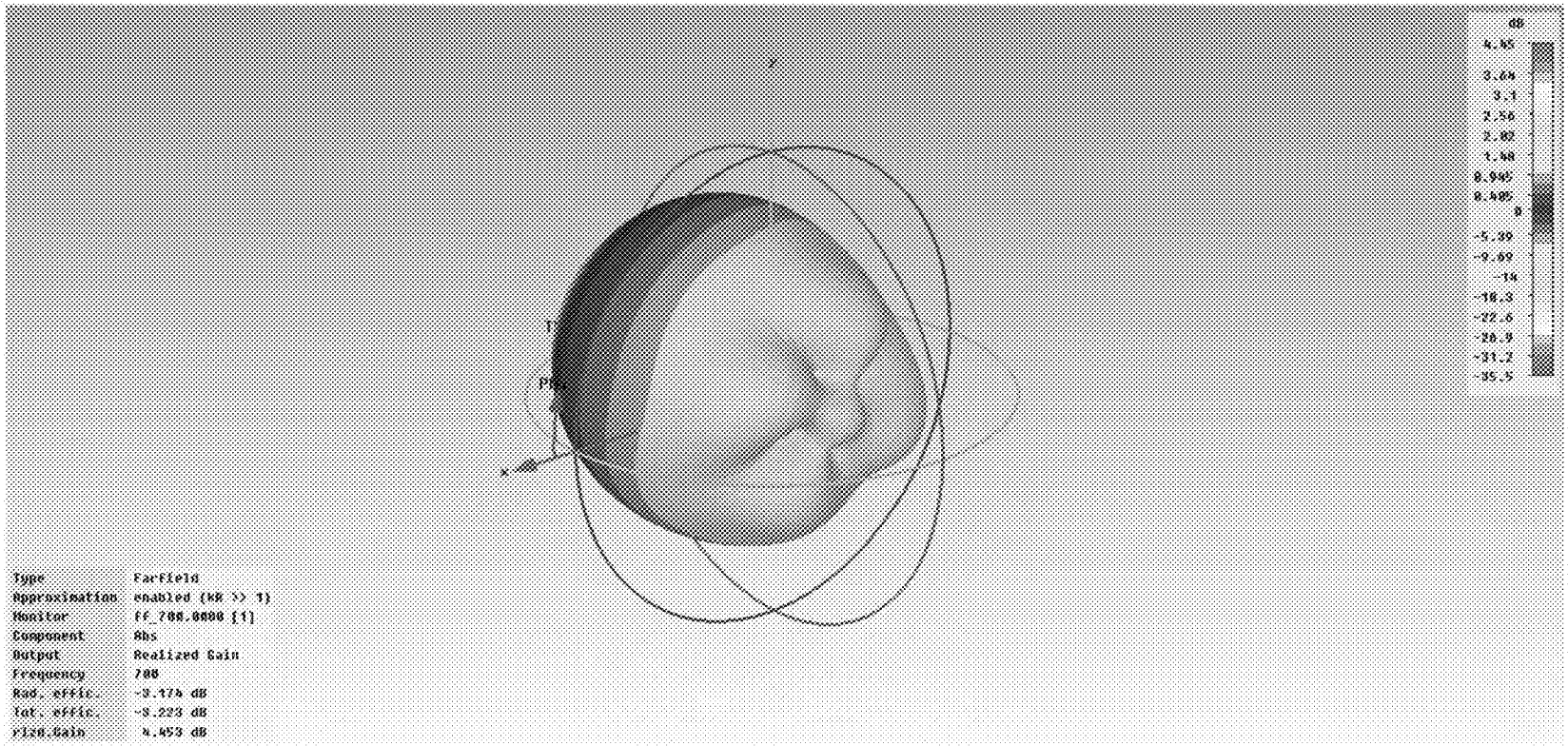
FIG. 19 shows a three-dimensional radiation pattern for the rearward pointing direction for an embodiment of the invention at 700 MHz.

FIG. 19 shows a three-dimensional radiation pattern for the rearward pointing direction for an embodiment of the invention at 700 MHz.

Figure 20:
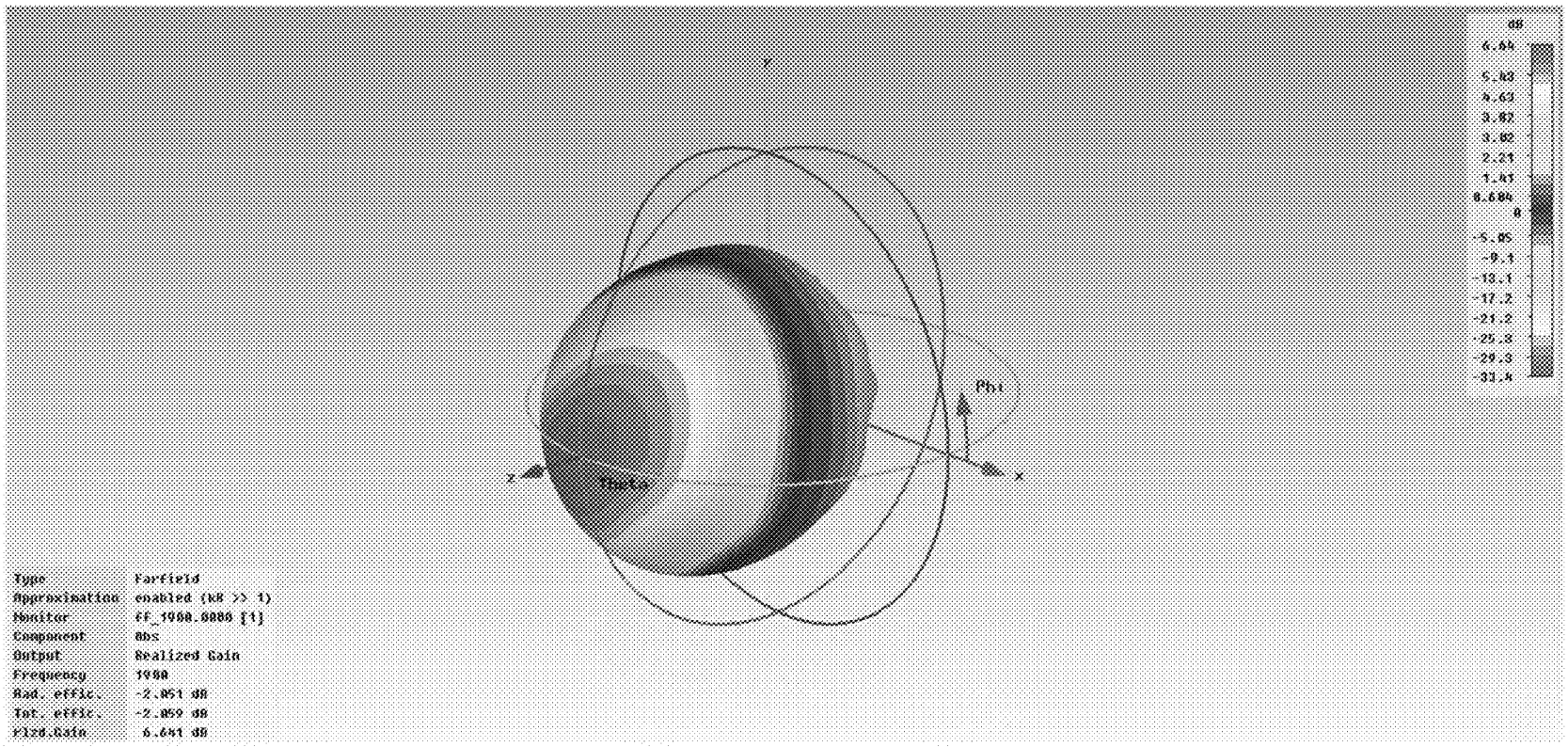
FIG. 20 shows a three-dimensional radiation pattern for the forward pointing direction for an embodiment of the invention at 1900 MHz.

FIG. 20 shows a three-dimensional radiation pattern for the forward pointing direction for an embodiment of the invention at 1900 MHz.

Figure 21:
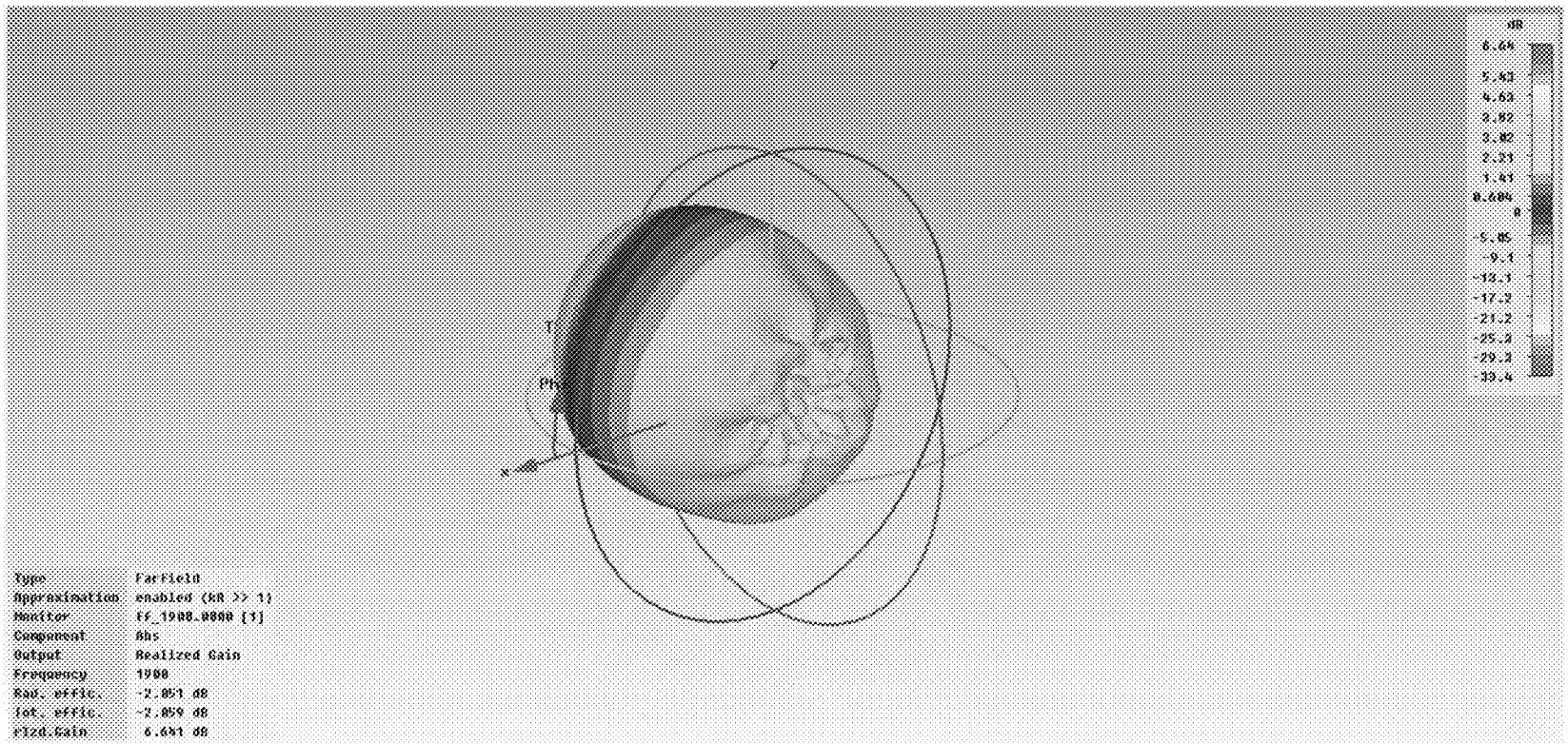
FIG. 21 shows a three-dimensional radiation pattern for the rearward pointing direction for an embodiment of the invention at 1900 MHz.

FIG. 21 shows a three-dimensional radiation pattern for the rearward pointing direction for an embodiment of the invention at 1900 MHz.

Figure 22:
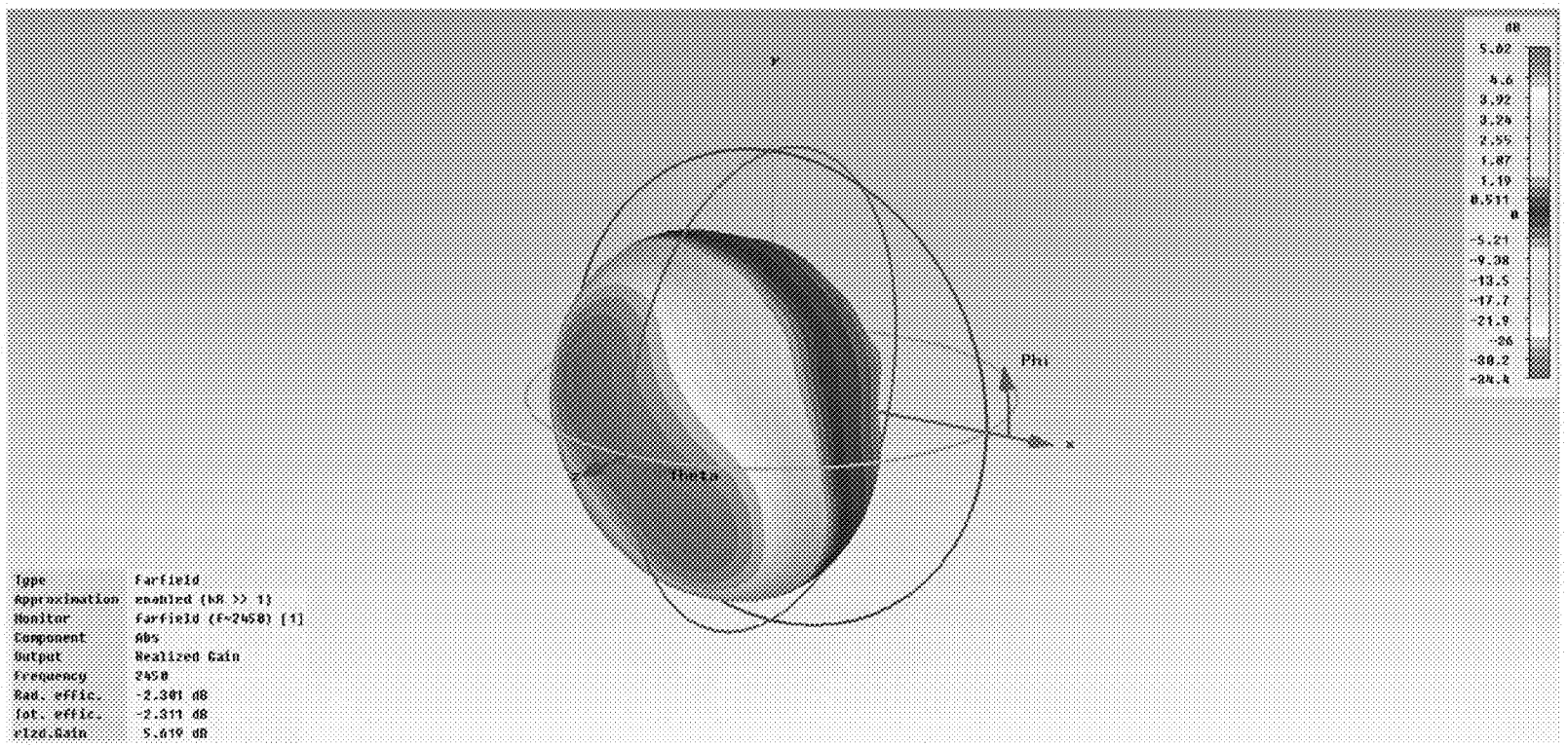
FIG. 22 shows a three-dimensional radiation pattern for the forward pointing direction for an embodiment of the invention at 2450 MHz.

FIG. 22 shows a three-dimensional radiation pattern for the forward pointing direction for an embodiment of the invention at 2450 MHz.

Figure 23:
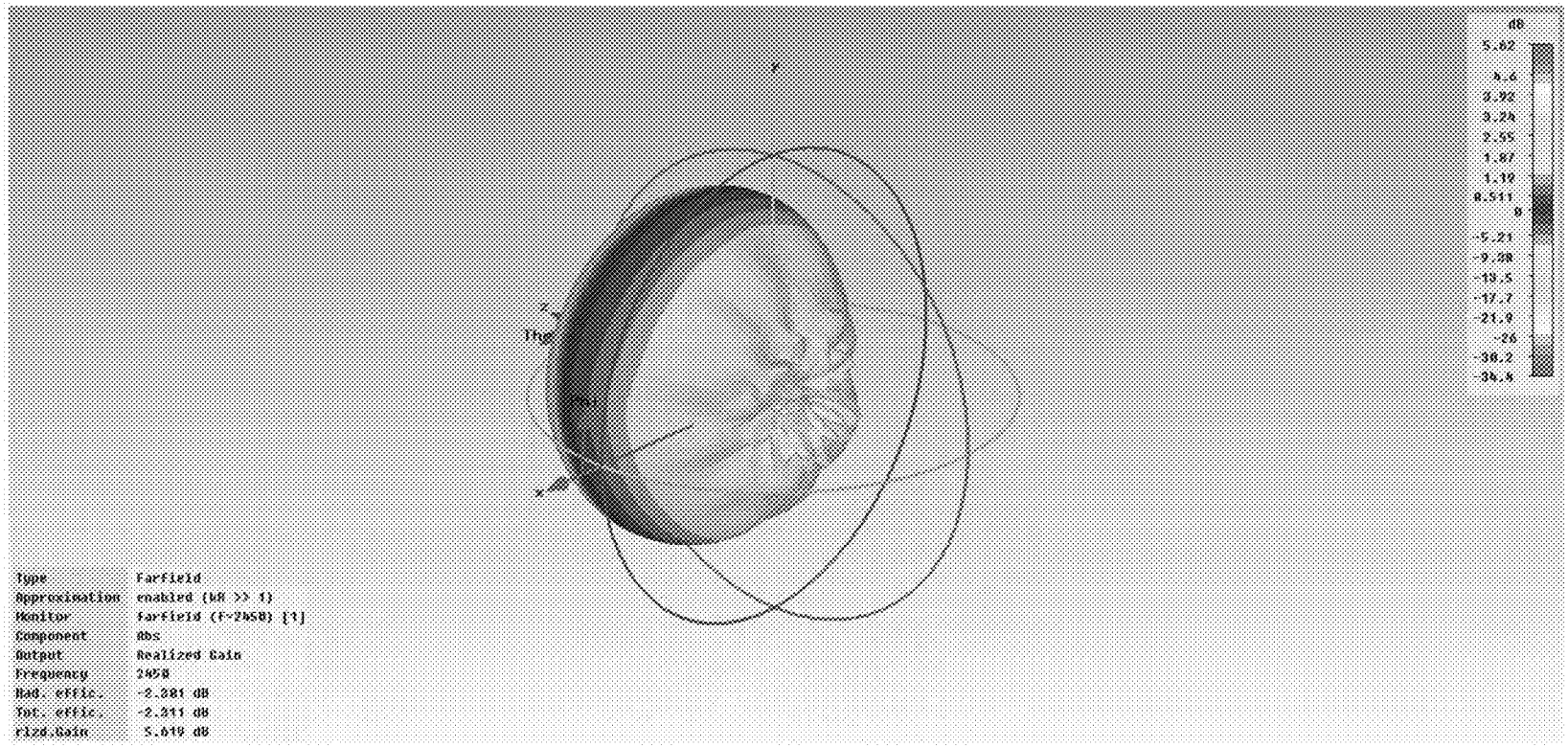
FIG. 23 shows a three-dimensional radiation pattern for the rearward pointing direction for an embodiment of the invention at 2450 MHz.

FIG. 23 shows a three-dimensional radiation pattern for the rearward pointing direction for an embodiment of the invention at 2450 MHz.

Figure 24:
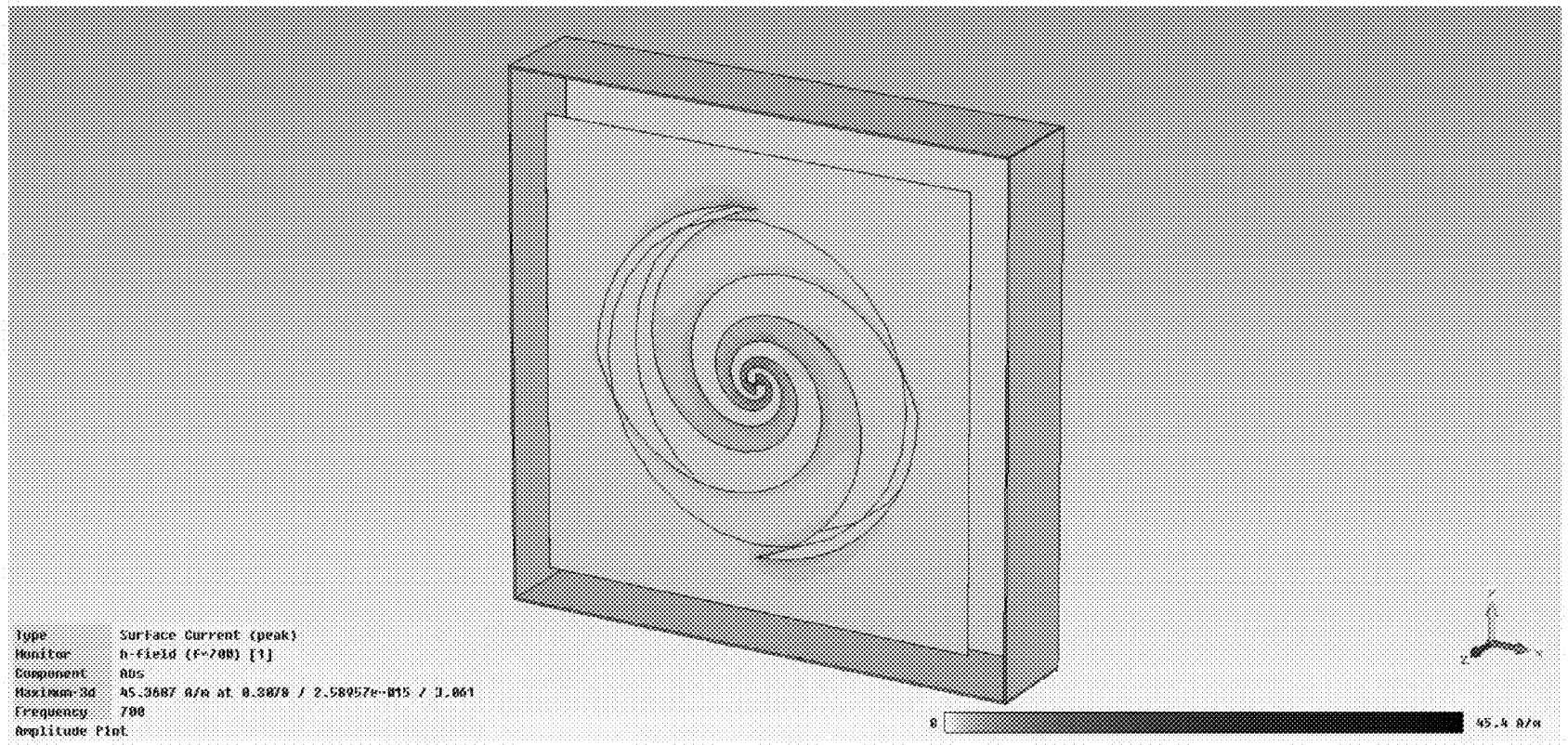
FIG. 24 shows a surface current plot for an embodiment of the invention at 700 MHz with for example the energy absorbent backing overlapping the outer portion of the slot, which greatly attenuates the reflected energy, for example at low frequencies.

FIG. 24 shows a surface current plot for an embodiment of the invention at 700 MHz with for example the energy absorbent siding overlapping the outer portion of the slot, which greatly attenuates the reflected energy, for example at low frequencies.

Figure 25:
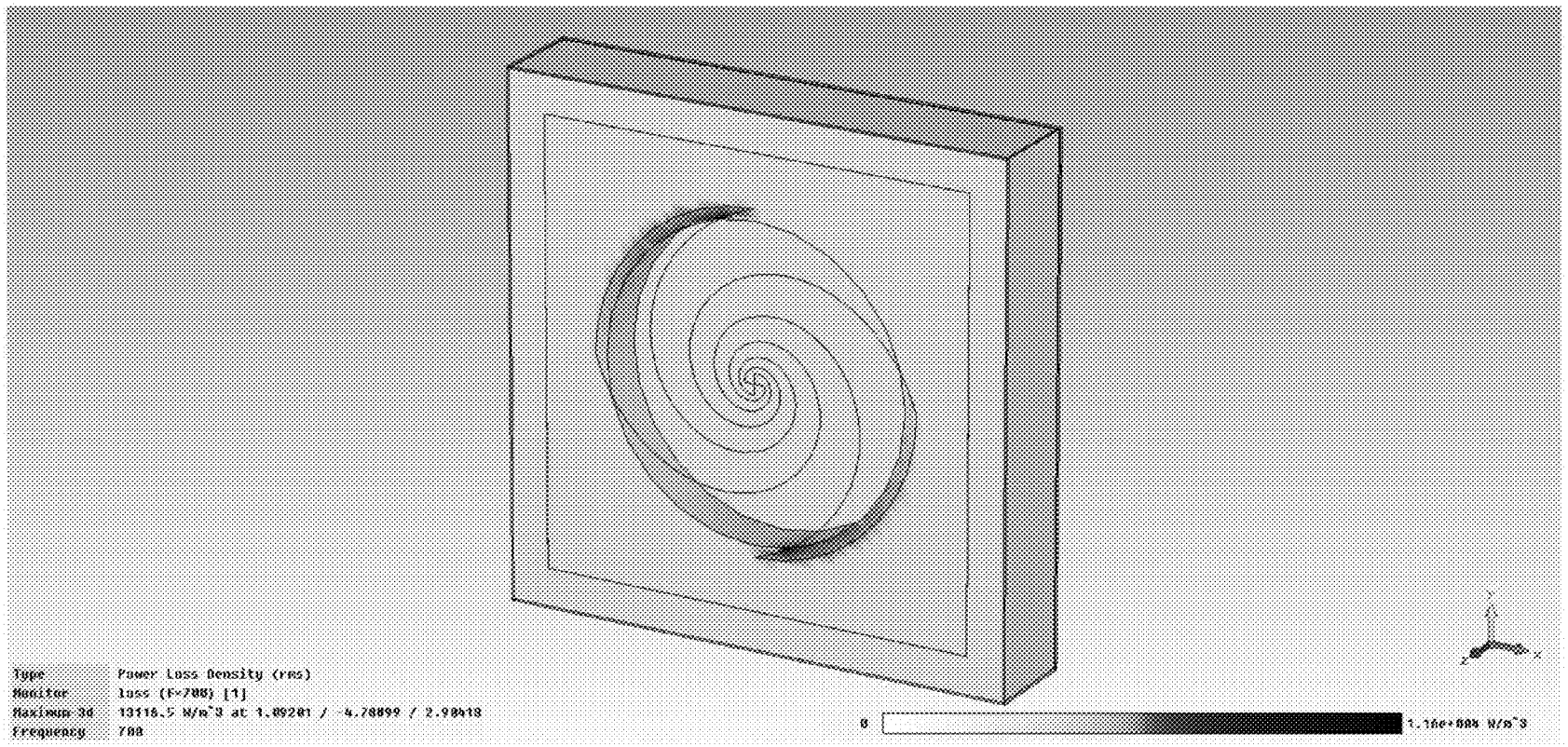
FIG. 25 shows a power loss density plot for an embodiment of the invention at 700 MHz.

FIG. 25 shows a power loss density plot for an embodiment of the invention at 700 MHz. The energy absorbed at the end of the slots shows that the overlap of the absorbent backing acts as an impedance matching component which absorbs energy which is not radiated between the feed-point of the antenna and the end of the slot, as can be seen in the chart in FIG. 40. This allows for excellent impedance matching, and stated another way, minimizes the reflected energy back from the end of the slots at above 700 MHz. See also the description of FIG. 35.

Figure 26:
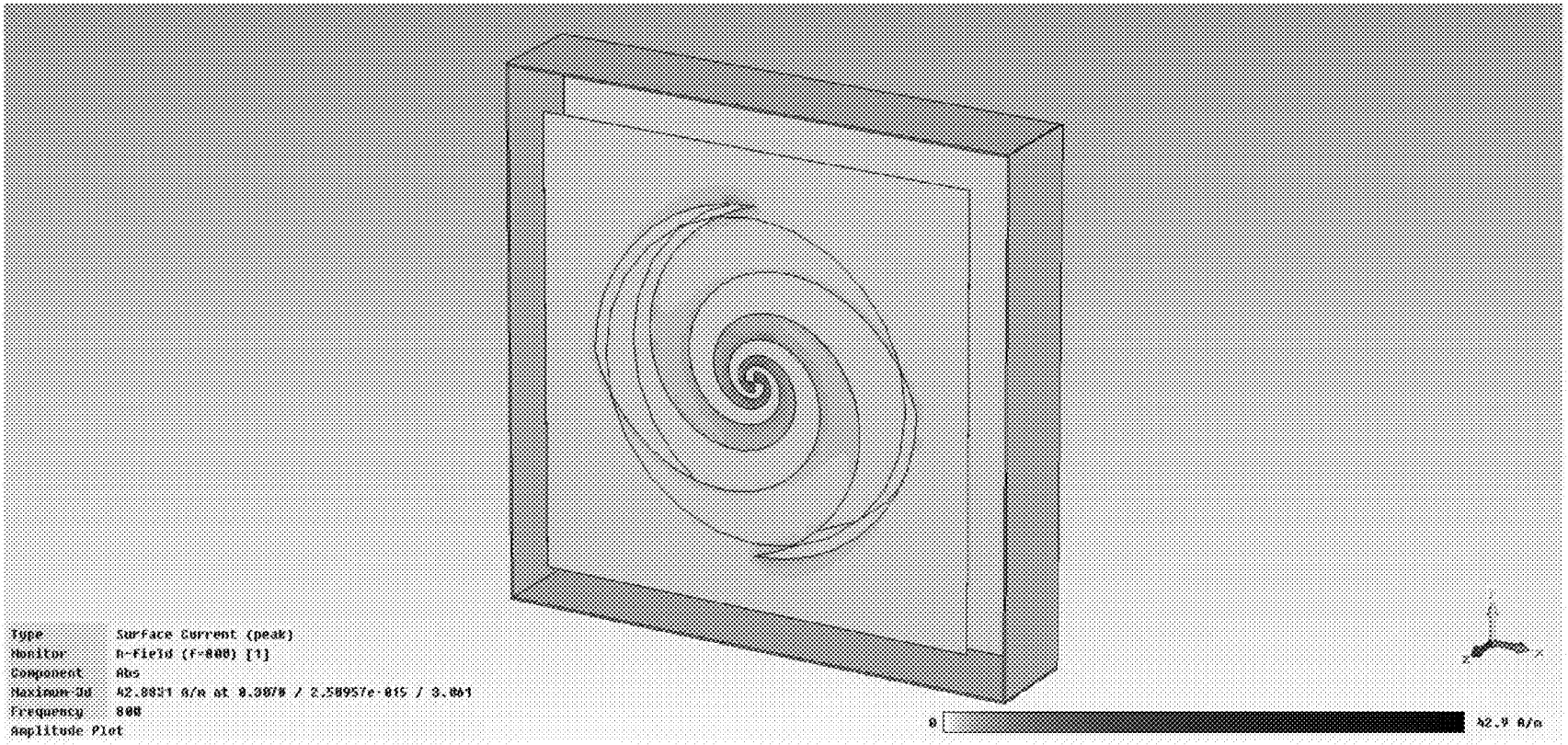
FIG. 26 shows a surface current plot for an embodiment of the invention at 800 MHz.

FIG. 26 shows a surface current plot for an embodiment of the invention at 800 MHz.

Figure 27:
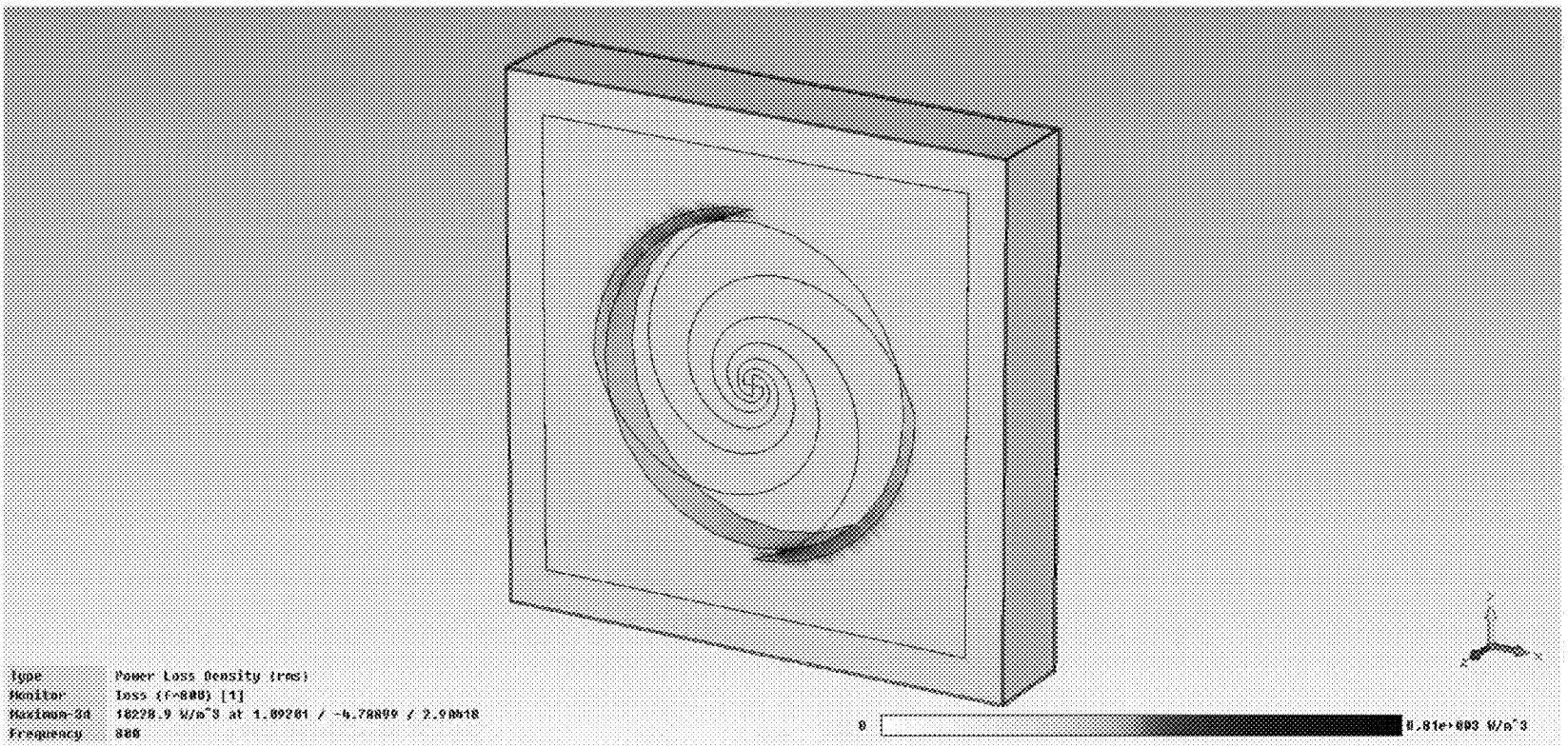
FIG. 27 shows a power loss density plot for an embodiment of the invention at 800 MHz.

FIG. 27 shows a power loss density plot for an embodiment of the invention at 800 MHz.

Figure 28:
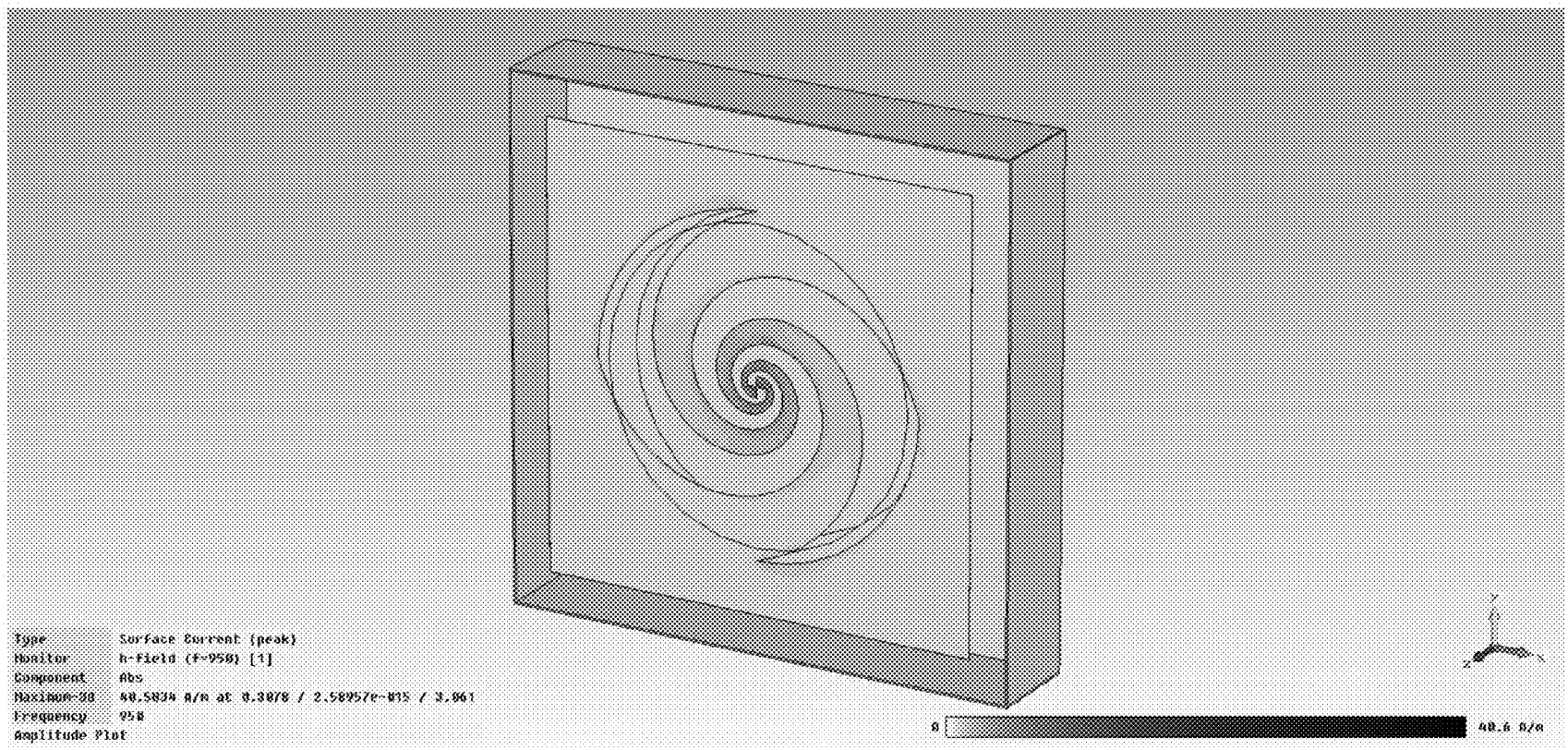
FIG. 28 shows a surface current plot for an embodiment of the invention at 950 MHz.

FIG. 28 shows a surface current plot for an embodiment of the invention at 950 MHz.

Figure 29:
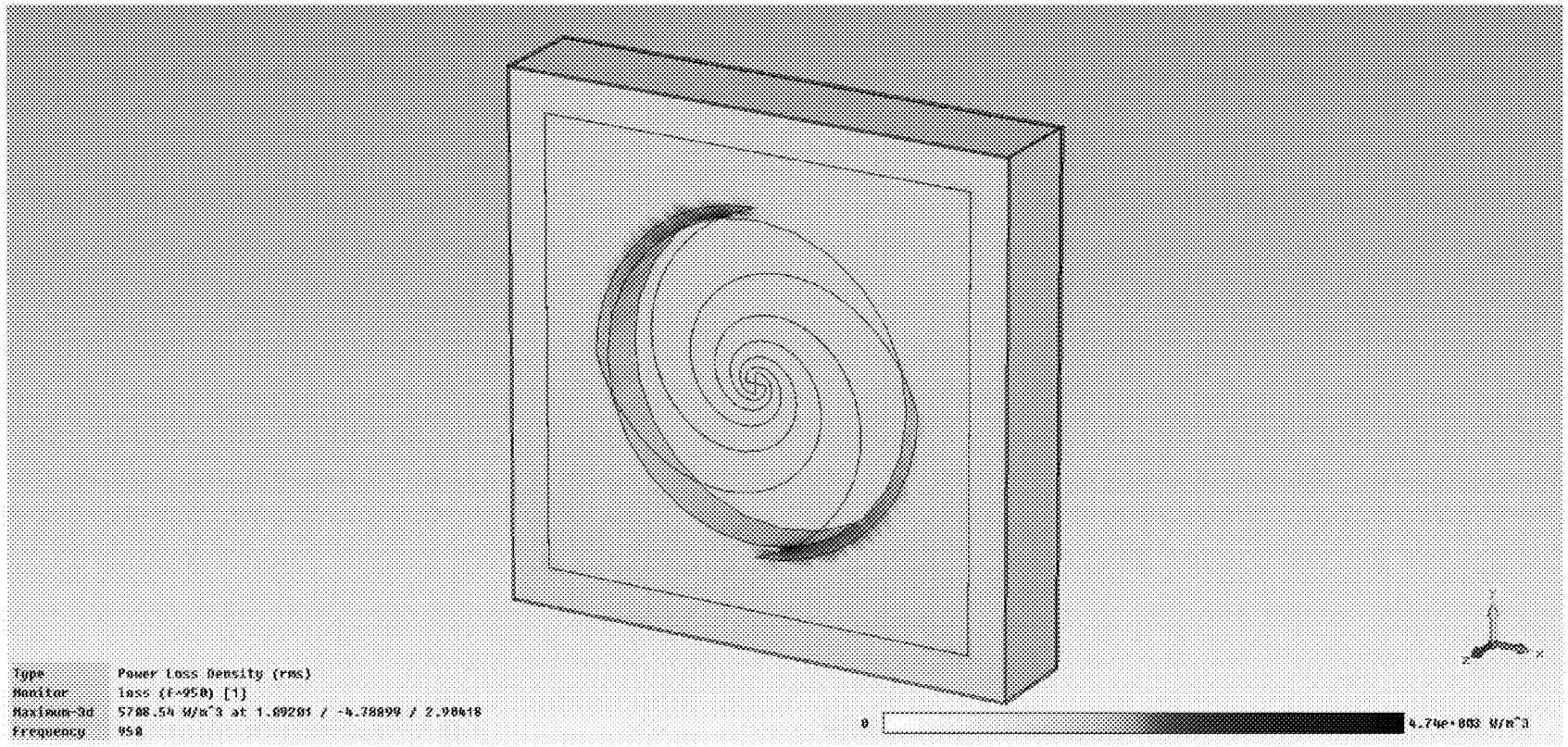
FIG. 29 shows a power loss density plot for an embodiment of the invention at 950 MHz.

FIG. 29 shows a power loss density plot for an embodiment of the invention at 950 MHz.

Figure 30:
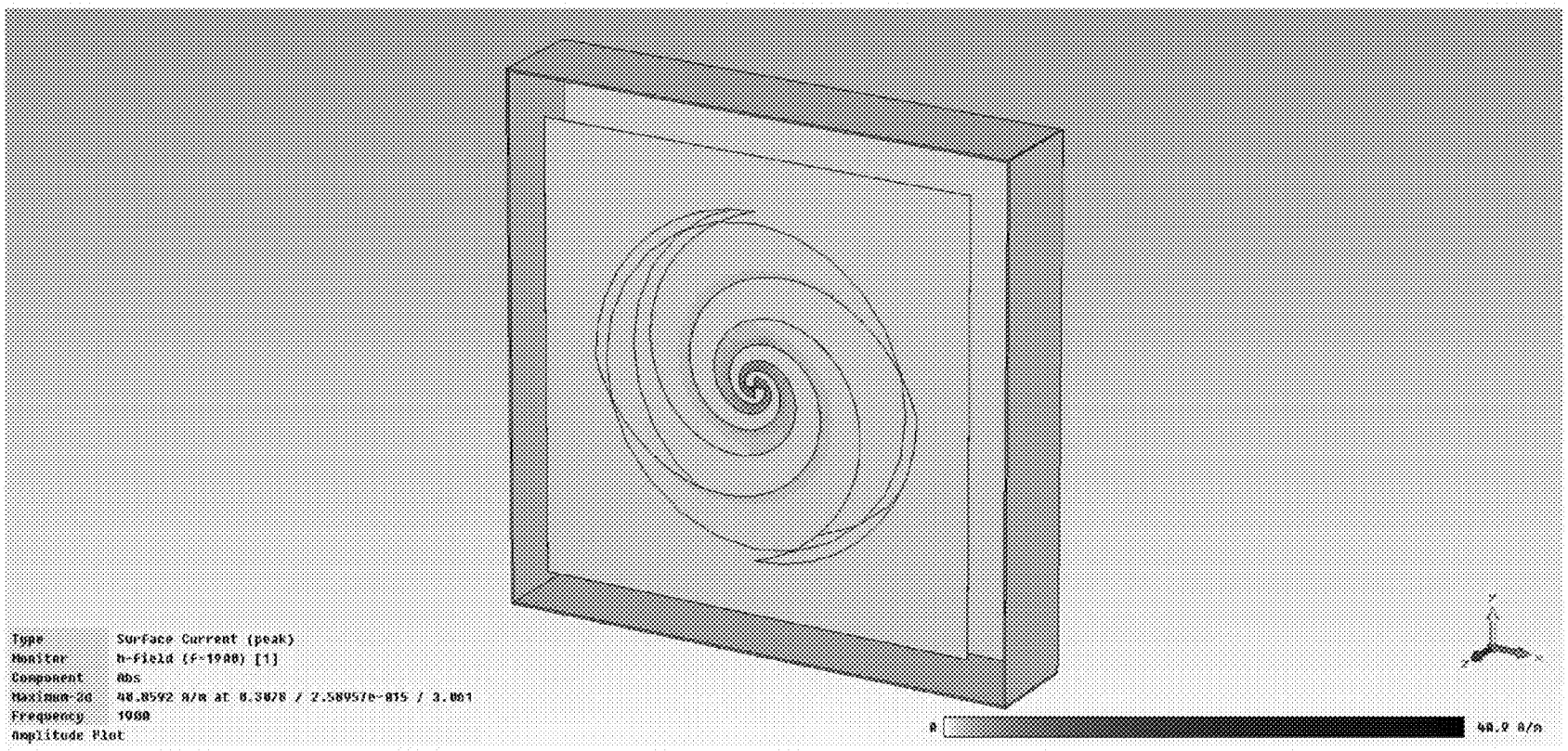
FIG. 30 shows a surface current plot for an embodiment of the invention at 1900 MHz.

FIG. 30 shows a surface current plot for an embodiment of the invention at 1900 MHz.

Figure 31:
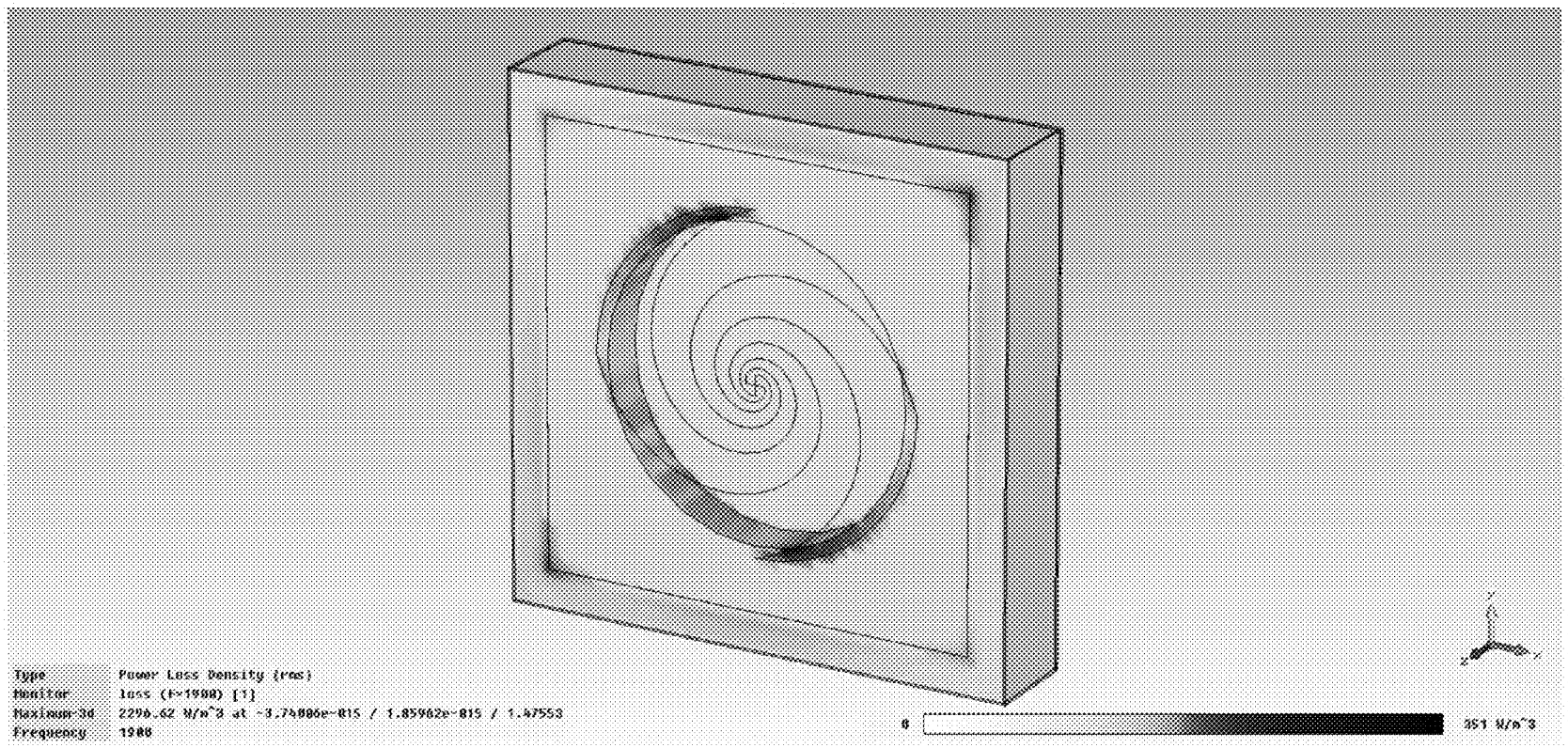
FIG. 31 shows a power loss density plot for an embodiment of the invention at 1900 MHz.

FIG. 31 shows a power loss density plot for an embodiment of the invention at 1900 MHz.

Figure 32:
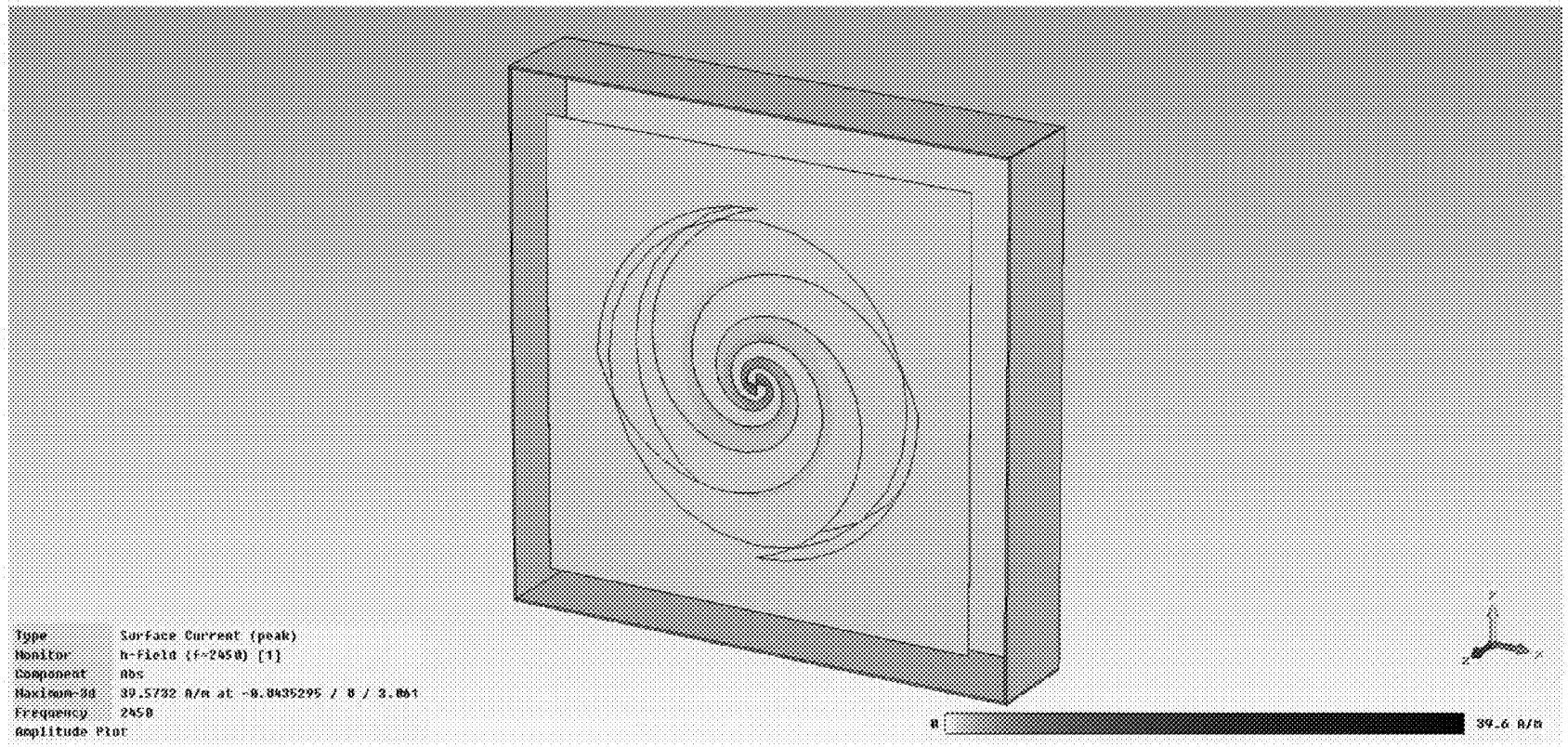
FIG. 32 shows a surface current plot for an embodiment of the invention at 2450 MHz.

FIG. 32 shows a surface current plot for an embodiment of the invention at 2450 MHz.

Figure 33:
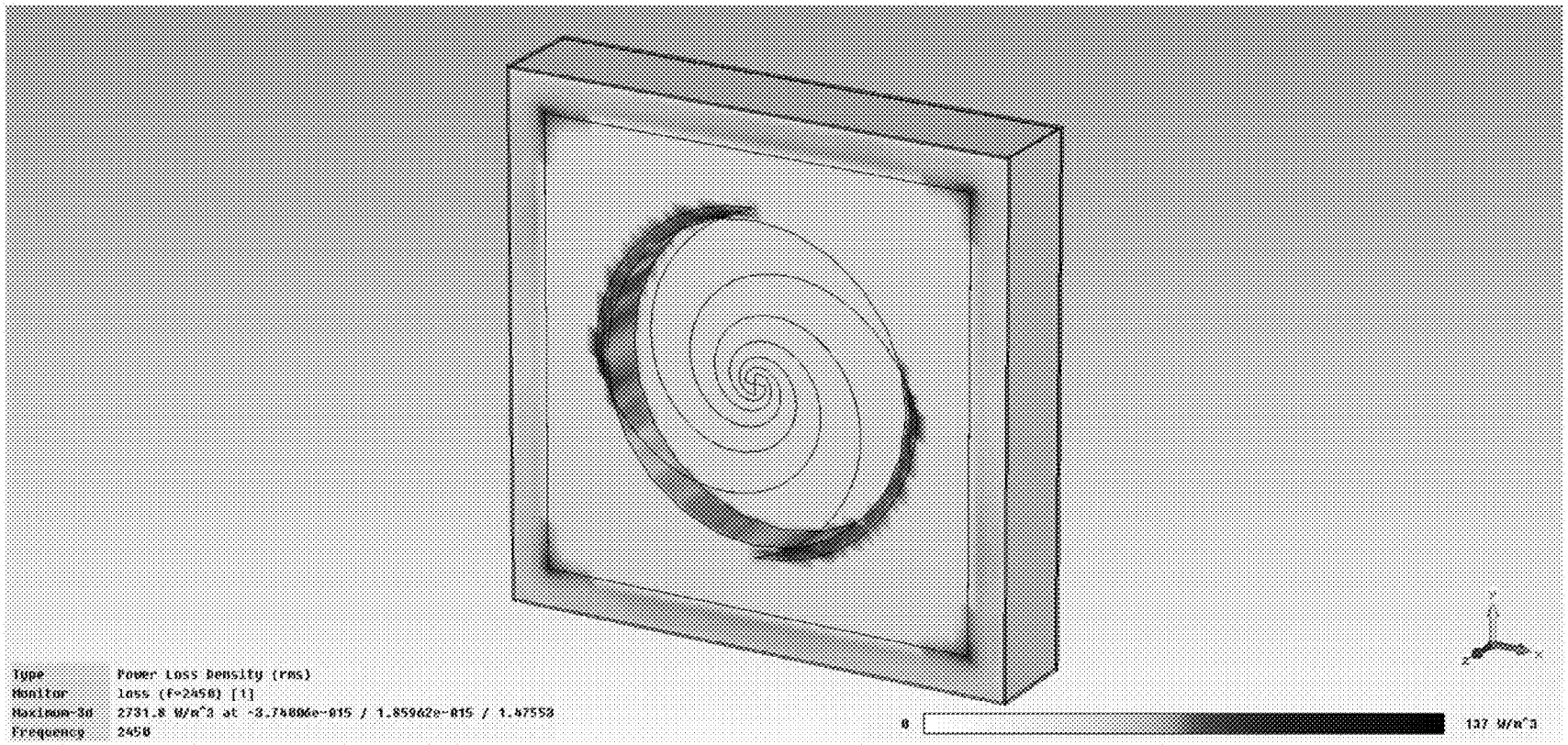
FIG. 33 shows a power loss density plot for an embodiment of the invention at 2450 MHz.

FIG. 33 shows a power loss density plot for an embodiment of the invention at 2450 MHz.

Figure 34:
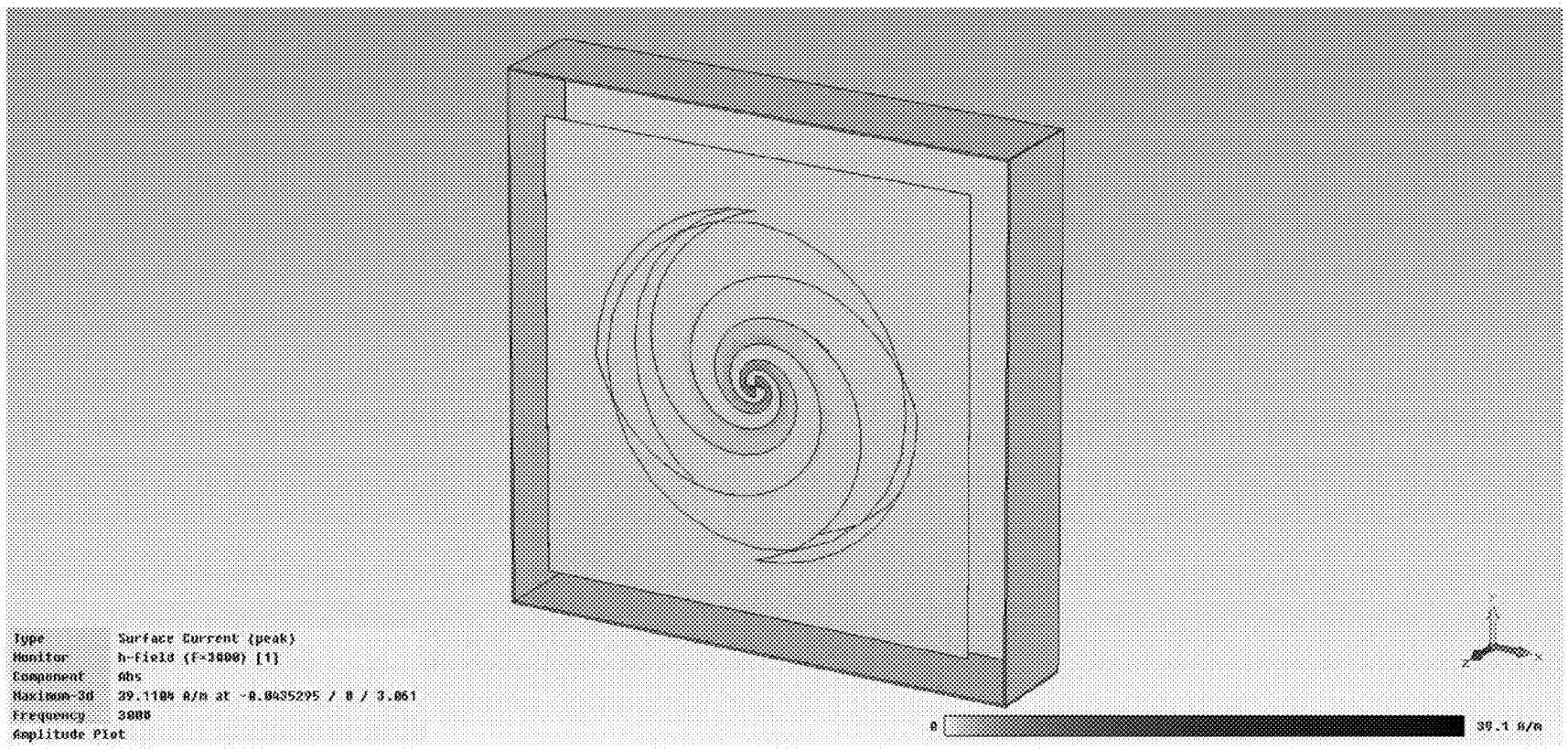
FIG. 34 shows a surface current plot for an embodiment of the invention at 3000 MHz.

FIG. 34 shows a surface current plot for an embodiment of the invention at 3000 MHz.

Figure 35:
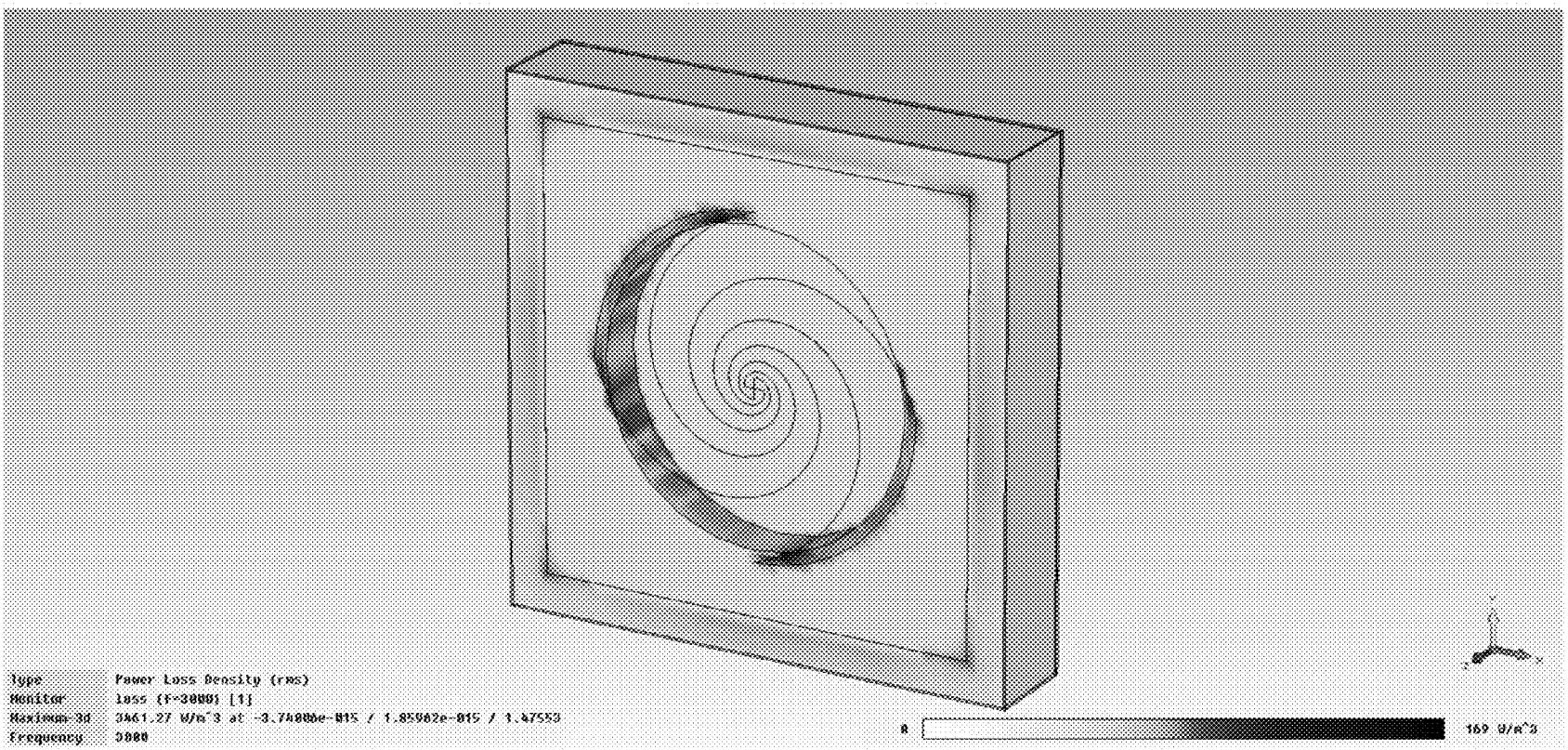
FIG. 35 shows a power loss density plot for an embodiment of the invention at 3000 MHz.

FIG. 35 shows a power loss density plot for an embodiment of the invention at 3000 MHz. The change of scale of the power loss density with respect to FIG. 25 shows that energy is still absorbed at the end of the slots albeit at a lower level, however, FIG. 35 further shows another important feature of the invention in that the absorbent siding also absorbs any current that flows to the edge of the PCB, and this allows one or more embodiments of the invention to have a very high F/B or front to back ratio. This is due to the fact that no currents can reach the container and wrap around to the back of the antenna and radiate in the reverse direction.

Figure 36:
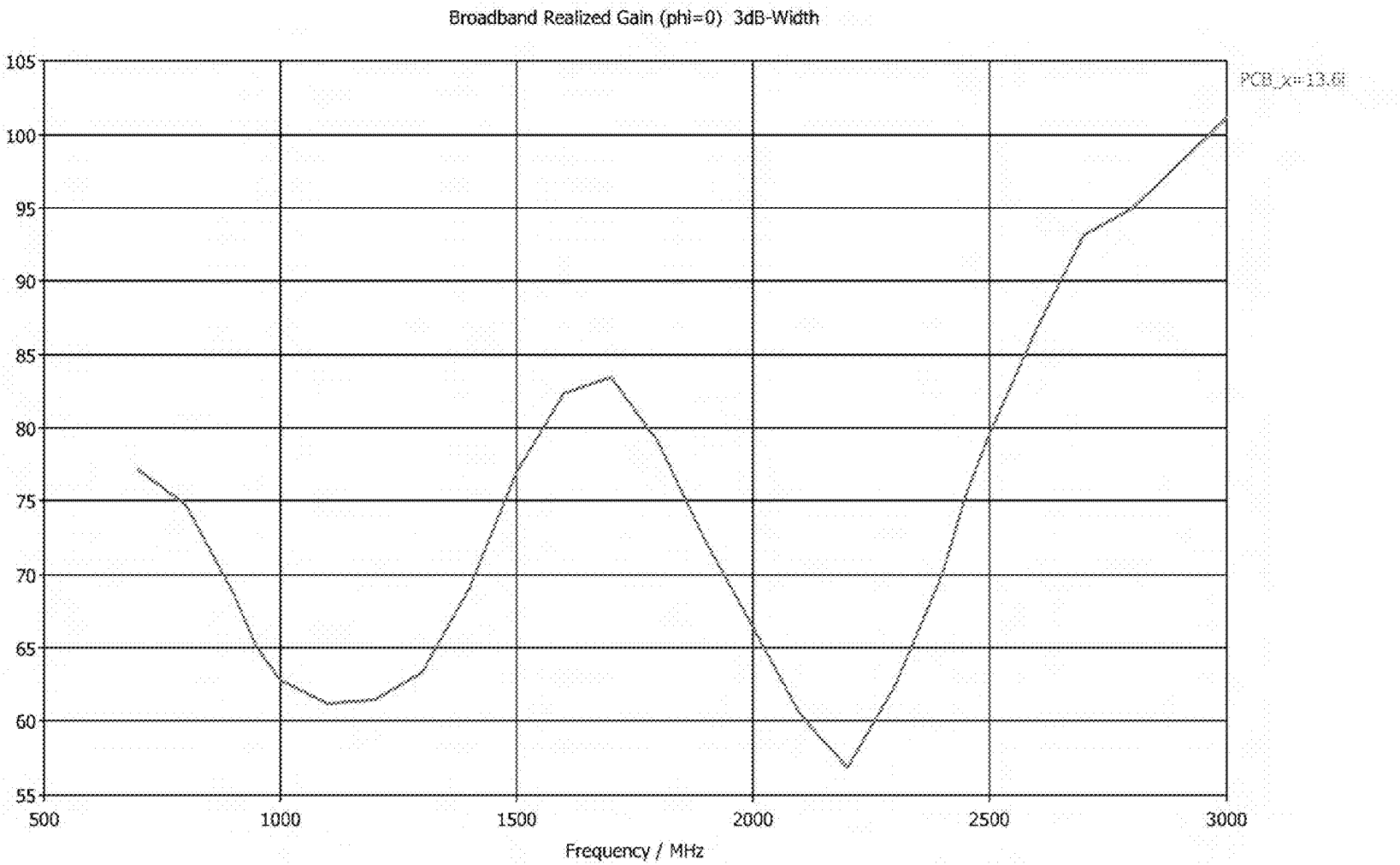
FIG. 36 shows a plot of Half-Power Beamwidth (HPBW) versus frequency from simulation.

FIG. 36 shows a plot of Half-Power Beamwidth (HPBW) versus frequency from simulation.

Figure 37:
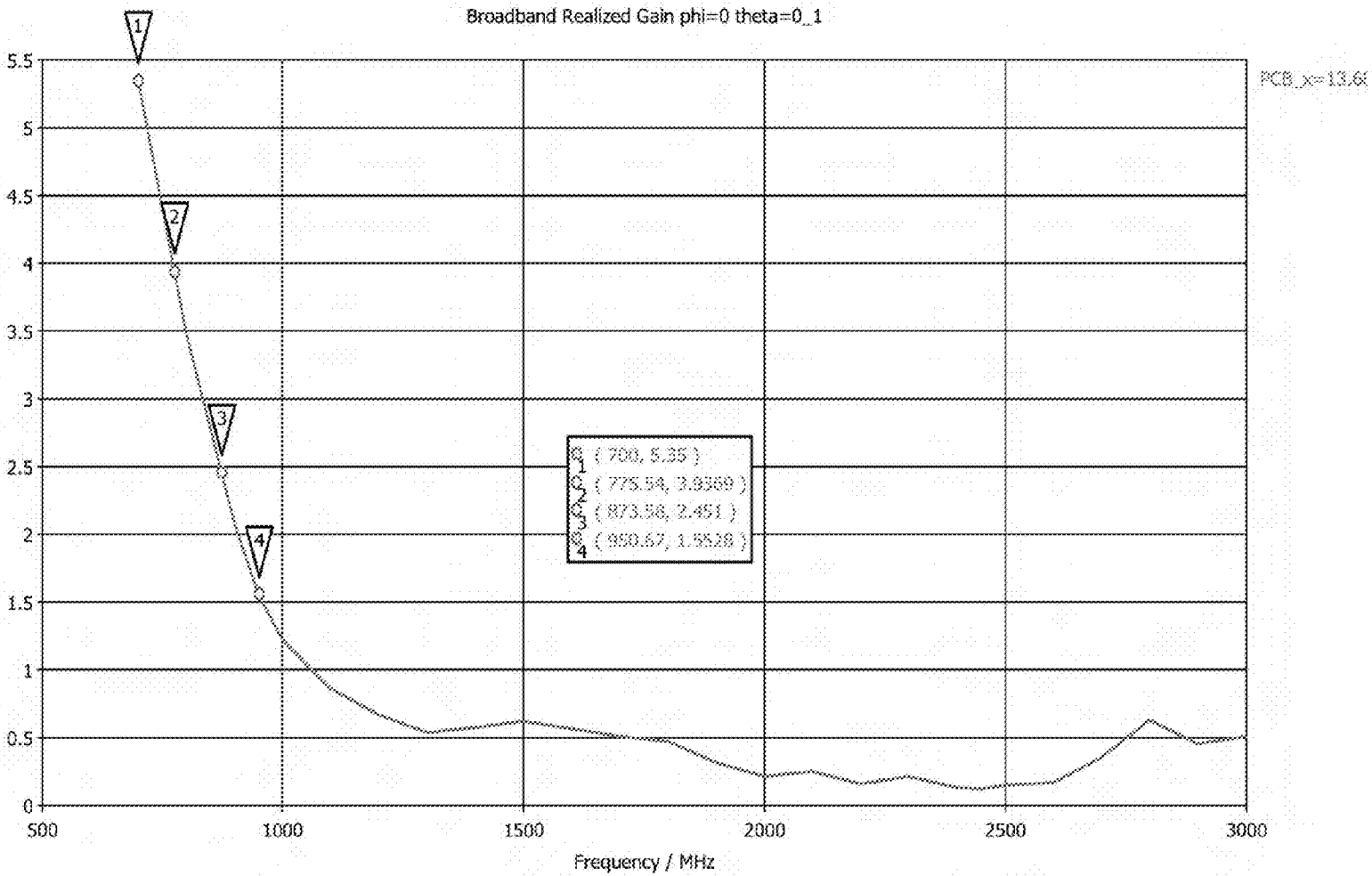
FIG. 37 shows a plot of Axial Ratio (AR) versus frequency from simulation.

FIG. 37 shows a plot of Axial Ratio (AR) versus frequency from simulation.

Figure 38:
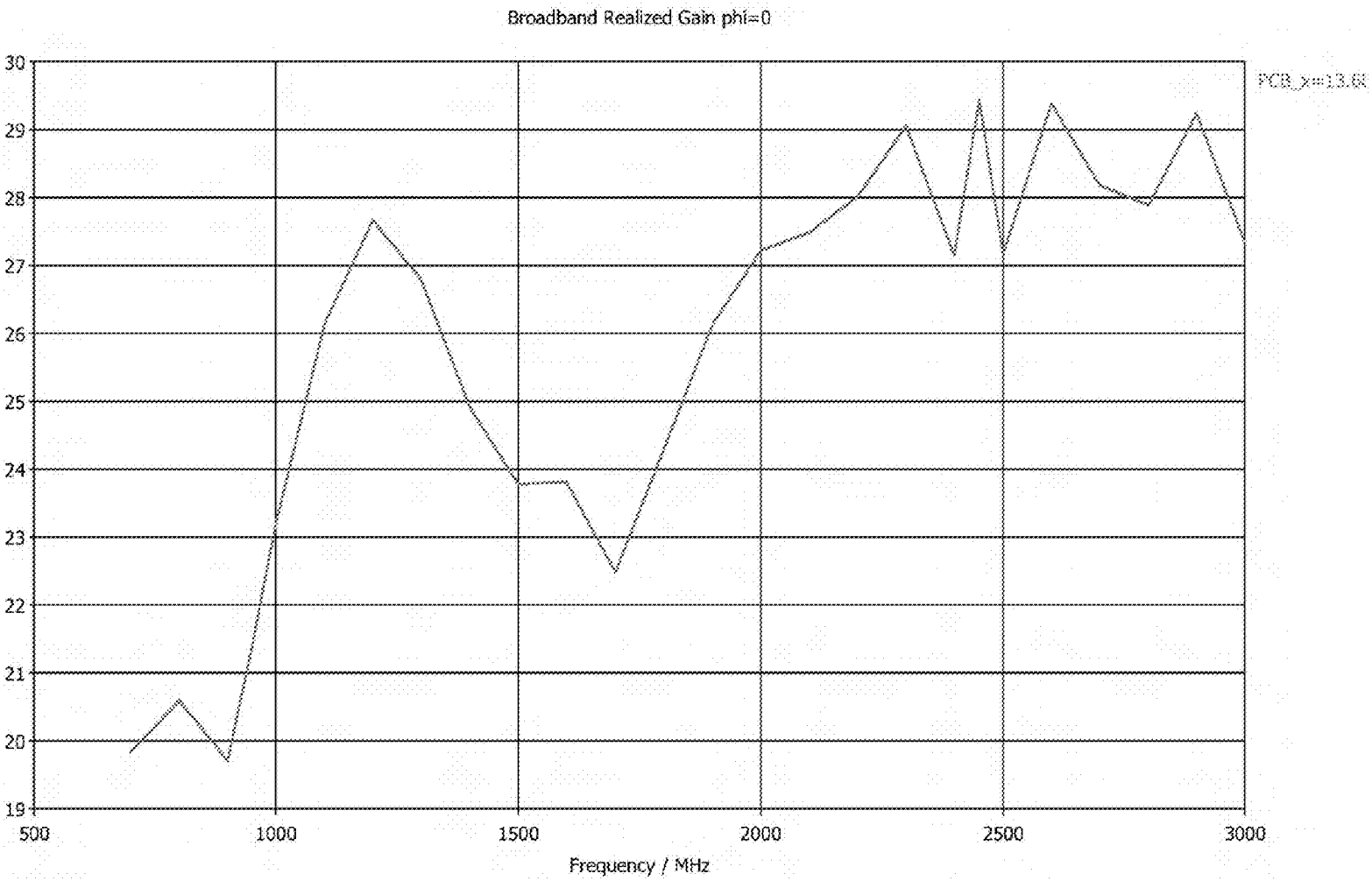
FIG. 38 shows a plot of Front-to-Back Ratio (F/B) versus frequency from simulation.

FIG. 38 shows a plot of Front-to-Back Ratio (F/B) versus frequency from simulation.

Figure 39:
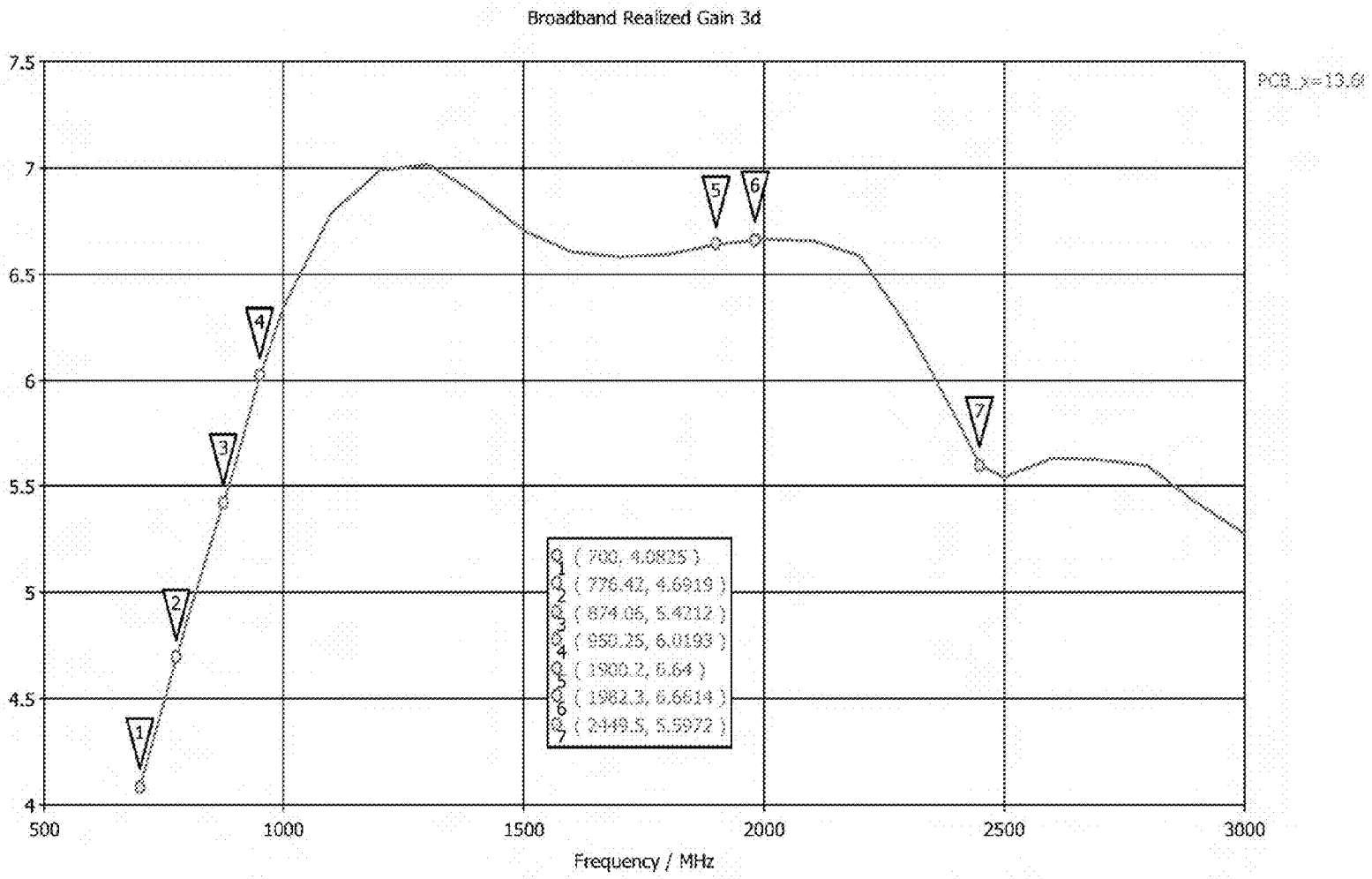
FIG. 39 shows a plot of simulation-predicted boresite gain versus frequency from simulation.

FIG. 39 shows a plot of simulation-predicted boresite gain versus frequency from simulation.

Figure 40:
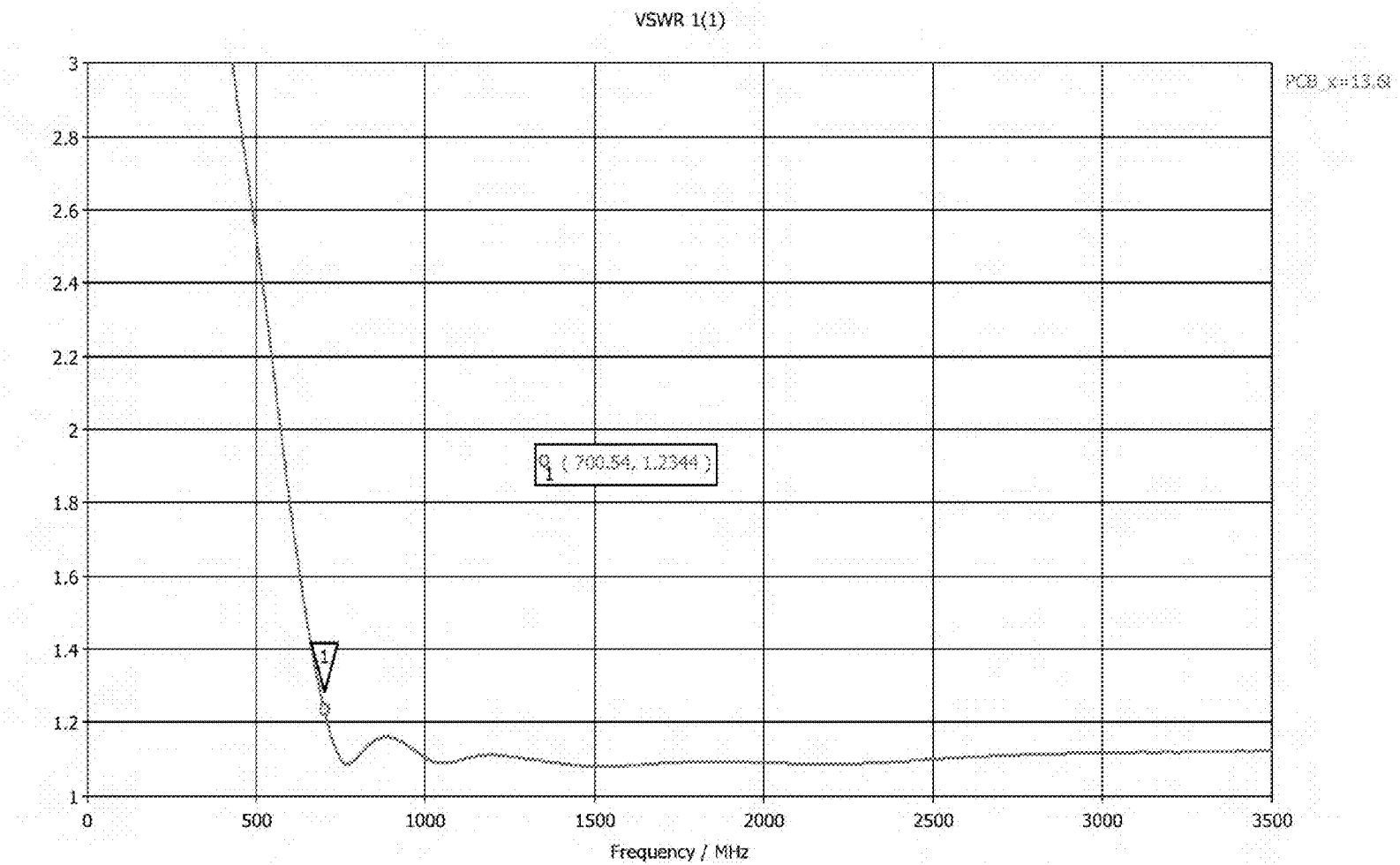
FIG. 40 shows a plot of Voltage Standing Wave Ratio (VSWR) versus frequency from simulation.

FIG. 40 shows a plot of Voltage Standing Wave Ratio (VSWR) versus frequency from simulation.

Figure 41:
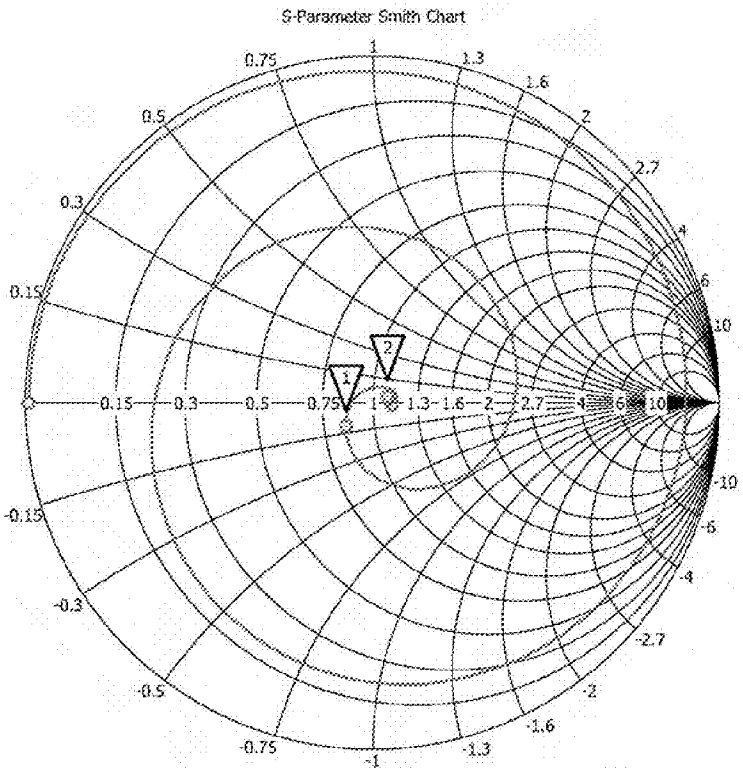
FIG. 41 shows a Smith Chart of the input impedance of the antenna feedpoint referred to 150 Ohms from simulation.

FIG. 41 shows a Smith Chart of the input impedance of the antenna feed-point referred to 150 Ohms from simulation.

Figure 42:
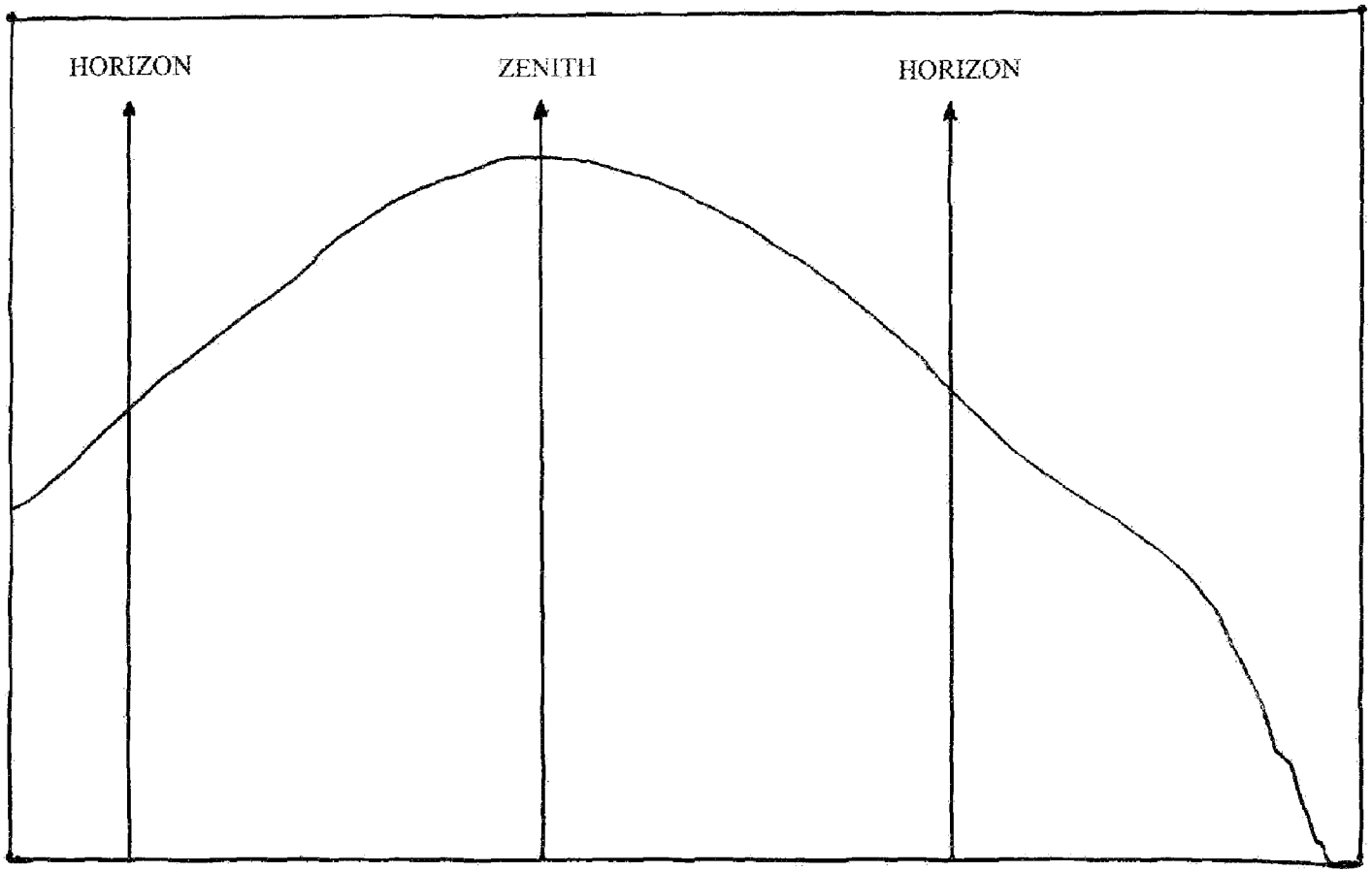
FIG. 42 shows a plot of 700 MHz RHCP Antenna Gain of the prototype versus azimuth, measured on an antenna range.

FIG. 42 shows a plot of 700 MHz RHCP Antenna Gain of the prototype versus azimuth, measured on an antenna range.

Figure 43:
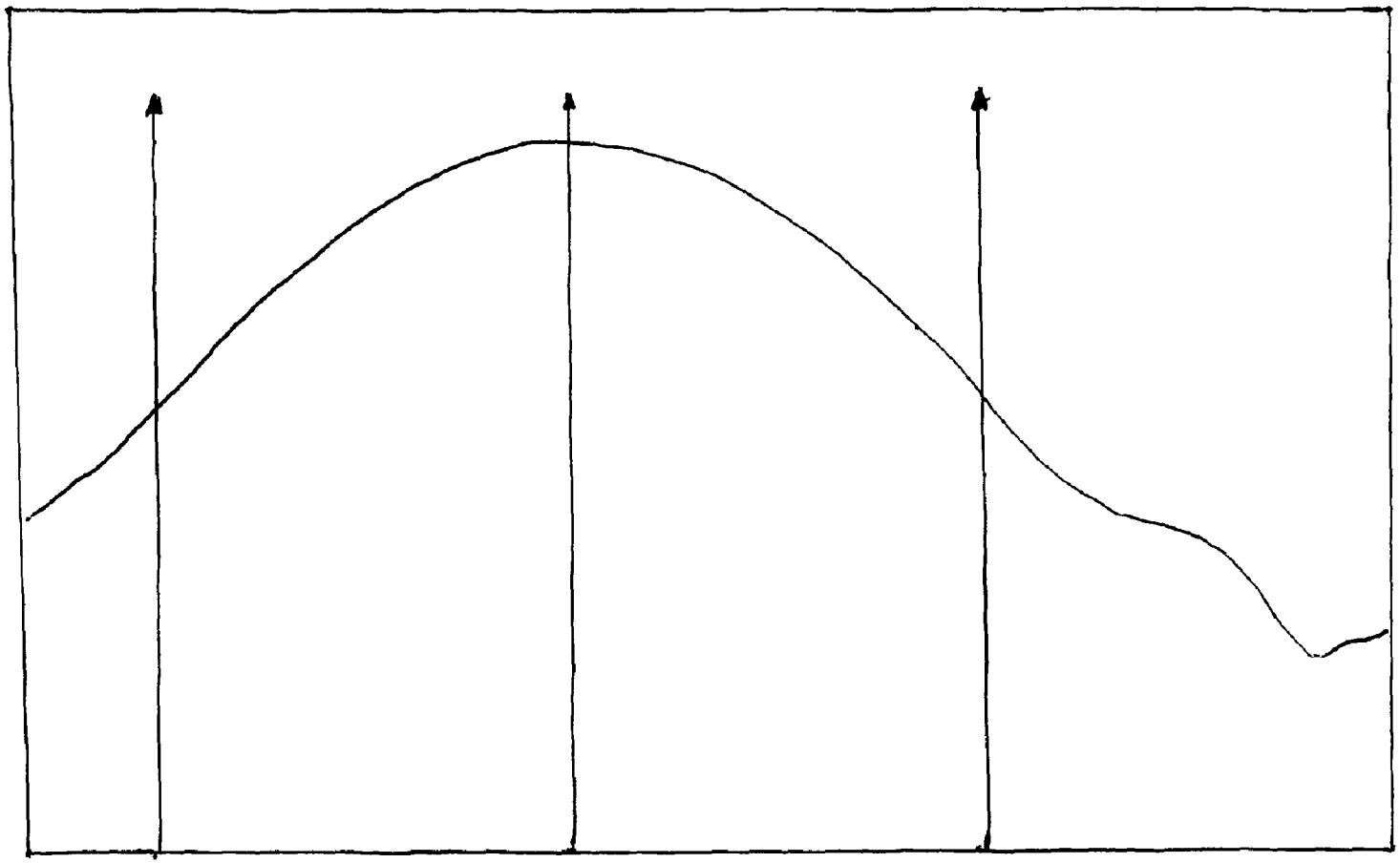
FIG. 43 shows a plot of 776 MHz RHCP Antenna Gain of the prototype versus azimuth, measured on an antenna range.

FIG. 43 shows a plot of 776 MHz RHCP Antenna Gain of the prototype versus azimuth, measured on an antenna range.

Figure 44:
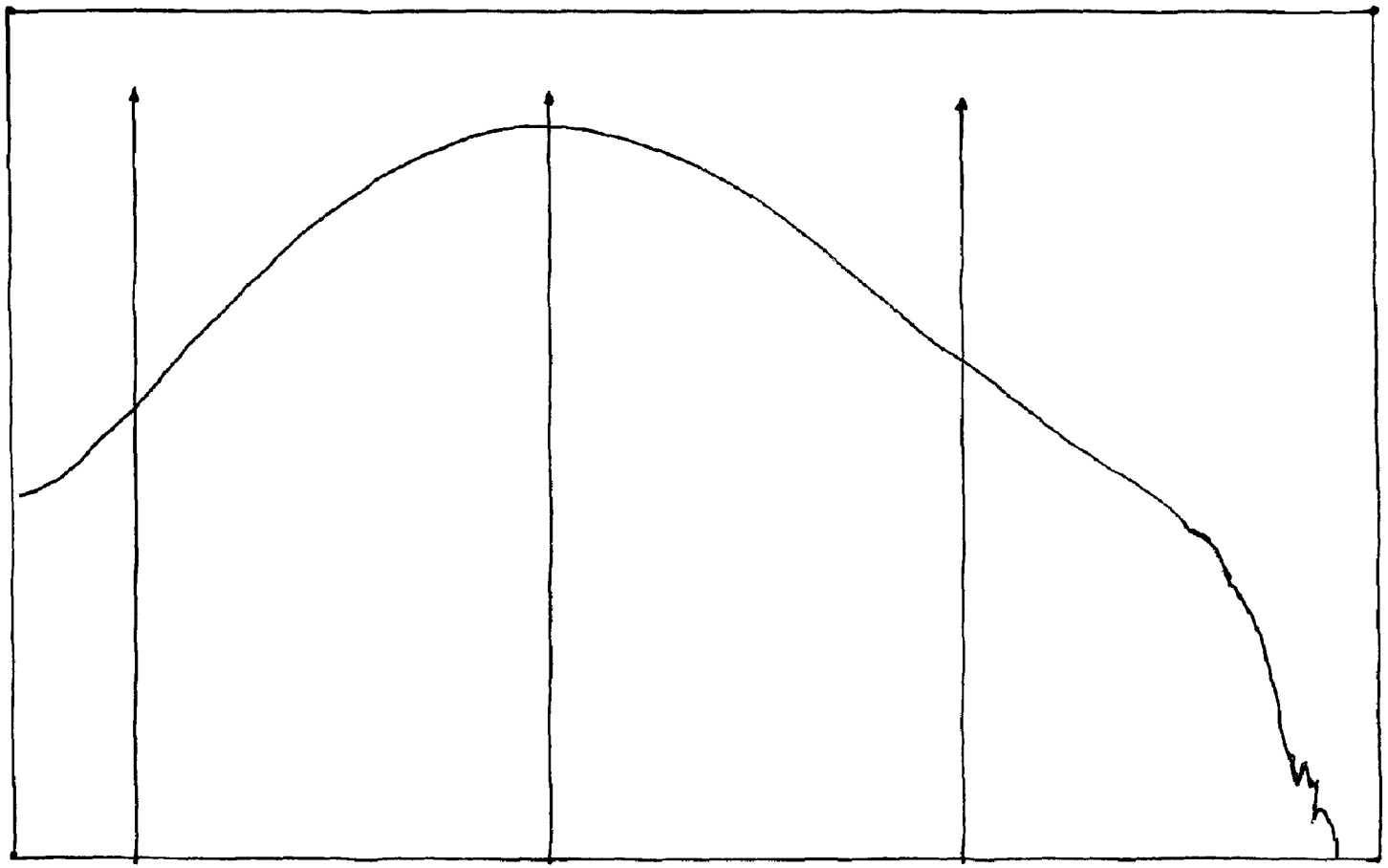
FIG. 44 shows a plot of 874 MHz RHCP Antenna Gain of the prototype versus azimuth, measured on an antenna range.

FIG. 44 shows a plot of 874 MHz RHCP Antenna Gain of the prototype versus azimuth, measured on an antenna range.

Figure 45:
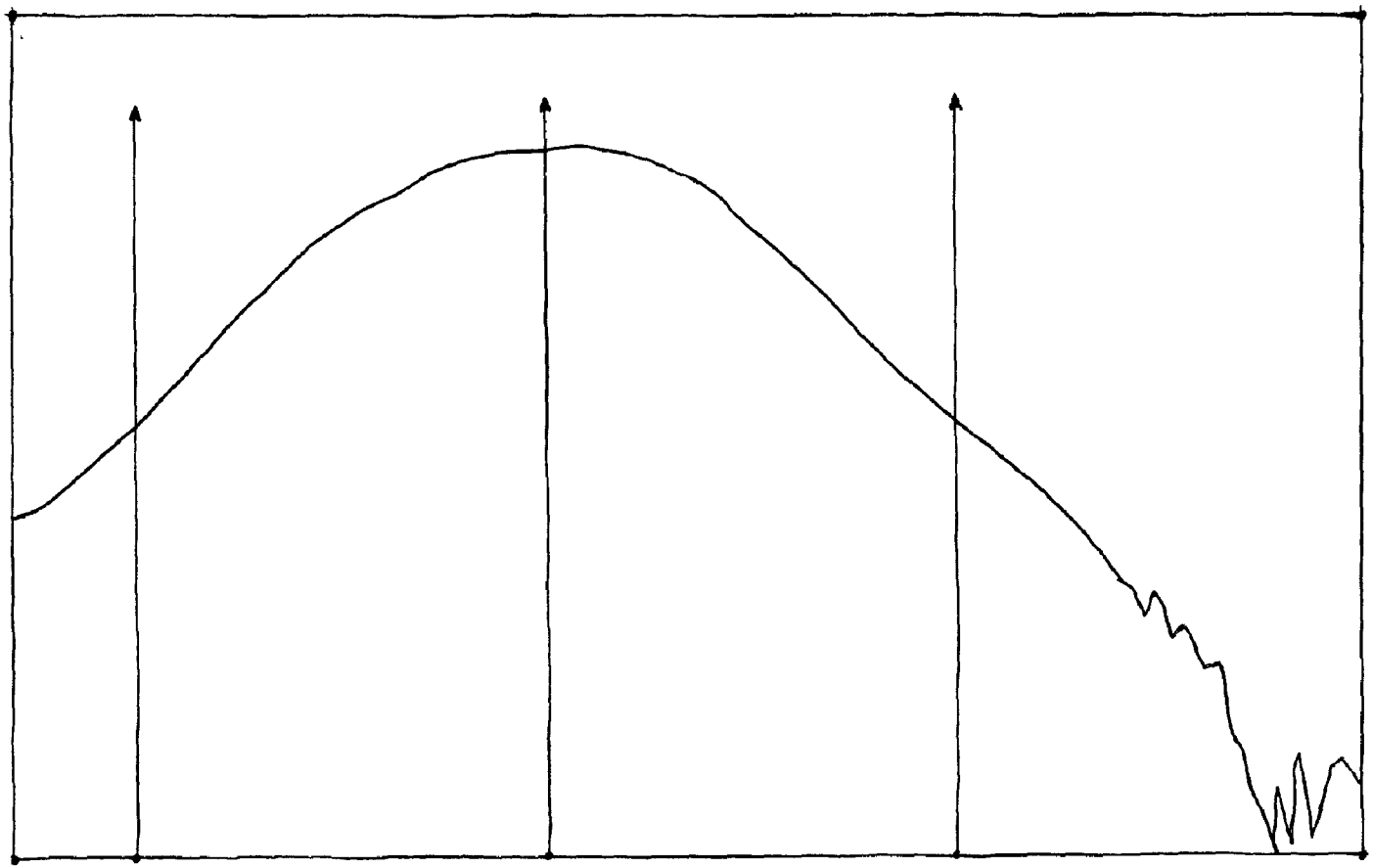
FIG. 45 shows a plot of 950 MHz RHCP Antenna Gain of the prototype versus azimuth, measured on an antenna range.

FIG. 45 shows a plot of 950 MHz RHCP Antenna Gain of the prototype versus azimuth, measured on an antenna range.

Figure 46:
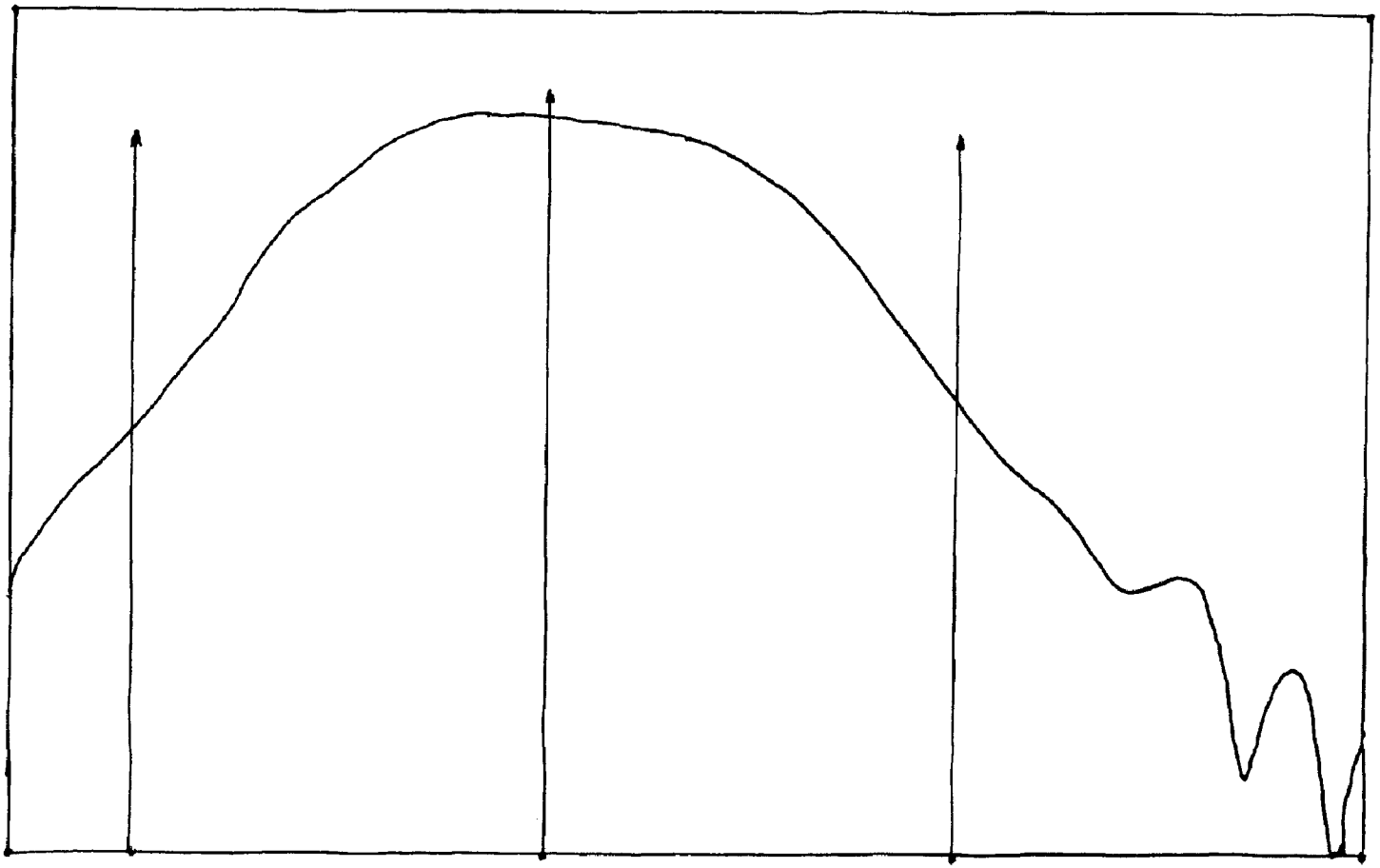
FIG. 46 shows a plot of 1900 MHz RHCP Antenna Gain of the prototype versus azimuth, measured on an antenna range.

FIG. 46 shows a plot of 1900 MHz RHCP Antenna Gain of the prototype versus azimuth, measured on an antenna range.

Figure 47:
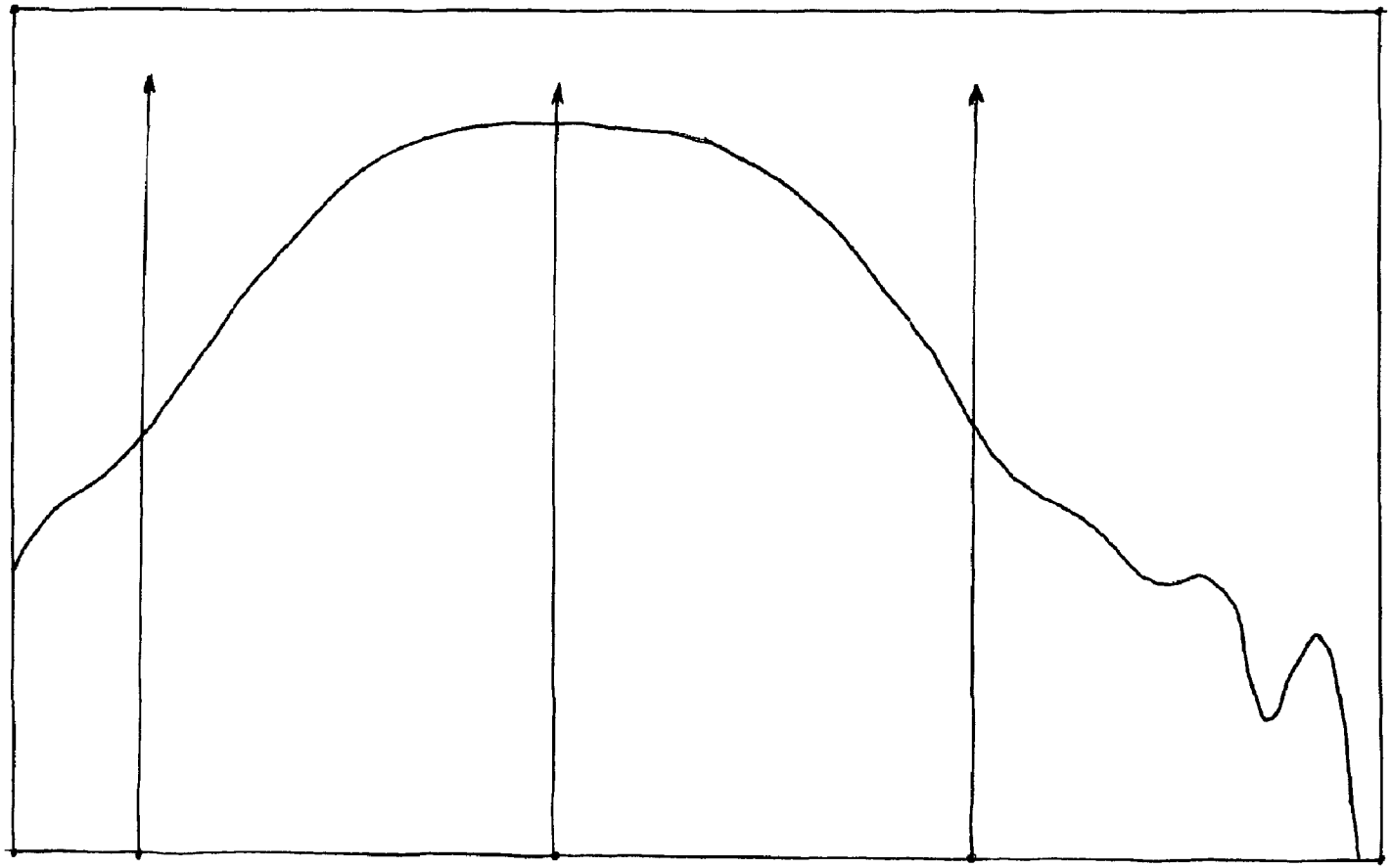
FIG. 47 shows a plot of 1982 MHz RHCP Antenna Gain of the prototype versus azimuth, measured on an antenna range.

FIG. 47 shows a plot of 1982 MHz RHCP Antenna Gain of the prototype versus azimuth, measured on an antenna range.

Figure 48:
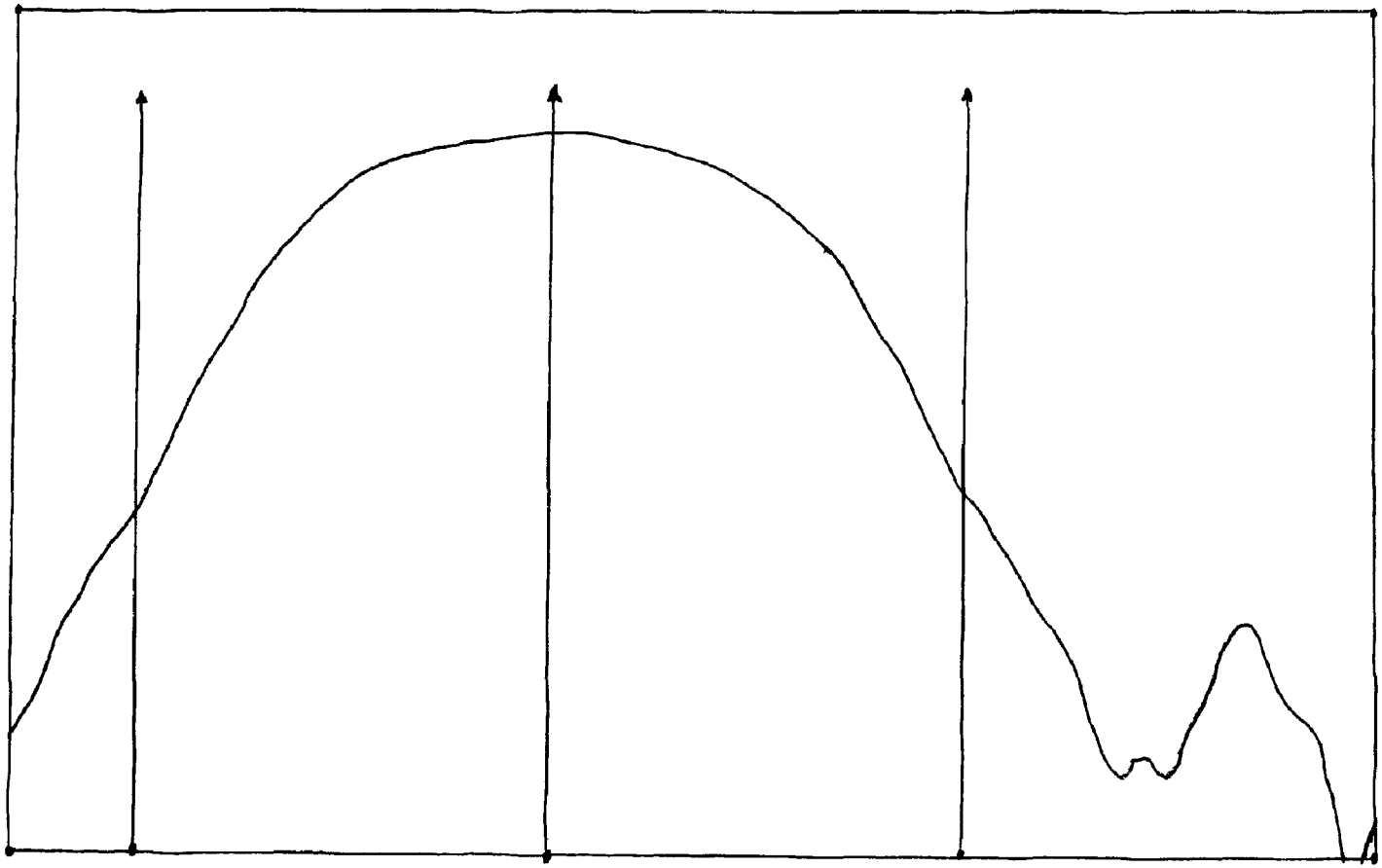
FIG. 48 shows a plot of 2450 MHz RHCP Antenna Gain of the prototype versus azimuth, measured on an antenna range.

FIG. 48 shows a plot of 2450 MHz RHCP Antenna Gain of the prototype versus azimuth, measured on an antenna range.

Figure 49:
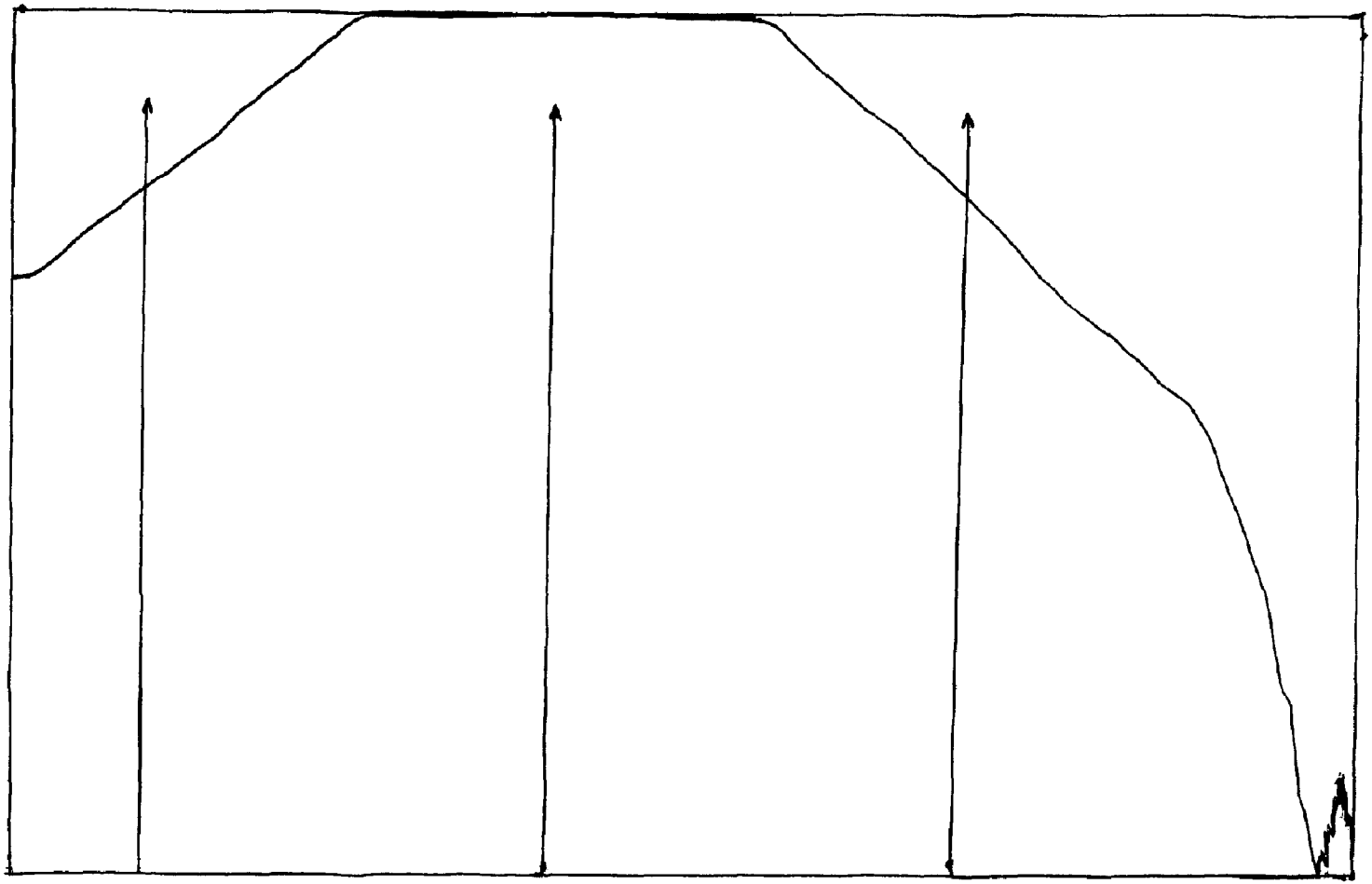
FIG. 49 shows a plot of 700 MHz RHCP Antenna Gain of the prototype versus azimuth, measured on an antenna range, raised 10 dB relative to FIG. 42.

FIG. 49 shows a plot of 700 MHz RHCP Antenna Gain of the prototype versus azimuth, measured on an antenna range, raised 10 dB relative to FIG. 42.

Figure 50:
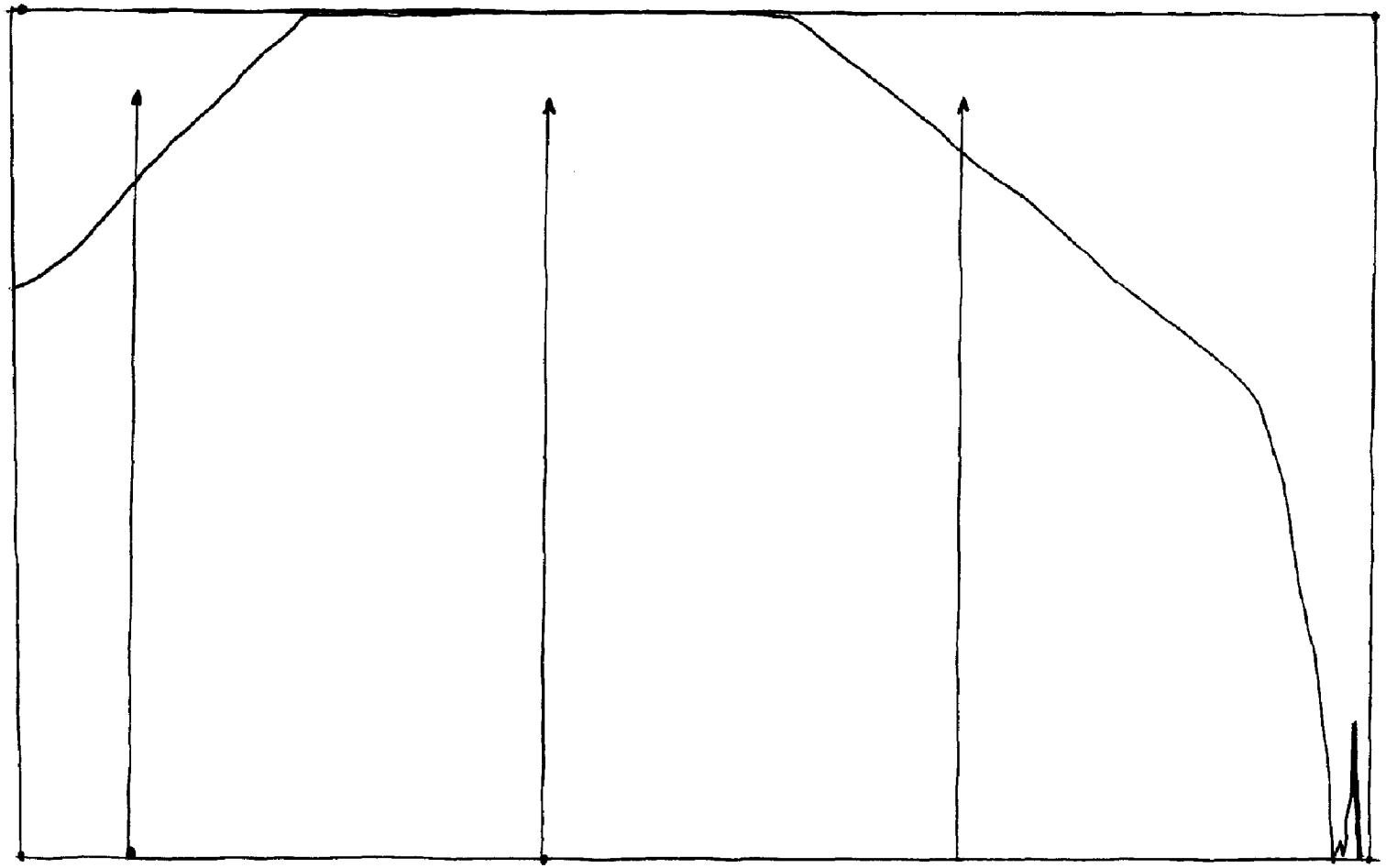
FIG. 50 shows a plot of 874 MHz RHCP Antenna Gain of the prototype versus azimuth, measured on an antenna range, raised 10 dB relative to FIG. 44.

FIG. 50 shows a plot of 874 MHz RHCP Antenna Gain of the prototype versus azimuth, measured on an antenna range, raised 10 dB relative to FIG. 44.

Figure 51:
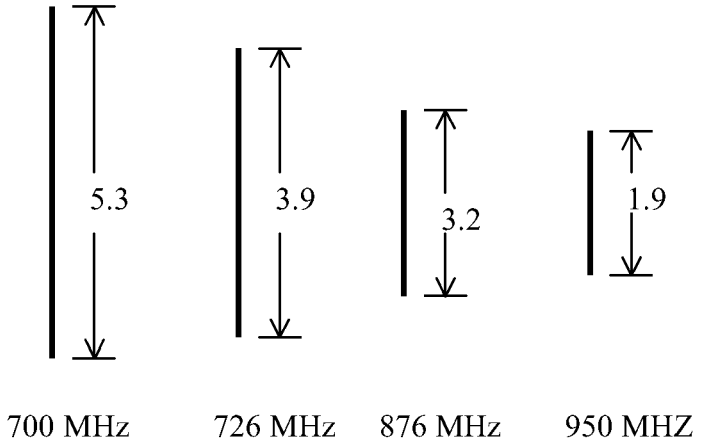
FIG. 51 shows a plot of axial ratio on boresite at four frequencies, using the method of rotating linear source.

FIG. 51 shows a plot of axial ratio on boresite at four frequencies, using the method of rotating linear source.

Figure 52:
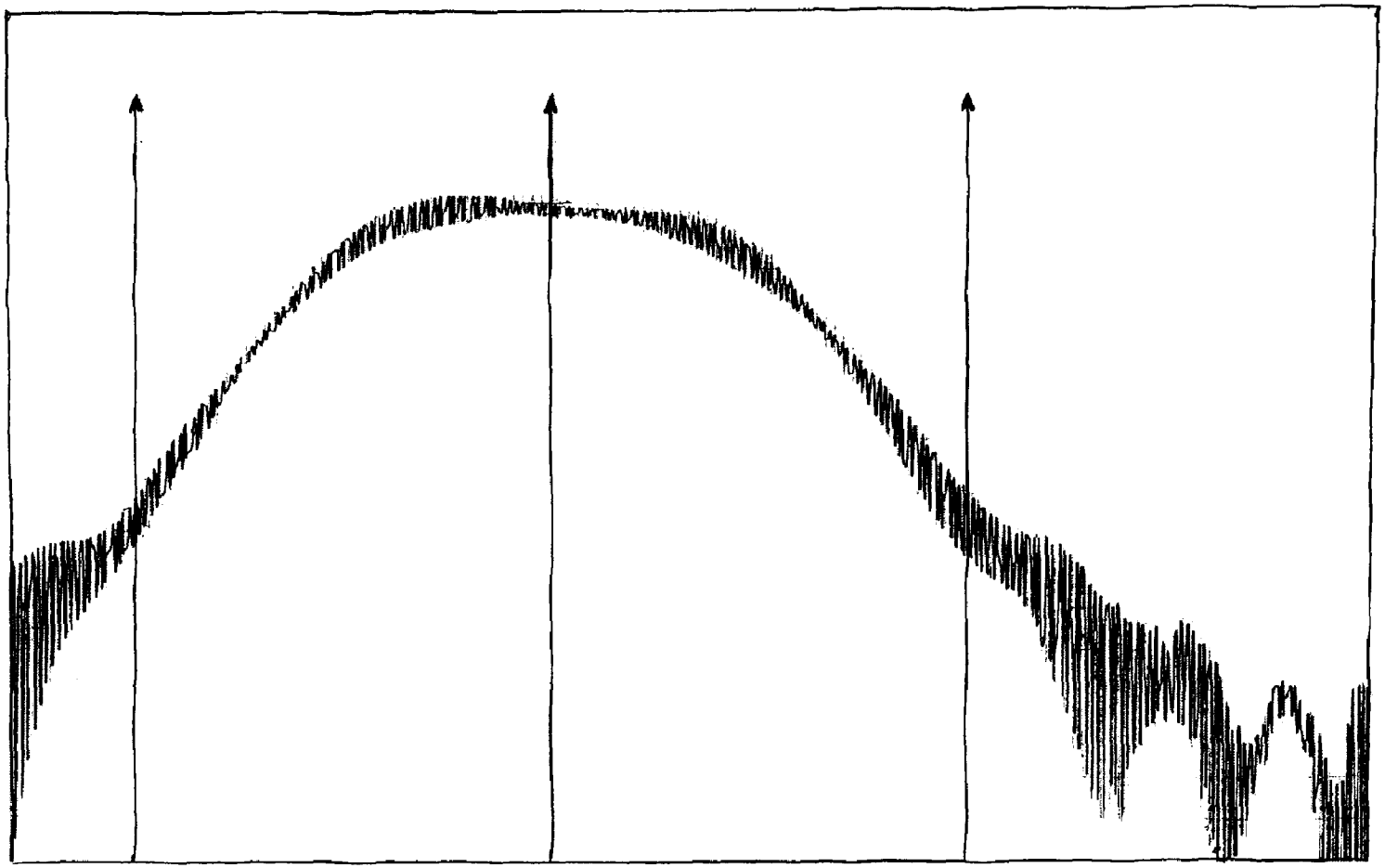
FIG. 52 shows a plot of 1900 MHz antenna gain using a rotating linear source versus azimuth for evaluation of axial ratio.

FIG. 52 shows a plot of 1900 MHz antenna gain using a rotating linear source versus azimuth for evaluation of axial ratio.

Figure 53:
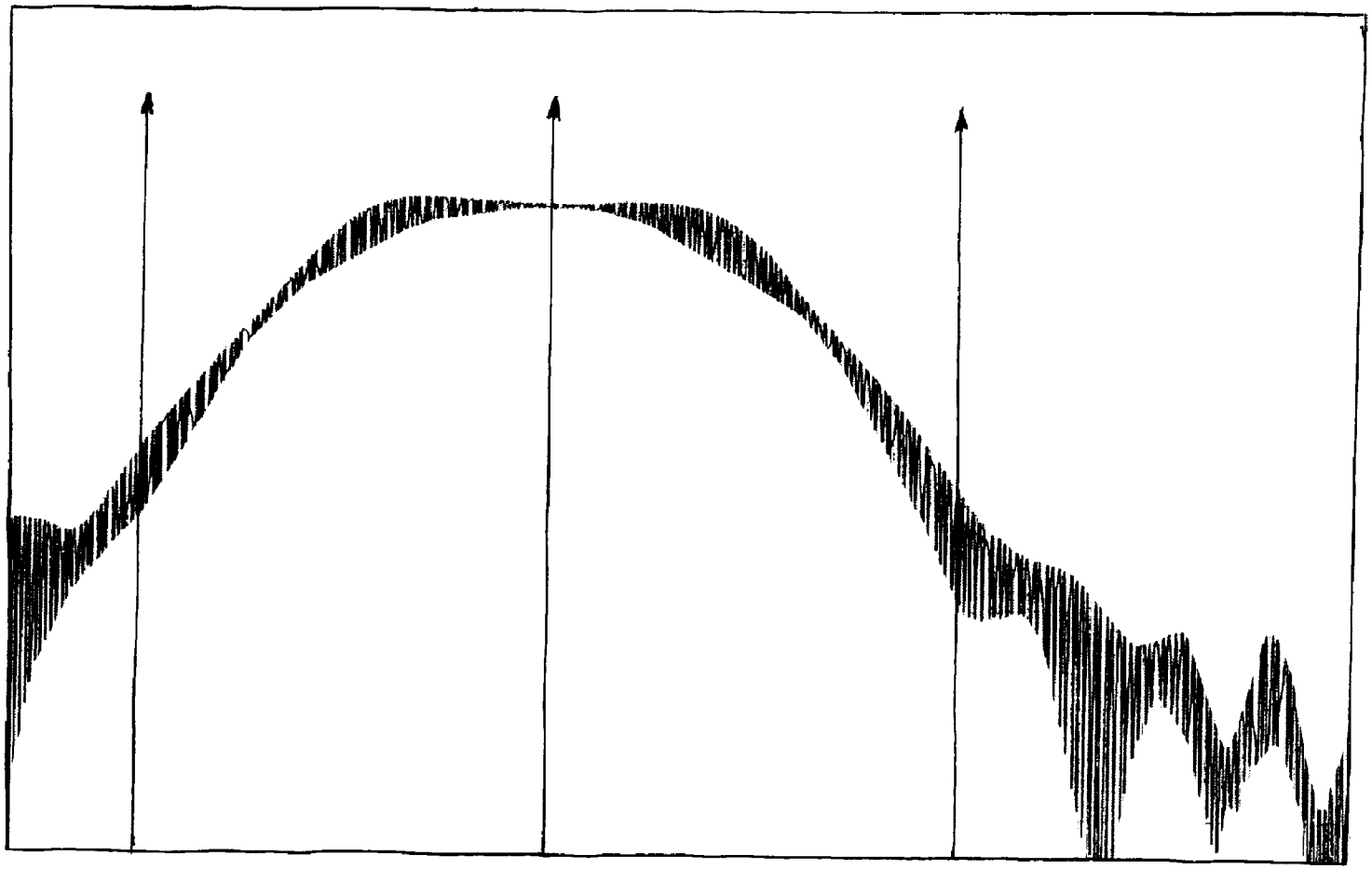
FIG. 53 shows a plot of 1982 MHz antenna gain using a rotating linear source versus azimuth for evaluation of axial ratio.

FIG. 53 shows a plot of 1982 MHz antenna gain using a rotating linear source versus azimuth for evaluation of axial ratio.

Figure 54:
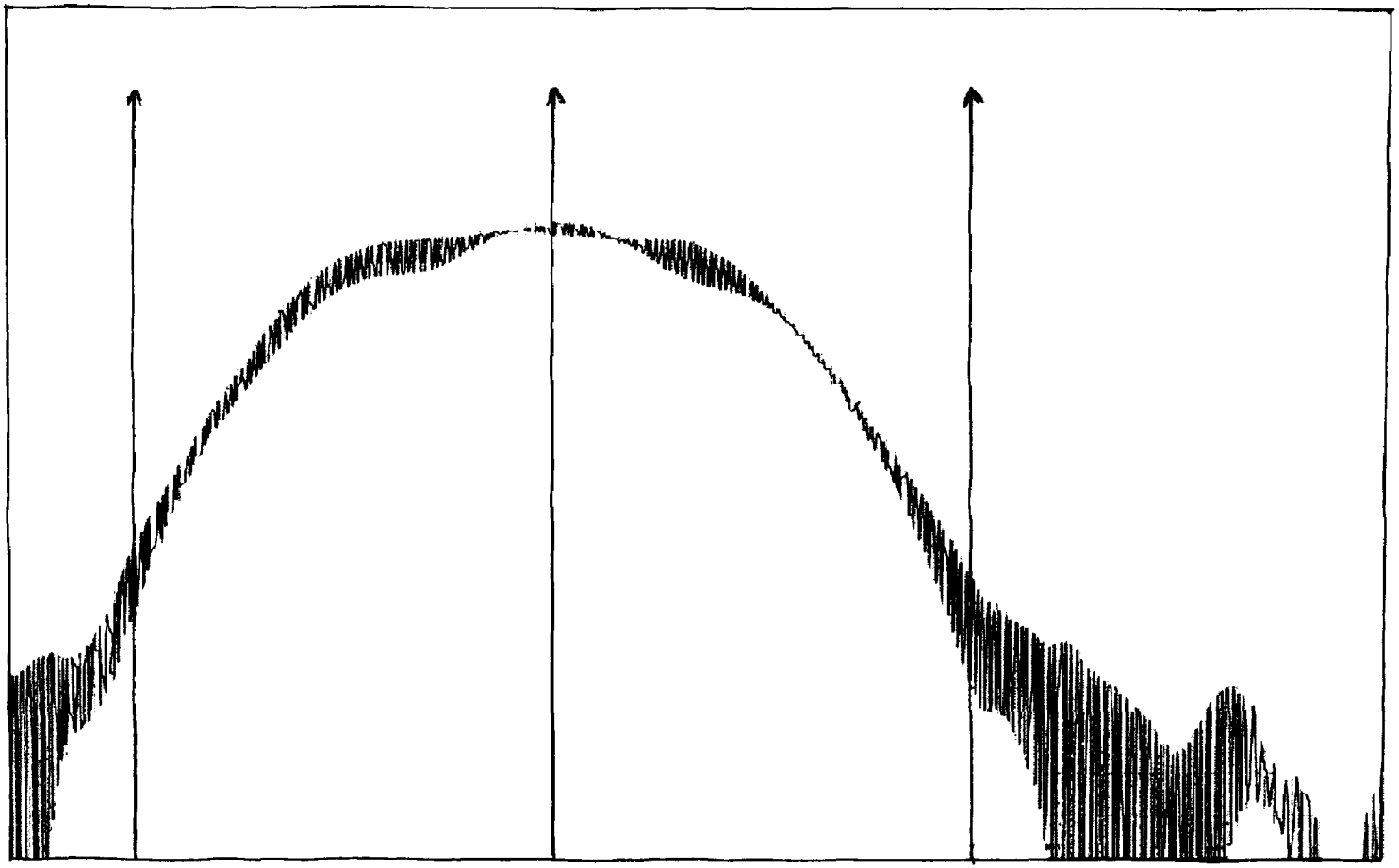
FIG. 54 shows a plot of 2450 MHz antenna gain using a rotating linear source versus azimuth for evaluation of axial ratio.

FIG. 54 shows a plot of 2450 MHz antenna gain using a rotating linear source versus azimuth for evaluation of axial ratio.

Figure 55:
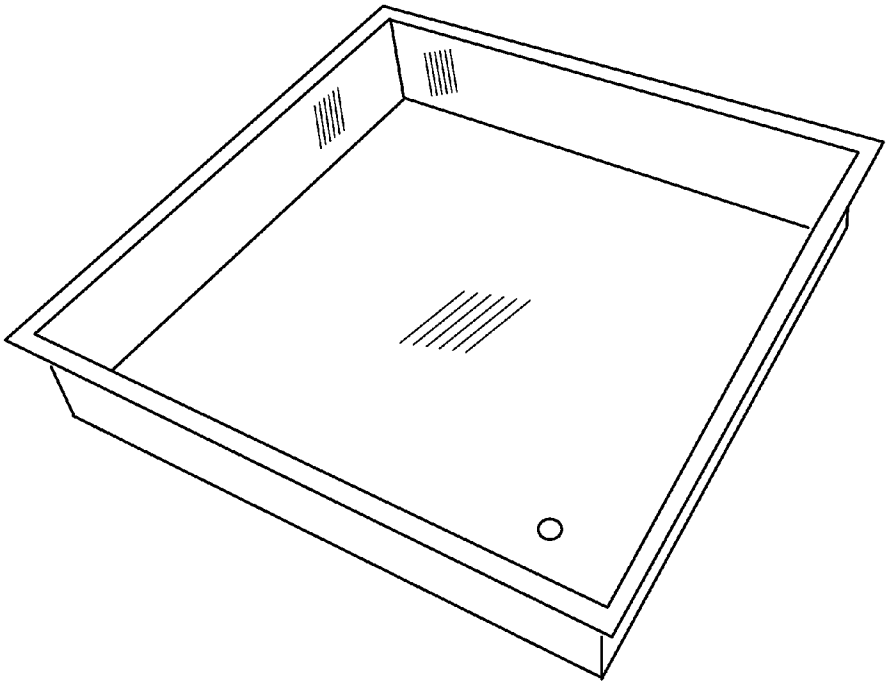
FIG. 55 shows a picture of an embodiment of the container.

FIG. 55 shows a picture of an embodiment of the container. Embodiments of the invention may utilize ferrite beads as shown on the coaxial cable 802.

Figure 56:
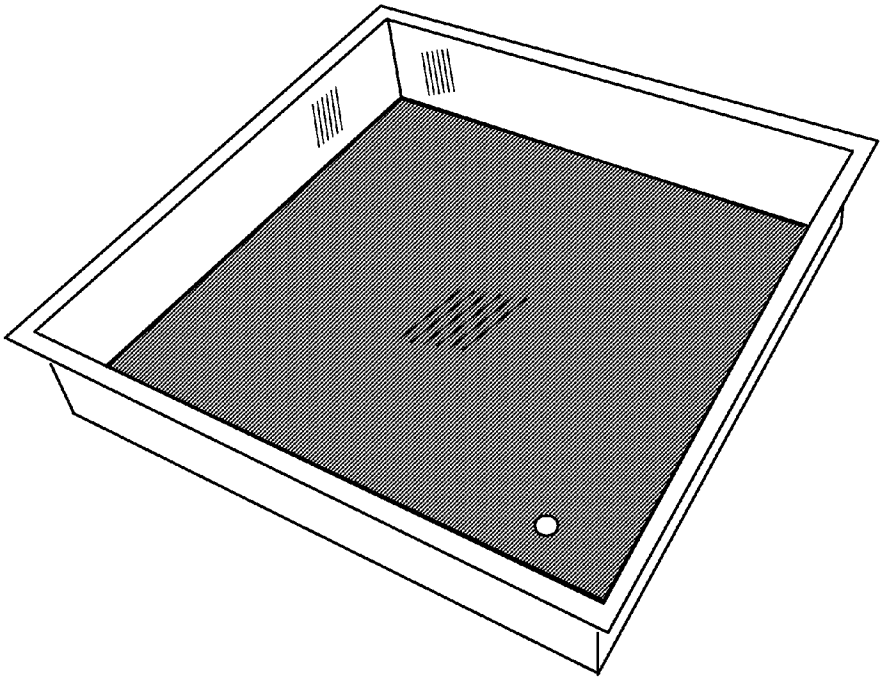
FIG. 56 shows a picture of an embodiment of the energy absorbent backing coupled with the container.

FIG. 56 shows a picture of an embodiment of the energy absorbent backing coupled with the container.

Figure 57:
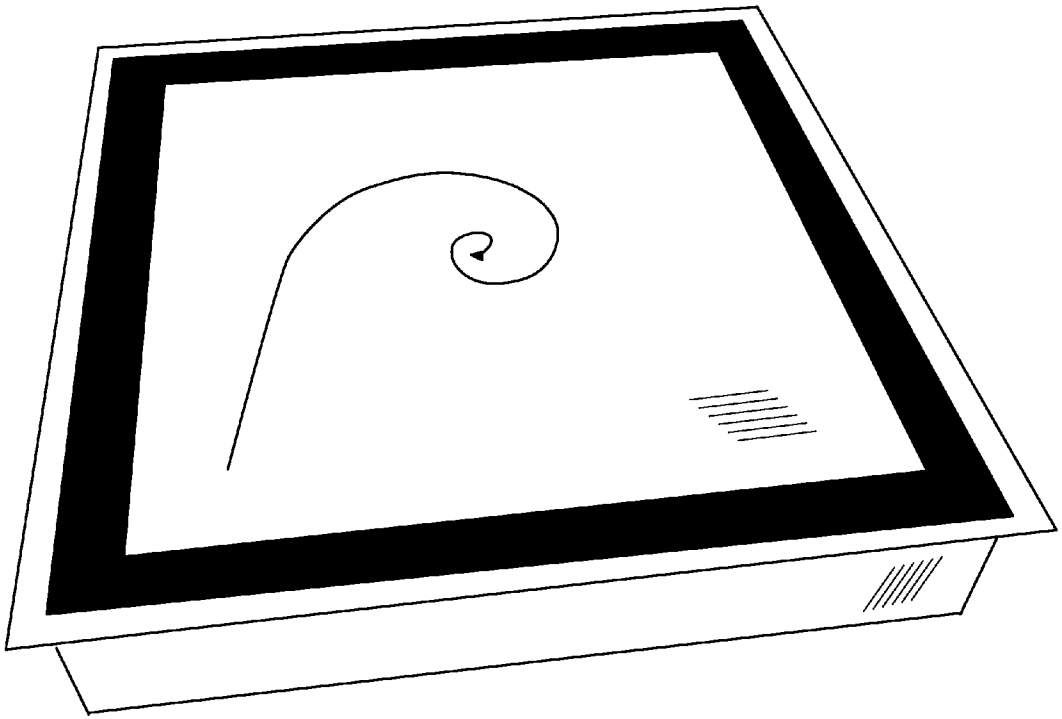
FIG. 57 shows a picture of the PCB board and energy absorbent siding coupled with the container.

FIG. 57 shows a picture of the PCB board and energy absorbent siding coupled with the container.

Figure 58:
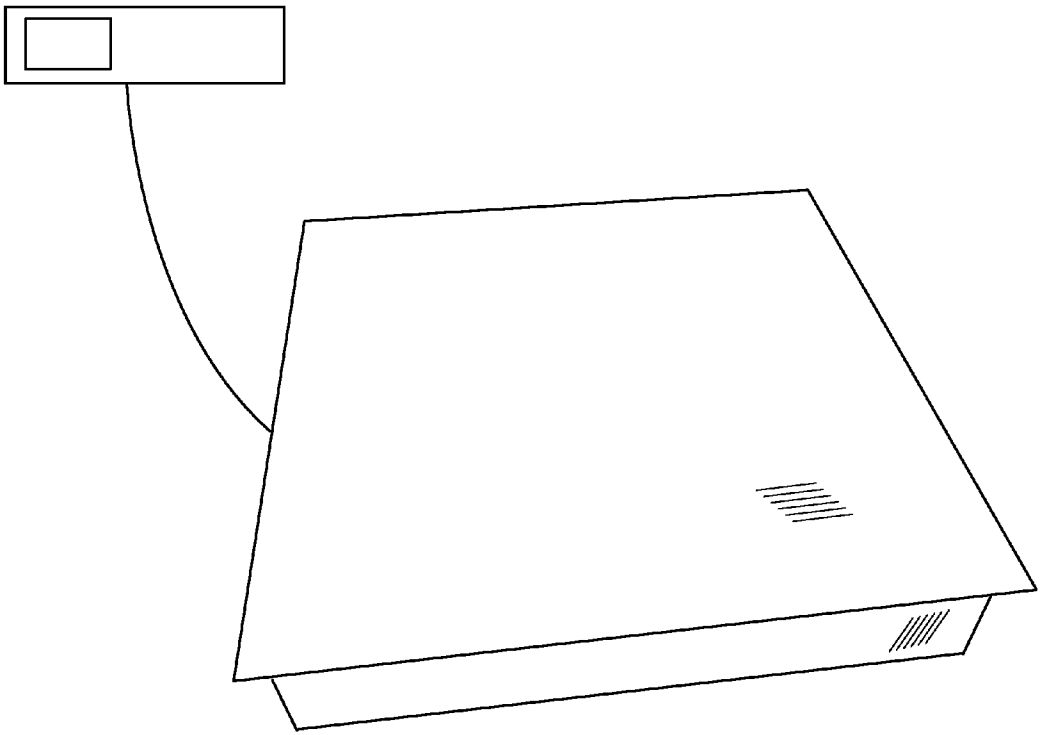
FIG. 58 shows a picture of an embodiment of the radome coupled to the container wherein the radome encloses the various parts within the container and wherein an embodiment of the invention is coupled to a vector network analyzer.

FIG. 58 shows a picture of an embodiment of the radome coupled to the container wherein the radome encloses the various parts within the container and wherein an embodiment of the invention is coupled to a vector network analyzer.

Figure 59:
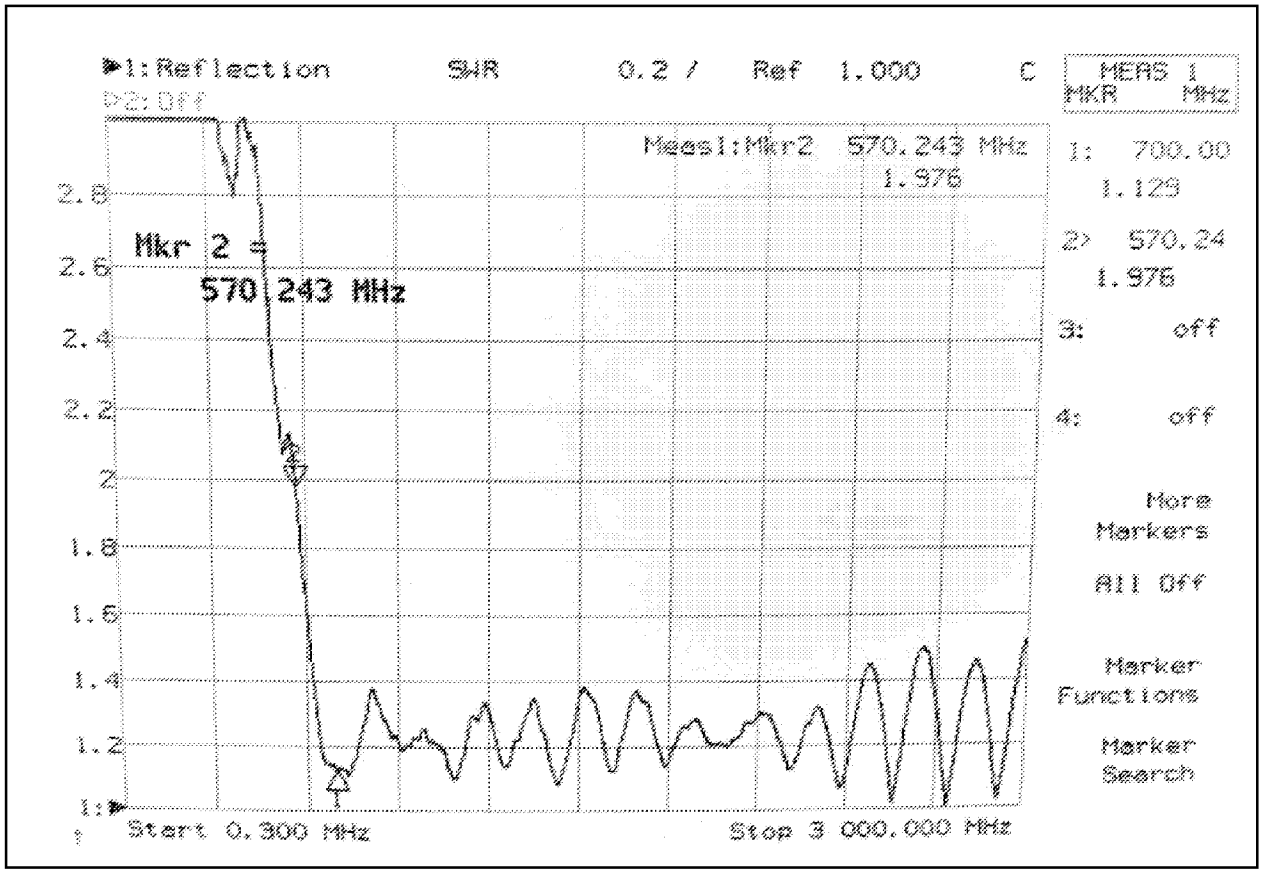
FIG. 59 shows a plot of Voltage Standing Wave Ratio (VSWR) versus frequency as measured on the prototype antenna using a vector network analyzer.

FIG. 59 shows a plot of Voltage Standing Wave Ratio (VSWR) versus frequency as measured on the prototype antenna using a vector network analyzer.

Figure 60:
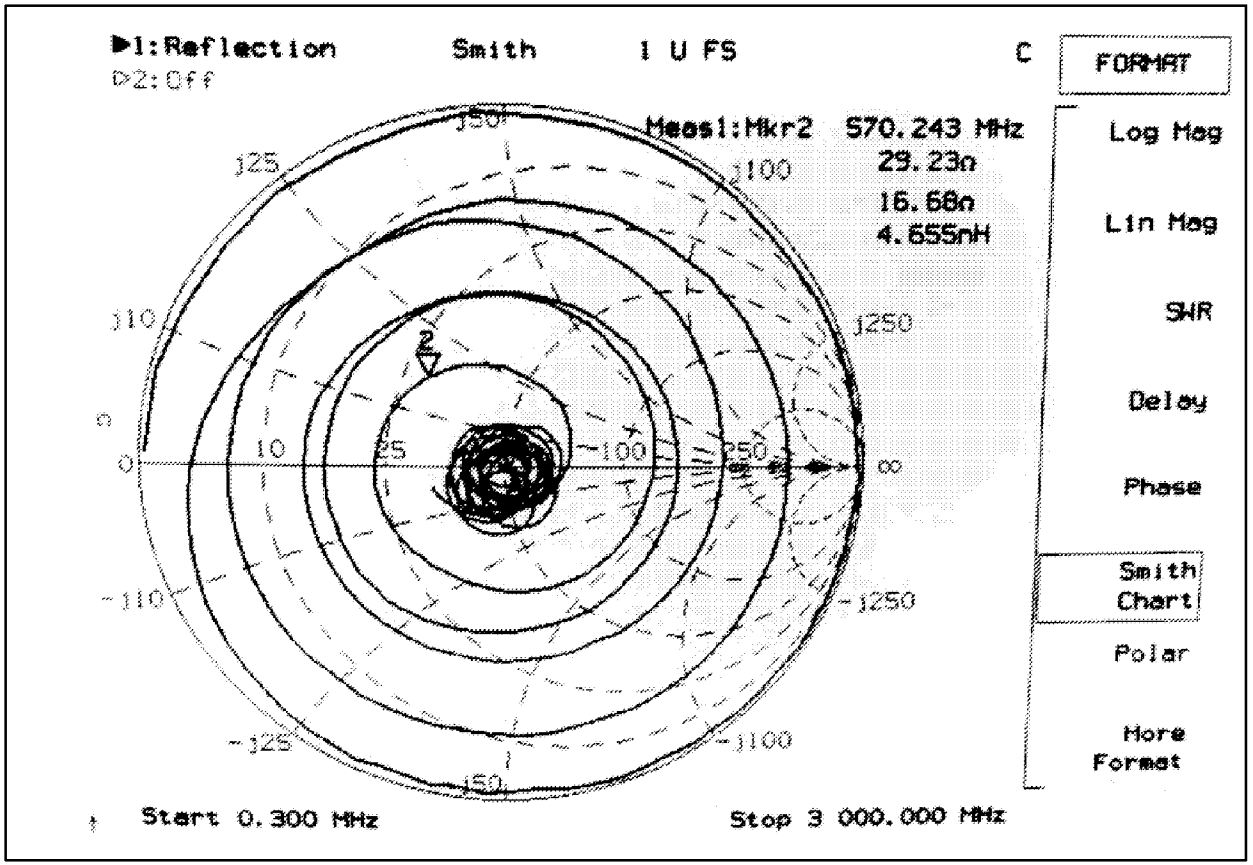
FIG. 60 shows a Smith Chart plot of the input impedance of the prototype antenna, referenced to 50 ohms.

FIG. 60 shows a Smith Chart plot of the input impedance of the prototype antenna, referenced to 50 ohms.

Figure 61:
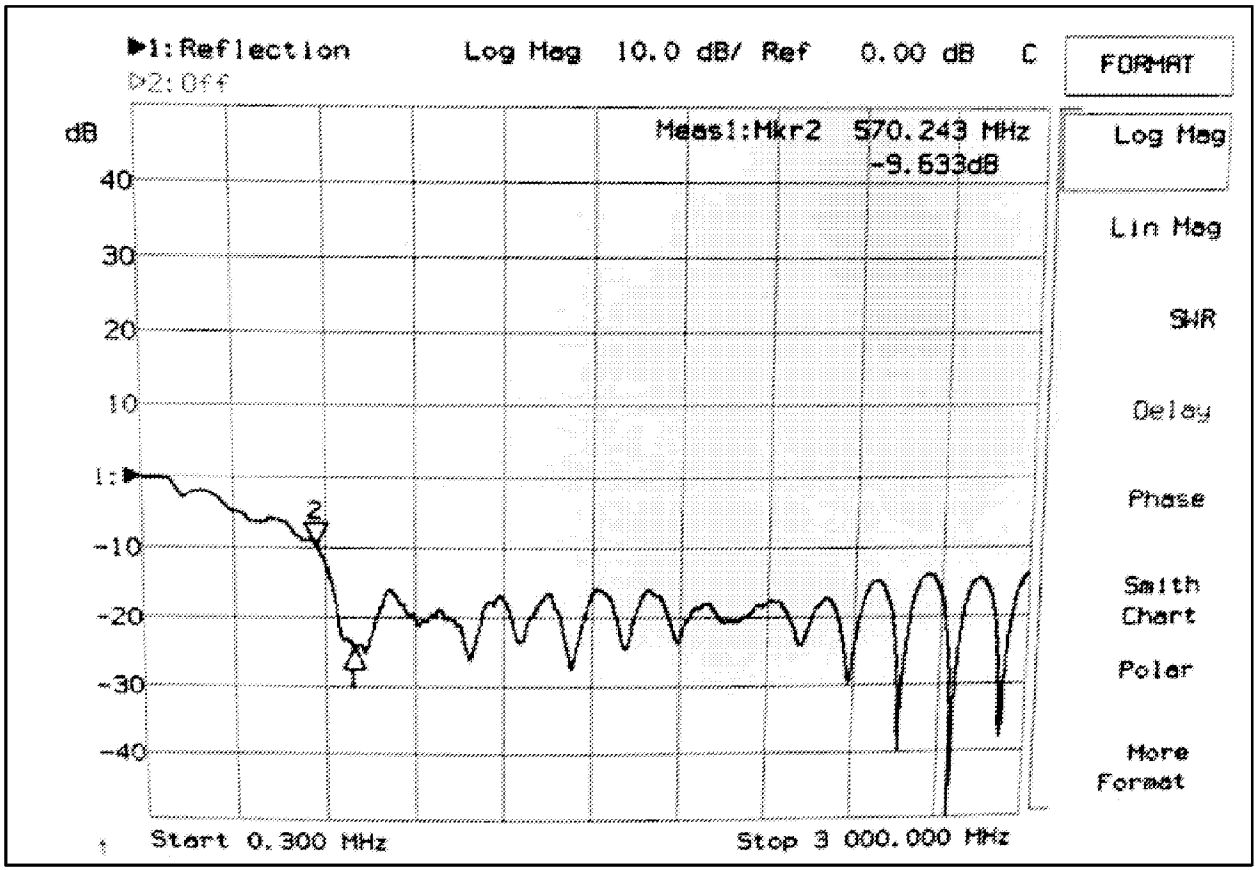
FIG. 61 shows a plot of Return Loss measured at the connector of the prototype antenna, referenced to 50 ohms, measured using a vector network analyzer.

FIG. 61 shows a plot of Return Loss measured at the connector of the prototype antenna, referenced to 50 ohms, measured using a vector network analyzer.

Figure 62:
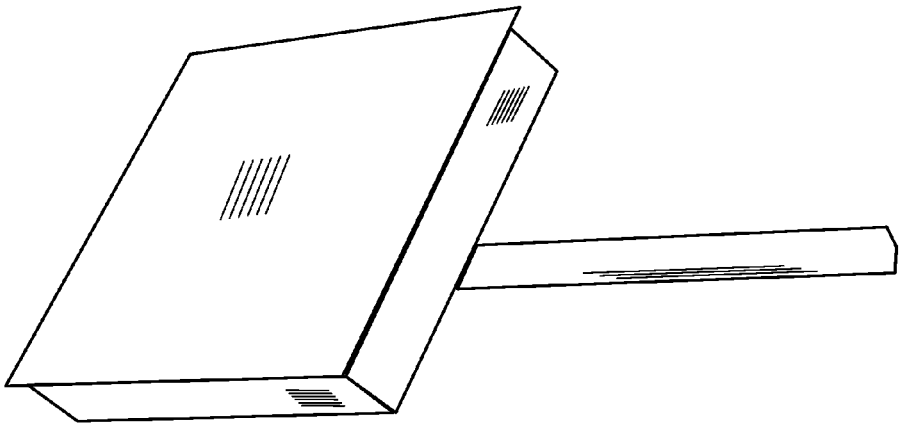
FIG. 62 shows an embodiment of the invention from below and to the side wherein the embodiment is mounted on a pole on an antenna range during the measurements described herein.

FIG. 62 shows an embodiment of the invention from below and to the side wherein the embodiment is mounted on a pole on an antenna range during the measurements described herein.

Figure 63:
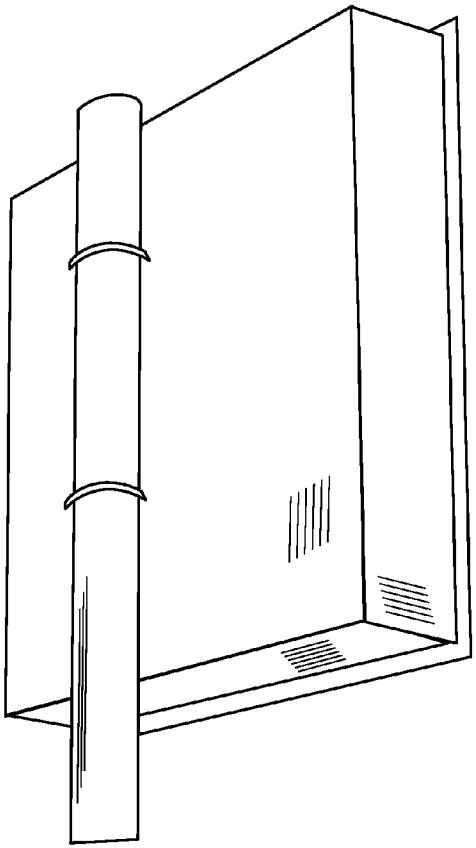
FIG. 63 shows an embodiment of the invention mounted on a pole from behind and to the side on an antenna range during the measurements described herein.

FIG. 63 shows an embodiment of the invention mounted on a pole from behind and to the side on an antenna range during the measurements described herein.

FIG. 64 shows actual antenna performance measured by an independent lab. The F/B or Front over Back ratio shows a worst case of 24 dB and a 30 dB F/B ratio at 950 MHz. The On-Axis Axial Ratio corresponds to that predicted in FIG. 37. The quantities measured relate to an embodiment of the invention for example, as implemented as shown in FIGS. 55-63.

While the ideas herein disclosed has been described by means of specific embodiments and applications thereof, numerous modifications and variations could be made thereto by those skilled in the art without departing from the scope of the invention set forth in the claims.

What is claimed is:

1. A directional planar log-spiral slot antenna comprising:

a log-spiral slot antenna comprising a feed-point configured to transfer energy to and from said log-spiral slot antenna, log-spiral shaped slots that begin at said feed-point and spiral outward and away from said feed-point toward an outer portion of said log-spiral slot antenna, an antenna impedance;

an energy absorbent backing;

an energy absorbent siding coupled with said energy absorbent backing and further coupled with said log-spiral slot antenna;

a cavity behind said log-spiral slot antenna and in front of a portion of said energy absorbent backing;

a cable connector having an input impedance wherein said cable connector is coupled to the feed-point; and, a container configured to hold said log-spiral slot antenna, said energy absorbent backing, said energy absorbent siding, said cavity, said cable connector.

2. The directional planar log-spiral slot antenna of claim 1 further comprising:

a transformer coupled between the cable connector and the feed-point and configured to transform the input impedance to the antenna impedance.

3. The directional planar log-spiral slot antenna of claim 1 further comprising:

a tapered microstrip line coupled between the cable connector and the feed-point and configured to transform the input impedance to the antenna impedance and provide a balanced output.

4. The directional planar log-spiral slot antenna of claim 1 wherein said log-spiral shaped slots at said outer portion of said log-spiral slot antenna overlap with said energy absorbent backing and wherein said feed-point overlaps said cavity.

5. The directional planar log-spiral slot antenna of claim 1 wherein said log-spiral slot antenna is coupled with a printed circuit board.

6. The directional planar log-spiral slot antenna of claim 1 wherein said energy absorbent backing and said energy absorbent siding is constructed from polyurethane impregnated with carbon.

7. The directional planar log-spiral slot antenna of claim 1 wherein said energy absorbent backing and energy absorbent siding has a net resistivity that is greater than zero Ohms/Square.

8. The directional planar log-spiral slot antenna of claim 1 wherein said energy absorbent backing and energy absorbent siding has a net resistivity of 200 to 400 Ohms/Square.

9. The directional planar log-spiral slot antenna of claim 1 wherein said antenna impedance is 150 Ohms.

10. The directional planar log-spiral slot antenna of claim 1 wherein said input impedance is 50 Ohms.

11. The directional planar log-spiral slot antenna of claim 1 wherein said container is conductive.

12. The directional planar log-spiral slot antenna of claim 1 wherein said container further comprises a gas vent.

13. The directional planar log-spiral slot antenna of claim 1 wherein said container further comprises a gas vent that is configured to block moisture from entering said container.

14. The directional planar log-spiral slot antenna of claim 1 further comprising a radome coupled with said container.

15. A method for constructing a directional planar log-spiral slot antenna comprising:

coupling a log-spiral slot antenna to a container wherein said log-spiral antenna comprises a feed-point configured to transfer energy to and from said log-spiral slot antenna, log-spiral shaped slots that begin at said feed-point and spiral outward and away from said feed-point toward an outer portion of said log-spiral slot antenna, an antenna impedance;

coupling an energy absorbent backing to said container;

coupling an energy absorbent siding with said energy absorbent backing and with said log-spiral slot antenna;

configuring a cavity behind said log-spiral slot antenna and in front of said energy absorbent backing;

coupling a cable connector having an input impedance to said container; and, coupling the cable connector and the feed-point.

16. The method for constructing a directional planar log-spiral slot antenna of claim 15 further comprising:

coupling a transformer between the cable connector and the feed-point; and, transforming the input impedance to the antenna impedance.

17. The method for constructing a directional planar log-spiral slot antenna of claim 15 further comprising:

coupling a tapered microstrip line between the cable connector and the feed-point; and, transforming the input impedance to the antenna impedance and providing a balanced output.

18. The method for constructing a directional planar log-spiral slot antenna of claim 15 further comprising:

overlapping said log-spiral shaped slots at said outer portion of said log-spiral slot antenna with said energy absorbent siding; and, overlapping said feed-point with said cavity.

19. The method for constructing a directional planar log-spiral slot antenna of claim 15 further comprising:

coupling a gas vent with said container.

20. The method for constructing a directional planar log-spiral slot antenna of claim 15 further comprising:

coupling a radome with said container.

* * * * *